US007537872B2

(12) United States Patent
Toda et al.

(10) Patent No.: US 7,537,872 B2
(45) Date of Patent: May 26, 2009

(54) IMAGE BEARING MEMBER WITH CHARGE BLOCKING LAYER AND MOIRE PREVENTION LAYER, AND IMAGE FORMING APPARATUS AND PROCESS CARTRIDGE USING THE SAME

(75) Inventors: Naohiro Toda, Yokohama (JP); Yasuyuki Yamashita, Zama (JP); Takeshi Orito, Numazu (JP)

(73) Assignee: Ricoh Company Limited, Tokyo (JP)

( * ) Notice: Subject to any disclaimer, the term of this patent is extended or adjusted under 35 U.S.C. 154(b) by 255 days.

(21) Appl. No.: 11/403,012

(22) Filed: Apr. 13, 2006

(65) Prior Publication Data

US 2006/0240346 A1 Oct. 26, 2006

(30) Foreign Application Priority Data

Apr. 13, 2005 (JP) ..... 2005-115454
Jun. 23, 2005 (JP) ..... 2005-183793

(51) Int. Cl.
*G03G 5/147* (2006.01)
*G03G 5/14* (2006.01)

(52) U.S. Cl. ..... 430/59.5; 430/60; 430/64; 430/66; 430/58.7; 399/159

(58) Field of Classification Search ..... 430/64, 430/60, 58.7, 66, 59.5; 399/159
See application file for complete search history.

(56) References Cited

U.S. PATENT DOCUMENTS 3,640,708 A 2/1972 Humphriss et al.
4,855,204 A 8/1989 Fujii et al.
5,017,449 A 5/1991 Yoshihara
5,071,723 A * 12/1991 Koyama et al. ..... 430/64
5,279,914 A * 1/1994 Aizawa et al. ..... 430/64
2004/0053149 A1 3/2004 Toda et al.
2004/0120730 A1 6/2004 Niimi et al.
2004/0126686 A1 7/2004 Toda et al.
2004/0234875 A1 11/2004 Toda et al.
2005/0026058 A1 2/2005 Kami et al.
2005/0053853 A1 3/2005 Sugino et al.

(Continued)

FOREIGN PATENT DOCUMENTS

EP 1521126 A1 * 4/2005

(Continued)

OTHER PUBLICATIONS

Frank H. Moser et al., "The Phthalocyanines," vol. II, Manufacture and Applications.

(Continued)

*Primary Examiner*—Christopher RoDee
(74) *Attorney, Agent, or Firm*—Oblon, Spivak, McClelland, Maier & Neustadt, P.C.

(57) ABSTRACT

An image bearing member including an electroconductive substrate, a charge blocking layer disposed overlying the electroconductive substrate, a moire prevention layer disposed overlying the charge blocking layer, and a photosensitive layer disposed overlying the moire prevention layer. The charge blocking layer contains N-alkoxymethylized nylon and optionally at least one of an aliphatic dicarboxylic acid and an aliphatic tricarboxylic acid. The moire prevention layer contains a titanium oxide having a purity not less than 99.0% and a cross-linking resin.

26 Claims, 13 Drawing Sheets

U.S. PATENT DOCUMENTS

| | | | | |
|---|---|---|---|---|
| 2005/0058918 | A1 | 3/2005 | Kurimoto et al. | |
| 2005/0118518 | A1 | 6/2005 | Ikegami et al. | |
| 2005/0141919 | A1 | 6/2005 | Kitajima et al. | |
| 2005/0158641 | A1 | 7/2005 | Yanagawa et al. | |
| 2005/0158644 | A1 | 7/2005 | Kondo et al. | |
| 2005/0181291 | A1 | 8/2005 | Kami et al. | |
| 2005/0266325 | A1 | 12/2005 | Yanagawa et al. | |
| 2005/0287452 | A1 | 12/2005 | Tamura et al. | |
| 2006/0051688 | A1 | 3/2006 | Toda et al. | |
| 2006/0134540 | A1* | 6/2006 | Kondo et al. | 430/64 |

FOREIGN PATENT DOCUMENTS

| | | | |
|---|---|---|---|
| EP | 1 672 003 | A1 | 6/2006 |
| EP | 1 521 126 | B1 | 11/2006 |
| JP | 52-010138 | | 1/1977 |
| JP | 52-082238 | | 7/1977 |
| JP | 54-036859 | | 3/1979 |
| JP | 55-113045 | | 9/1980 |
| JP | 58-058556 | | 4/1983 |
| JP | 58-093062 | | 6/1983 |
| JP | 58-095351 | | 6/1983 |
| JP | 58-105155 | | 6/1983 |
| JP | 59-017557 | | 1/1984 |
| JP | 59-093453 | | 5/1984 |
| JP | 60-032054 | | 2/1985 |
| JP | 60-066258 | | 4/1985 |
| JP | 60-111255 | | 6/1985 |
| JP | 61-239248 | | 10/1986 |
| JP | 64-017066 | | 1/1989 |
| JP | 64-068762 | | 3/1989 |
| JP | 64-068763 | | 3/1989 |
| JP | 64-073352 | | 3/1989 |
| JP | 64-073353 | | 3/1989 |
| JP | 01-118848 | | 5/1989 |
| JP | 01-118849 | | 5/1989 |
| JP | 01-299874 | | 12/1989 |
| JP | 02-008256 | | 1/1990 |
| JP | 03-109406 | | 5/1991 |
| JP | 03-255456 | | 11/1991 |
| JP | 03-269064 | | 11/1991 |
| JP | 04-170552 | | 6/1992 |
| JP | 04-269761 | | 9/1992 |
| JP | 05-080572 | | 4/1993 |
| JP | 05-094049 | | 4/1993 |
| JP | 5-113688 | | 5/1993 |
| JP | 06-019174 | | 1/1994 |
| JP | 06-208238 | | 7/1994 |
| JP | 06-222600 | | 8/1994 |
| JP | 8-029999 | | 2/1996 |
| JP | 08-110649 | | 4/1996 |
| JP | 08-184979 | | 7/1996 |
| JP | 09-190005 | | 7/1997 |
| JP | 09-288367 | | 11/1997 |
| JP | 10-268543 | | 10/1998 |
| JP | 11-005919 | | 1/1999 |
| JP | 2000-206723 | | 7/2000 |
| JP | 2001-019871 | | 1/2001 |
| JP | 2001-034001 | | 2/2001 |
| JP | 2001-209200 | | 8/2001 |
| JP | 2002-131961 | | 5/2002 |
| JP | 2002-268335 | | 9/2002 |
| JP | 2003-098705 | | 4/2003 |
| JP | 06-293769 | | 10/2004 |

OTHER PUBLICATIONS

U.S. Appl. No. 12/030,886, filed Feb. 14, 2008, Toda, et al.

* cited by examiner

IMAGE BEARING MEMBER WITH CHARGE BLOCKING LAYER AND MOIRE PREVENTION LAYER, AND IMAGE FORMING APPARATUS AND PROCESS CARTRIDGE USING THE SAME

BACKGROUND OF THE INVENTION

1. Field of the Invention

The present invention relates to an image bearing member, image forming apparatus and process cartridge.

2. Discussion of the Background

Recently, image bearing members have been actively developed using organic photoconductive materials as photoconductive materials for use in image bearing members, which have advantages over inorganic materials such as Se, CdS and ZnO in terms of sensitivity, thermal stability and toxicity. Image bearing members formed of such organic photoconductive materials have been provided in a number of photocopiers and printers. When a photosensitive layer of an image bearing member formed of such organic photoconductive materials is formed, a function separation type in which a charge transport layer is accumulated on a charge generating layer is widely used because the function separation type has excellent sensitivity and durability. Generally, in an image forming apparatus such as printers, photocopiers and facsimile machines, images are formed through the series of repeated processes of charging, irradiating, developing, transferring and fixing. In recent years, with the advance of speed and durability of electrophotographic photocopiers, image bearing members have been demanded to have a high reliability such that quality images can be produced for repetitive use for an extended period of time. Especially, since the copy volume is large in the case of an ultra high speed photocopier, the image formation thereby is relatively frequently suspended by replacing the image bearing member, which causes significant decline of the productivity. In the case of color image formation, a tandem system in which 4 color developing systems are arranged is popularly diffused. To avoid the size increase of a photocopying machine, an image bearing member having a relatively small diameter is used. Therefore, such an image bearing member is demanded to have a higher durability corresponding to the speed-up of image formation.

With regard to the durability, one of abnormal images ascribable to an image bearing member is background fouling in the currently dominant image formation system, i.e., negative positive development. Specific causes of background fouling are, for example, the contamination and deficiency of an electroconductive substrate, the electric insulation breakdown of a photosensitive layer, the infusion of carriers (charge) from a substrate, the increase of dark decay of an image bearing member, and the thermal generation of carriers. Among these, it is possible to deal with the contamination and deficiency of an image bearing member by eliminating such a substrate before applying a photosensitive layer thereto. Since this is caused by an error in a sense, this does not make an essential cause. Therefore, it is thought that the background problem can be fundamentally solved by improving the property of anti-dielectric breakdown of an image bearing member and preventing the charge infusion from a substrate and electrostatic fatigue of an image bearing member.

In consideration of these, technologies such that an undercoating layer or an intermediate layer is provided between an electroconductive substrate and a photosensitive layer have been proposed in the past. For example, JOP S47-6341 describes an intermediate layer containing a cellulose nitrate based resin, JOP S60-66258 describes an intermediate layer containing a nylon based resin, JOP S52-10138 describes an intermediate layer containing a maleic acid based resin, and JOP S58-105155 describes an intermediate layer containing a polyvinyl alcohol resin. However, such a single intermediate layer formed of a simple resin has a high electric resistance, which causes the residual potential to rise. As a result, the image density deteriorates in a negative positive development.

In addition, such an intermediate layer shows ion conductivity caused by impurities. Therefore, the electric resistance of the intermediate layer is extremely high in a low temperature and low humid circumstance. This extremely raises the residual voltage. Therefore, it is necessary to make the thickness of an intermediate layer thinner, which causes a drawback that the charging property is not sufficient after repetitive use.

To deal with these problems, JOP 2002-131961 describes a technology to control the electric resistance of an intermediate layer in which an image bearing member having an intermediate layer containing a thermosetting resin and a specific contact angle is provided. Further, as a method of adding a conductive additive to an intermediate layer bulk, JOP S51-65942 describes an intermediate layer in which carbon or chalcogen based material is dispersed in a curing resin, JOP S52-82238 describes a thermopolymeric intermediate layer in which a quaternary ammonium salt is added and an isocyanate based curing agent is used, JOP S55-113045 describes a resin intermediate layer in which a resistance controlling agent is added, JOP S58-93062 describes an intermediate resin layer in which an organic metal compound is added, and JOP H04-269761 and H10-268543 describe an intermediate layer in which a cross linking agent is contained in a polyamide resin. However, there is a problem that, when these single intermediate resin layers are used in an image forming apparatus of late years using coherent light such as a laser beam, moiré is observed in images obtained.

Further, to prevent moiré and control the electric resistance of an intermediate layer at the same time, an image bearing member having a filler in its intermediate layer is proposed. For example, JOP S58-58556 describes an intermediate resin layer in which an oxide of aluminum or tin is dispersed. JOP S60-111255 describes an intermediate layer in which electroconductive particles are dispersed. JOP S59-17557 describes an intermediate layer in which a magnetite is dispersed. JOP S60-32054 describes an intermediate resin layer in which titanium oxide and tin oxide are dispersed. JOPs S64-68762, S64-68763, S64-73352, S64-73353, H01-118848 and H01-118849 describe an intermediate resin layer in which powder of borides, nitrides, fluorides and oxides of calcium, magnesium, aluminum, etc., are dispersed. JOPs 2001-209200 and 2003-98705 describe an intermediate layer in which two kinds of organic particles having a different average particle diameter are dispersed.

To have suitable electric characteristics by the filler dispersed, such an intermediate layer in which a filler is dispersed contains the filler in a large amount, that is, the amount of a resin contained therein decreases. Therefore, there is a problem that, as the content of a resin decreases, the adhesive property between the intermediate layer and an electroconductive substrate deteriorates, which easily causes detachment thereof. Especially, this has a significant adverse effect on an image bearing member formed of an electroconductive substrate having a flexible belt form.

To deal with these problems, a technology of a layered intermediate layer is proposed. Largely, there are two layered types. One is that a resin layer 102 in which a filler is dispersed and another resin layer 103 in which a filler is not dispersed are disposed on an electroconductive substrate 101 in this order (refer to FIG. 1). The other is that the resin layer 103 in which a filler is not dispersed and the resin layer 102 in which a filler is dispersed are accumulated on the electroconductive substrate 101 in this order (refer to FIG. 2).

The former structure is detailed as follows. To seal off the deficiency mentioned above involved in a substrate, an electroconductive layer in which a filler having a low electroconductivity is dispersed is provided on an electroconductive substrate. Further, the resin layer mentioned above is provided on the electroconductive filler dispersed layer. For example, JOPs S58-95351, S59-93453, H04-170552, H06-208238, H06-222600, H08-184979, H09-43886, H09-190005, and H09-288367 describe such a structure.

Since the electroconductive filler dispersed layer disposed as the bottom layer in this structure functions as an electrode of the electroconductive substrate in an essential sense, the electrostatic problem involved in the image bearing members having a single intermediate resin layer mentioned above still remains. But the electroconductive layer is formed of a filler dispersed film and can scatter writing beam so that moiré can be prevented. In this structure, since the bottom layer is an electroconductive layer, charges reversely charged to the polarity of the surface of an image bearing member during charging can reach the interface between the bottom layer (electroconductive layer) and the top layer (intermediate resin layer) Thereby, the image bearing member can function. However, when the resistance of the electroconductive layer is not sufficiently low, the charge infusion from the electrode is not sufficient, either. Therefore, such a bottom layer can be a resistance component during repetitive use, which causes significant increase of the residual voltage. This problem has a significant meaning because it is necessary to make the bottom layer sufficiently thick (not less than 10 μm) to seal off the deficiency of an electroconductive substrate, which is one of the objects of this structure.

To the contrary, the latter structure is a structure in which a single positive hole blocking resin layer is provided on an electroconductive substrate and a resin layer is provided thereon in which a filler having a low resistance or an electroconductive filler is dispersed as described in JOPS H05-80572 and H06-19174. This structure has the same positive hole blocking function as the former structure and therefore is effective against the background fouling. In addition, since the top layer is a filler dispersed layer, the accumulation property of the residual voltage is relatively low in comparison with that of the former structure. As mentioned above, this structure can prevent charge (positive hole) infusion from an electroconductive substrate to a photosensitive layer so that the background fouling phenomenon in the negative positive development can be significantly reduced. Further, by disposing a charge blocking layer as the bottom layer, the rise of the residual voltage is relatively small during repetitive use in comparison with when a charge blocking layer is disposed as the top layer.

An image bearing member having a layered intermediate layer formed of a charge blocking layer dispersed as the bottom layer and a filler dispersed layer as the top layer is effective to prevent the background fouling as mentioned above. However, such an image bearing member has a problem in that the charging responsibility thereof decreases after repetitive use over an extended period of time and the charging voltage is low only during a first rotation of the image bearing member. Thereby, the background fouling ascribable to the low charging voltage occurs at the top portion of a first output image. As a method adopted for avoiding this phenomenon, the first rotation of an image bearing member is not for use in image formation and images are formed when and after the image bearing member rotates twice. As another method, JOP 2002-268335 describes a method of providing a preliminary charging process. Naturally, these methods involve problems such as the speed-down of image formation and the size increase of a device and are therefore not suitable in terms of long durability required along with demands of late, i.e., the reduction of the diameter of an image bearing member and speed-up of an electrophotographic device.

SUMMARY OF THE INVENTION

Because of these reasons, the present inventors recognize that a need exists for an image bearing member, and corresponding image forming apparatus and process cartridge, which can form images without reducing the image density, causing background fouling, etc., even for an extended repetitive use and stably perform image formation from the first rotation of the image bearing member.

Accordingly, an object of the present invention is to provide an image bearing member, and corresponding image forming apparatus and process cartridge, which can form images without reducing the image density, causing background fouling, etc., even for an extended repetitive use and stably perform image formation from the first rotation of the image bearing member.

Briefly this object and other objects of the present invention as hereinafter described will become more readily apparent and can be attained, either individually or in combination thereof, by an image bearing member including an electroconductive substrate, a charge blocking layer disposed overlying, i.e., including contact or no contact, the electroconductive substrate, a moire prevention layer disposed overlying the charge blocking layer, and a photosensitive layer disposed overlying the moire prevention layer. The charge blocking layer contains N-alkoxymethylized nylon and optionally at least one of an aliphatic dicarboxylic acid and an aliphatic tricarboxylic acid. The moire prevention layer contains a titanium oxide having a purity not less than 99.0% and a cross-linking resin.

It is preferred that, in the image bearing member mentioned above, the content of the titanium oxide contained in the moiré prevention layer is from 50 to 75% by volume.

It is still further preferred that, in the image bearing member mentioned above, the titanium oxide is titanium oxide (T1) having a specific surface area of from 5 to 8 $m^2/g$ and titanium oxide (T2) having a surface are of from 20 to 35 $m^2/g$ It is still further preferred that, in the image bearing member mentioned above, the mixing ratio (weight ratio) of the two kinds of titanium oxides satisfies the following relationship: $0.2 \leqq T2/(T1+T2) \leqq 0.6$.

It is still further preferred that, in the image bearing member mentioned above, the cross-linking resin contained in the moiré prevention layer is a thermosetting resin which is a mixture of an alkyd resin and a melamine resin with a mixing ratio of the alkyd resin to the melamine resin of from 1 to 4.

It is still further preferred that, in the image bearing member mentioned above, the aliphatic dicarboxylic acid and the aliphatic tricarboxylic acid are any one of maleic acid, fumaric acid, succinic acid, malic acid, adipic acid, tricarballylic acid and citric acid.

It is still further preferred that, in the image bearing member mentioned above, the content ratio of the aliphatic dicarboxylic acid and the aliphatic tricarboxylic acid to the N-alkoxymethylized nylon is from 0.005 to 0.1.

It is still further preferred that, in the image bearing member mentioned above, the layer thickness of the charge blocking layer containing the N-alkoxymethylized nylon is from 0.5 to 2.0 μm.

It is still further preferred that, in the image bearing member mentioned above, the photosensitive layer has a layer structure comprising a charge generating layer and a charge transport layer.

It is still further preferred that, in the image bearing member mentioned above, the charge generating layer contains a charge generating material containing titanyl phthalocyanine.

It is still further preferred that, in the image bearing member mentioned above, the titanyl phthalocyanine has a primary particle diameter of not greater than 0.25 μm and having a crystal form having a CuKα X ray diffraction spectrum having a wavelength of 1.542 Å such that a maximum diffraction peak is observed at a Bragg (2θ) angle of 27.2±0.2°, main peaks at a Bragg (2θ) angle of 9.4±0.2°, 9.6±0.2°, and 24.0±0.2°, and a peak at a Bragg (2θ) angle of 7.3±0.2° as a lowest angle diffraction peak, and having no peak between 9.4±0.2° and 7.3±0.2° and no peak at 26.3±0.2°.

It is still further preferred that, in the image bearing member mentioned above, a liquid dispersion is applied to form the photosensitive layer or the charge generating layer and the liquid dispersion is prepared by dispersing the titanyl phthalocyanine such that a crystal thereof has an average particle size not greater than 0.3 μm with a standard deviation not greater than 0.2 μm and filtering the resultant titanyl phthalocyanine with a filter having an effective mesh diameter not greater than 3 μm.

It is still further preferred that, in the image bearing member mentioned above, the titanyl phthalocyanine crystal is prepared by performing crystal-conversion of an amorphous or low crystalline titanyl phthalocyanine with an organic solvent under the presence of water, the amorphous or low crystalline titanyl phthalocyanine having an average primary particle diameter not greater than 0.1 μm and having a CuKα X ray diffraction spectrum having a wavelength of 1.542 Å such that the maximum diffraction peak is observed at a Bragg (2θ) angle of 7.0 to 7.5±0.2° with a half value width of at least 1°, and separating and filtrating the crystal converted titanyl phthalocyanine from the organic solvent before the primary average particle diameter of the crystal converted titanyl phthalocyanine is greater than 0.25 μm.

It is still further preferred that, in the image bearing member mentioned above, the titanyl phthalocyanine crystal is synthesized of a material excluding a halogenated compound.

It is still further preferred that, in the image bearing member mentioned above, the amorphous titanyl phthalocyanine used for the crystal conversion of the titanyl phthalocyanine is prepared by an acid paste method and washed with a deionized water until the deionized water after washing has at least one of a pH of from 6 to 8 and a specific conductivity not greater than 8 μS/cm.

It is still further preferred that, in the image bearing member mentioned above, the ratio by weight of the organic solvent used during the crystal conversion of the titanyl phthalocyanine to the amorphous titanyl phthalocyanine is not less than 30/1.

It is still further preferred that, in the image bearing member mentioned above, a protective layer containing a binder resin is disposed overlying, i.e., including contact or no contact, the photosensitive layer.

It is still further preferred that, in the image bearing member mentioned above, the protective layer contains an inorganic dye or a metal oxide having a specific electric resistance not less than $10^{10}$ Ωcm.

It is still further preferred that, in the image bearing member mentioned above, the metal oxide is one of alumina, titanium oxide and silica having a specific electric resistance not less than $10^{10}$ Ωcm.

It is still further preferred that, in the image bearing member mentioned above, the alumina is α-alumina.

It is still further preferred that, in the image bearing member mentioned above, the protective layer contains a charge transport polymer.

22. It is still further preferred that, in the image bearing member mentioned above, the binder resin contained in the protective layer has a cross-linking structure.

It is still further preferred that, in the image bearing member mentioned above, the protective layer is formed by curing at least a radical polymeric monomer having three or more functional groups without a charge transport structure and a radical polymeric compound having one functional group with a charge transport structure.

It is still further preferred that, in the image bearing member mentioned above, the radical polymeric monomer is at least one of acryloyloxy group and methacryloyloxy group.

As another aspect of the present invention, an image forming apparatus is provided which includes the image bearing member mentioned above to bear a latent electrostatic image, a charging device to charge the image bearing member, an irradiating device to irradiate the image bearing member, a developing device to develop the latent electrostatic image, a transfer device to transfer the developed image to a transfer body, and a cleaning device to clean the surface of the image bearing member.

As another aspect of the present invention, another image forming apparatus is provided which includes a process cartridge detachably attached to the image forming apparatus. The process cartridge includes the image bearing member mentioned above and at least one of the charging device, the irradiating device, the developing device and the cleaning device mentioned above.

As another aspect of the present invention, a process cartridge is provided which includes the image bearing member mentioned above, and at least one of a charging device to charge the image bearing member, an irradiating device to irradiate the image bearing member, a developing device to develop the latent electrostatic image, a transfer device to transfer the developed image to a transfer body and a cleaning device to clean a surface of the image bearing member.

These and other objects, features and advantages of the present invention will become apparent upon consideration of the following description of the preferred embodiments of the present invention taken in conjunction with the accompanying drawings.

BRIEF DESCRIPTION OF THE DRAWING

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
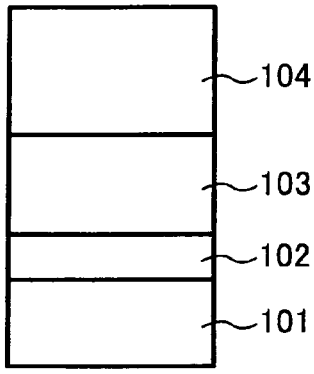
FIG. 1 BACKGROUND ART
FIG. 1 is a schematic diagram illustrating an intermediate layer including a resin layer in which a filler is dispersed and a resin layer in which a filer is not dispersed are disposed on an electroconductive substrate in this order.
Figure 2:
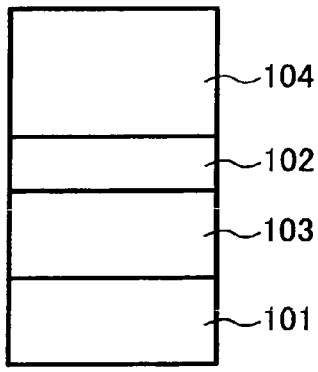
FIG. 2 BACKGROUND ART
FIG. 2 is a schematic diagram illustrating an intermediate layer including a resin layer in which a filler is not dispersed and a resin layer in which a filer is dispersed are disposed on an electroconductive substrate in this order.

The present invention will be described below in detail with reference to several embodiments and accompanying drawings.

To begin with, the charge blocking layer of the image bearing member of the present invention is described.

The charge blocking layer of the image bearing member of the present invention is desired to show insulation and not to be soluble in liquid of application for use in a moire prevention layer and/or a photosensitive layer. Nylon resins are a suitable example. Among these, N-alkoxymethylized nylon for use in the present invention can be obtained by modifying polyamide 6, polyamide 12 or a copolymer polyamide containing these as a component, for example, by the method proposed in J. A.m. Chem. Soc. 71. P651 (1949) (authored by T. L. Cairns. N-alkoxymethylized nylon is a compound obtained by substituting hydrogen in the amide linking of the original polyamide with methoxymethyl group. The substitution ratio can be determined depending on modification conditions and is preferably not less than 15 mol % to restrain the moisture absorption of the charge blocking layer, which is preferred in terms of environmental stability.

In the present invention, when the N-alkoxymethylized nylon optionally contains at least one of an aliphatic dicarboxylic acid and aliphatic tricarboxylic acid, it is possible to prevent the reduction of charging for a first rotation of an image bearing member caused by fatigue during repetitive use, which leads to high speed image formation.

Specific examples of the aliphatic dicarboxylic acids include oxalic acid, malonic acid, succinic acid, glutaric acid, adipic acid, β-methyl adipic acid, pimelic acid, azelaic acid, sebacic acid, nonane dicarboxylic acid, decane dicarboxylic acid, undecane dicarboxylic acid, dodecane dicarboxylic acid, maleic acid, fumaric acid, citraconic acid, diglycol acid, malic acid, tartaric acid, and cyclohexane dicarboxylic acid. In addition, specific examples of the aliphatic tricarboxylic acids include tricarballylic acid, cirtic acid, aconitic acid and camphoronic acid. Among these, maleic acid, fumaric acid, succinic acid, tartaric acid, malic acid, adipic acid, tricarballylic acid and cirtic acid have excellent characteristics. It is possible to obtain a large effect by containing such a dicarboxylic acid in an amount of preferably 0.005 to 0.1 parts by weight and more preferably 0.01 to 0.05 parts by weight based on 1 part by weight of N-alkoxymethylized nylon.

In addition, since N-alkoxymethylized nylon is soluble in alcohols, an alcohol based solvent such as methanol, ethanol, propane, butanol and a mixture thereof is used as a liquid of application for the charge blocking layer. Among these, methanol is most preferred since N-alkoxymethylized nylon for use in the present invention is most soluble in methanol among these.

However, when methanol is singly used as the liquid of application, the solvent evaporates quickly and its latent heat is high. Therefore, coating film deficiency referred to as blushing occurs when the film is formed and dried. To avoid this, it is preferred to use methanol in combination with an alcohol based solvent which is slow in evaporation. As other alcohol based solvents, an alcohol based solvent having 3 or more carbon atoms is preferably used because an alcohol based solvent not having a large number of carbon atoms does not effectively prevent blushing. Specific examples thereof include n-propanol, iso-propanol, n-butanol, iso-butanol, tert-butanol, and n-pentanol. When the number of carbon atoms are too great, blushing is long and the solubility of N-alkoxymethylized nylon is reduced. Therefore, suitable number of carbon atoms are not greater than 6.

In addition, water can be added as another mixable solvent other than the alcohol based solvent mentioned above to increase the compatibility of N-alkoxymethylized nylon and the alcohol-based solvent, which may lead to increase of temporary stability of a liquid of application. The content of water in the solvent is preferably from 5 to 20% by weight in terms of combination of applicability and solvent stability. The content is represented in weight ratio of the water in the total solvent for use in a liquid of application.

Tapped water can be used as the water for use in the present invention but distilled water and deionized water, in which impurities are removed, are suitable. In addition, water filtered with a filter having a suitable mesh size is further preferred.

In addition, depending on the design of charge blocking layer formed of this liquid of application, a filler and/or an additive such as a charge accepting material, a curative agent and a dispersant can be added. If desired, an organic solvent other than alcohol based solvent can be also added.

Next, the moiré prevention layer of the image bearing member of the present invention is now described.

The moiré prevention layer is a layer having a function of preventing the occurrence of moiré images caused by optical coherence inside a photosensitive layer when writing is performed by a coherent light such as a laser beam. Fundamentally, the layer has a function of scattering the writing laser beam mentioned above. Due to such a function, it is effective for a moiré prevention layer to contain a material having a large refraction index. Generally, such a moiré layer contains a binder resin in which an inorganic pigment is dispersed. Especially, white pigment is effectively used. For example, titanium oxide, calcium fluoride, silicon oxide, magnesium oxide, aluminum oxide, etc., are suitably used. In the present invention, it is possible to prevent the decrease of charge occurring during a first rotation of a photoreceptor when the fatigue caused by repetitive use accumulates by containing titanium oxide having a purity not less than 99.0% and a cross-linking resin. Further, it is preferred for the moiré prevention layer to contain two kinds of titanium oxides, which are titanium oxide (T1) preferably having a specific surface area of from 5 to 8 $m^2/g$ and titanium oxide (T2) preferably having a specific surface area of from 20 to 35 $m^2/g$ Further, titanium oxide having a high purity contained in the moiré prevention layer is especially effective when the content thereof is from 50 to 75% by volume. When the content of titanium oxide having a high purity is too small, the moiré prevention effect tends to be small. In addition, since the contact area between the titanium oxide having a high purity and a charge blocking area is reduced, the charging during a first rotation of an image bearing member tends to lower. To the contrary, when the content of titanium oxide having a high purity is too large, the moiré prevention layer is easily peeled and particles of the titanium oxide or the two kinds of titanium oxides mentioned above tend to be not uniformly dispersed, which prevents the effect of preventing the reduction of charging during a first rotation of an image bearing member.

Furthermore, as described in the present invention, in an image bearing member having a charge blocking layer, a moiré prevention layer and a photosensitive layer, it is desired to limit the content ratio of the two kinds of used titanium oxide having a high purity within a specific range to have a good combination of moiré prevention and restraint of the charge decrease during a first rotation of an image bearing member. When the mixing ratio of the titanium oxide (T2) having a large specific surface area is too small, the effect of preventing the charge decrease during a first rotation of an image bearing member is not sufficient. When the mixing ratio is too great, the optical scattering ability of a moiré prevention layer decreases so that the moiré prevention function is not sufficient.

Titanium oxide having a purity not less than 99.0% for use in the present invention can be manufactured by the following method referred to as chlorination method: chlorinating a material, i.e., titan slug, with chlorine to obtain titanium tetrachloride; subsequent to separation, condensation and refinement, oxidizing the resultant; pulverizing and classifying the obtained titanium oxide; and subsequent to filtration, washing and drying, pulverizing the resultant. Impurities contained in the titanium oxide are mainly moisture absorption materials and ionic materials such as $Na_2O$ and $K_2O$. The purity of titanium oxide can be measured according to JIS K5116 (Titanium dioxide (pigment)), which regulates the quality of a pigment formed of titanium dioxide and corresponding test method.

Thermosetting resins are suitably used as a cross-linking resin contained in the moiré prevention layer. Especially, a mixture of an alkyd resin and a melamine resin is most suitably used. The mixing ratio by weight of an alkyd resin to a melamine resin is an important factor determining the structure and characteristics of a moiré prevention layer. Preferred mixing ratio thereof is 5/5 to 8/2. When a melamine resin is too rich, volume contraction during thermosetting tends to be large. This may cause deficiency of coated film and increase the residual voltage of an image bearing member, which are not preferred. When an alkyd resin is too rich, the reduction of the residual voltage of an image bearing member is effectively prevented but the bulk resistance tends to become too low, which may worsen the background fouling. Naturally, this is not preferred.

It is not clear how the effect described in the present invention is obtained by providing a moiré prevention layer and/or a charge blocking layer. But in the case (1) of an image bearing member in which a moiré prevention layer and a photosensitive layer are accumulated on an electroconductive substrate in this order without providing a charge blocking layer and the case (2) of an image bearing member in which a charge blocking layer and a photosensitive layer are accumulated on an electroconductive substrate in this order without providing a moiré prevention layer, the reduction of charging during a first rotation of an image bearing member caused by the fatigue accumulating over repetitive use is extremely small. However, in the case (3) of an image bearing member in which a charge blocking layer, a moiré prevention layer and a photosensitive layer are accumulated on an electroconductive substrate in this order and the charge blocking layer and a moiré prevention layer, the moiré prevention effect is obtained but the reduction of charging during a first rotation of an image bearing member caused by the fatigue accumulating over repetitive use is extremely large. It is therefore inferred that the reduction of charging during a first rotation of an image bearing member mainly derives from charge trap at the interface between a charge blocking layer and a moiré prevention layer. In the present invention, the aliphatic dicarboxylic acid and/or the aliphatic tricarboxylic acid contained in a charge blocking layer promotes cross-linking reaction and therefore, the number of alkoxymethyl groups therein is reduced. In addition to this, the amount of impurities contained in titanium oxide having a purity not less than 99.0% is small. Thereby, the trap site at the interface is deduced to decrease. Also, this is true when titanium oxide having a high purity having a specific surface area of from 20 to 35 $m^2/g$ is contained in the moiré prevention layer because the contact area between the titanium oxide having a high purity and the charge blocking layer increases. As a result, the reduction of charging during a first rotation of an image bearing member caused by the fatigue accumulating over repetitive use can be prevented.

The specific surface area of the titanium oxide for use in the present invention is measured by BET specific surface area based on a nitrogen absorption method. As mentioned above, by containing titanium oxide having a high purity with a specific surface area of from 5 to 8 $m^2/g$, an image bearing member having excellent electric characteristics and moiré prevention effect can be obtained. Further, by containing titanium oxide having a high purity with a specific surface area of from 20 to 35 $m^2/g$, the reduction of charging during a first rotation of an image bearing member caused by the fatigue accumulating over repetitive use can be prevented.

Next, the image bearing member of the present invention is now described in detail with reference to drawings.

Figure 3:
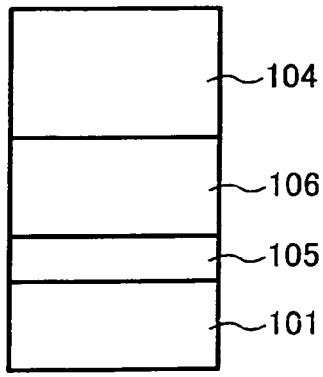
FIG. 3 is a cross section illustrating an example of the structuring of the image bearing member of the present invention.
Figure 4:
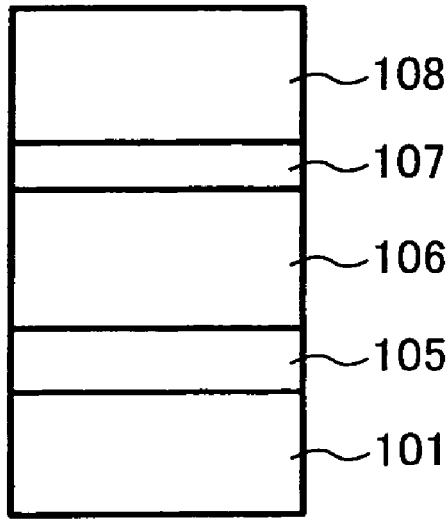
FIG. 4 is a cross section illustrating another example of the structuring of the image bearing member of the present invention.

FIG. 3 is a cross section illustrating an example of the structure of the image bearing member for use in the present invention. The structure is that a charge blocking layer 105, a moiré prevention layer 106 and a photosensitive layer 104 are accumulated on an electroconductive substrate 101 in this order. In this case, the photosensitive layer 104 can be formed of a charge generating layer 107 and a charge transport layer 108 as illustrated in FIG. 4. Further, a protective layer 109 can be provided on the photosensitive layer 104 as illustrated in FIG. 5.

FIG. 4 is a cross section illustrating another example of the structure of the image bearing member for use in the present invention. The charge blocking layer 105, the moiré prevention layer 106, a charge generating layer 107 and a charge transport layer 108 are accumulated on the electroconductive substrate 101 in this order.

Figure 5:
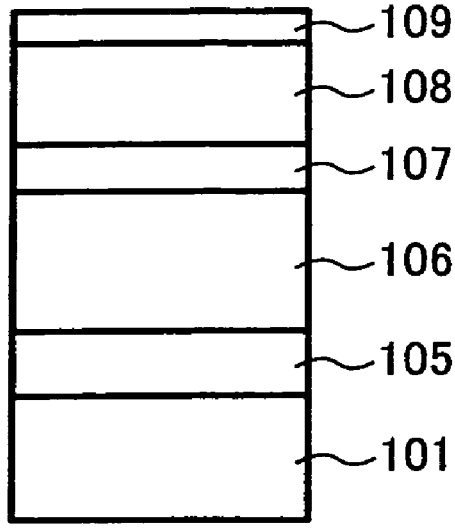
FIG. 5 is a cross section illustrating another example of the structuring of the image bearing member of the present invention.

FIG. 5 is a cross section illustrating another example of the structure of the image bearing member for use in the present invention. The charge blocking layer 105, the moiré prevention layer 106, the charge generating layer 107, the charge transport layer 108 and a protective layer 109 are accumulated on the electroconductive substrate 101 in this order.

Among the structures illustrated in FIGS. 3 to 5, the image bearing members having the structure illustrated in FIGS. 4 and 5 are most suitably used.

Materials having a volume resistance of not greater than $10^{10}$ Ωcm can be used as a material for the electroconductive substrate 101. For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Further, a tube which is manufactured from the board mentioned above by a crafting technique such as extruding and extracting and surface-treatment such as cutting, super finishing and glinding is also usable. In addition, endless nickel belt and endless stainless belt can be used as the electroconductive substrate 101.

The electroconductive substrate 101 of the present invention can be formed by applying to the substrate mentioned above a liquid of application in which electroconductive powder is dispersed in a suitable binder resin.

Specific examples of such electrconductive powder include carbon black, acetylene black, metal powder such as aluminum, nickel, iron, nichrome, copper, zinc and silver, and metal oxide powder such as electroconductive tin oxide, and ITO.

Specific examples of the binder resins which are used together with the electroconductive powder include thermoplastic resins, thermosetting resins, and optical curing resins such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acryl resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent such as tetrahydrofuran (THF), dichloromethane (MDC), methyl ethyl ketone (MEK), and toluene and applying the resultant to a substrate.

Also, an electroconductive substrate formed by providing a heat contraction rubber tube on a suitable cylindrical substrate can be used as the electroconductive substrate of the present invention. The heat contraction tube is formed of a material such as polyvinyl chloride, polypropylene, polyester, polystyrene, polyvinylidene chloride, polyethylene, chloride rubber, and TEFLON® in which the electroconductive powder mentioned above is contained.

Next, the charge blocking layer 105 is described.

The charge blocking layer 105 is a layer containing N-alkoxymethylized nylon and aliphatic dicarboxylic acid as mentioned above. The charge blocking layer 105 has a function of preventing charges having a reverse polarity which are induced at an electrode (i.e., electroconductive substrate 101) during charging an image bearing member from infusing from the substrate 101 to the photosensitive layer 104. When negatively charged, infusion of positive holes is prevented. When positively charged, infusion of electron is prevented. In addition, electroconductive polymers having a rectifying function or a resin or compound having a donor or accepting property corresponding to the polarity can be added to the charge blocking layer 105 in order that the charge blocking layer 105 can have a function of restraining the infusion of charges from the electroconductive substrate 101.

Further, the layer thickness of the charge blocking layer 105 is from 0.1 to less than 3.0 μm and preferably from about 0.5 to about 2.0 μm. When the charge blocking layer 105 is too thick, the residual voltage extremely rises at a low temperature and in a low humidity due to repetition of charging and irradiation. When the charge blocking layer 105 is too thin, the effect of blocking tends to be small. The charge blocking layer 105 is formed on the electroconductive substrate 101 by a known method such as a blade coating method, a dip coating method, a spray coating method, a beat coating method and a nozzle coating method. It is possible to add an agent, a solvent, an additive, and a promoter to help curing (cross-linking). After coating, the layer is dried or cured by a curing treatment such as drying, heating, or application of light.

Next, the moiré prevention layer 106 is described.

As described above, the moiré prevention layer 106 is a layer formed of titanium oxide having a purity not less than 99.0% and a cross-linking resin. Further, the content of the titanium oxide contained in the moiré prevention layer 106 is preferably from 50 to 75% by volume. Furthermore, it is preferred that the titanium oxide contained in the moiré prevention layer includes titanium oxide (T1) having a specific surface area of from 5 to 8 $m^2/g$ and titanium oxide (T2) having a specific surface area of from 20 to 35 $m^2/g$. In addition, the mixing ratio {T2/(T1+T2)} by weight of the two kinds of titanium oxides having different specific surface areas is preferably from 0.2 to 0.6. Thereby, an image bearing member having more excellent characteristics can be obtained.

The layer thickness of the moiré prevention layer 106 is from 1 to 10 μm and preferably from 2 to 5 μm. When the layer thickness is too thin, the effects of reducing background fouling and residual voltage are not sufficient. When the layer thickness is too thick, the residual voltage tends to accumulate, which is not preferred.

As a method of forming the moiré prevention layer 106, a wet type application method is adopted. A solvent which does not erode the charge blocking layer 105 disposed under the moiré prevention layer 106 is used in the method.

Next, the photosensitive layer 104 is described.

The photosensitive layer 104 can adopt either a single layer structure as illustrated in FIG. 3 and a layered structure formed of the charge generating layer 107 and the charge transport layer 108 as illustrated in FIG. 4. The layered structure is described first.

Known materials can be used as a charge generating material for the charge generating layer 107. Specific examples thereof include metal phthalocyanine such as titanyl phthalocyanine and chloro gallium phthalocyanine, non-metal phthalocyanine, azulenium salt pigment, sauaric acid methane pigment, symmetry or asymmetry azo pigments having a carbazole skeleton, symmetry or asymmetry azo pigments having a triphenyl amine skeleton, symmetry or asymmetry azo pigments having a diphenyl amine skeleton, symmetry or asymmetry azo pigments having a dibenzothiophene skeleton, symmetry or asymmetry azo pigments having a fluorenone skeleton, symmetry or asymmetry azo pigments having an oxadiazole skeleton, symmetry or asymmetry azo pigments having a bisstilbene skeleton, symmetry or asymmetry azo pigments having a distyryloxadiazole skeleton, symmetry or asymmetry azo pigments having a distyrylcarbazole skeleton, perylene based pigments, anthraquinone based or polycyclic quinine based pigments, quinine imine based pigments, diphenyl methane and triphenyl methane based pigments, benzoquinone and naphthoquinone based pigments, cyanine and azomethine based pigments, indigoid based pigments, and bisbenzimidazole based pigments. As the phthalocyanine pigments for use in the present invention, non-metal phthalocyanine or metal phthalocyanine are suitable. These are obtained by the synthetic methods described in "Phthalocyanine Compounds" (authored by Moser and Thomas, published in 1963 by LineHold Co., Ltd.) and other suitable methods.

Specific examples of such metal phthalocyanines include compounds having a metal such as copper, silver, beryllium, magnesium, calcium, zinc, indium, sodium, lithium, titanium, tin, lead, vanadium, chrome, manganese, iron, and cobalt as the center metal. A haologenized metal having 3 or more atomic valence can be centered in the phthalocyanine instead of the metal atom mentioned above. Phthalocyanine having any known crystal form such as α type, β type, γ type, ϵ type, τ type, and χ type and amorphous phthalocyanine can be used. Among these, as described later, titanyl phhtalocyanine (hereinafter referred to as TiOPC) having titanium as the center metal is more preferred because of its especially excellent sensitivity.

[Chemical formula 1]

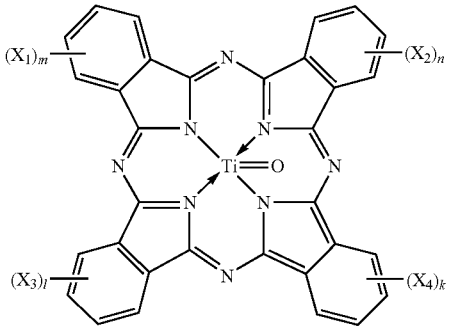

(in the chemical structure, X1, X2, X3 and X4 independently represent various kinds of halogen atoms, and n, m, K and P independently represent an integer of from 0 to 4).

Further, among titanyl phthalocyanines, a titanyl phthalocyanine is preferred which has a CuKα X ray diffraction spectrum having a wavelength of 1.542 Å such that a maximum diffraction peak is observed at a Bragg (2θ) angle of 27.2±0.2°, main peaks at a Bragg (2θ) angle of 9.4±0.2°, 9.6±0.2°, and 24.0±0.2°, and a peak at a Bragg (2θ) angle of 7.3±0.2° as a lowest angle diffraction peak, and having no peak between 9.4±0.2° and 7.3±0.2° and no peak at 26.3±0.2°.

The titanyl phthalocyanines having the crystal types illustrated above is described in JOP 2001-19871. The charge generating material for use in the present invention and an image bearing member and an image forming apparatus using the charge generating material are described therein. A stable image bearing member maintaining a chargeability over repetitive use without losing a high sensitivity can be obtained by using this titanyl phthalocyanine crystal. However, when such an image bearing member is repetitively used for an extremely extended period of time, the background fouling increases, resulting in shortening of the life of the image bearing member. This is not satisfactory. This is thought to be because the background fouling stemming from the charge generating layer is improved but the background fouling ascribable to charges infused from the electroconductive substrate is not dealt with.

Further, as a result of the intensive study on technologies of improving the titanyl phthalocyanine having the crystal form mentioned above by the inventors of the present invention, it is found that, when the average particle size of primary particles thereof is not greater than 0.25 μm, the photosensitivity and the anti-background characteristics of an image bearing member using the titanyl phthalocyanine are greatly improved. Therefore, as the charge generating material for use in the image bearing member of the present invention, the titanyl phthalocyanine having the crystal form mentioned above and a controlled primary particle size is particularly suitable. The method of controlling the primary particle size is described later.

As described above, structuring multiple underlying layers or intermediate layers between an electric substrate and a photosensitive layer is a technology set forth in JOP H05-80572, etc. However, in combinational with the photosensitive layer 104 having a high sensitivity, the thermal generation of carriers in the photosensitive layer 104 has a large effect so that the background fouling is not completely prevented. This tendency is a significant problem when a charge generating material having absorption in a long wavelength, for example, the titanyl phthalocyanine crystal for use in the present invention, is used.

As described above, respective methods of preventing the occurrence of background fouling in a charge generating layer or an undercoating layer are disclosed. However, there are multiple factors causing background fouling, and to endure repetitive use over an extended period of time, these factors should be removed simultaneously. These problem causing factors may be extremely trivial and ignorable in the initial stage. But as an image bearing member becomes fatigued during repetitive use and the deterioration of the materials forming the image bearing member becomes heavy, these factors greatly grow. Therefore, it is preferred to eliminate the causes of background fouling as much as possible and to improve the durability of an image bearing member against fatigue caused during repetitive use. However, a method of solving these factors at the same time and drastically improving the durability has not been described.

According to the present invention, the background fouling caused by multiple factors can be restrained and the chargeability can be stably maintained for an extended period of time. Further, side effects to residual voltage and environmental dependency can be minimized so that the stability is maintained for repetitive use.

Next, a method of synthesizing titanyl phthalocyanine having a specific crystal form for use in the present invention is described.

To begin with, a method of synthesizing a synthesized coarse product of titanyl phthalocyanine crystal is described later. The method of synthesizing phthalocyanines has been known for a long time, as described in "Phthalocyanine Compounds" (published in 1963, authored by Moser, etc.), "The phthalocyanines" (published in 1983) and JOP H06-293769.

There is a first method in which a mixture of phthalic anhydride, a metal or halogenated metal and urea is heated under the optional presence of a solvent having a high boiling point. A catalyst such as ammonium molybdenum acid is used in combination if desired. There is a second method in which the mixture of a phtahlonitrile and a halogenated metal is heated under the optional presence of a solvent having a high boiling point. This method is used to prepare phthalocyanines which cannot be prepared by the first method. Specific examples thereof include aluminum phthalocyanines, indium phthalocyanines, oxovanadium phthalocyanine, oxotitanium phthalocyanines and zirconium phthalocyanines. There is a third method in which phthalic anhydride or a phthalonitrile and ammonium are reacted first to produce an intermediary body such as 1,3-diiminoisoindoline which is then reacted with a halogenated metal in a solvent having a high boiling point. A fourth method is that a phthalonitrile and a metal alcoxide are reacted under the presence of urea. Among these, the fourth method is extremely useful as a method of synthesizing an electrophotographic material because chlorization (halogenation) of a benzene ring does not occur. Therefore, this method is also extremely suitable for the present invention.

As described in JOP H06-293769, a method of synthesizing a titanyl phthalocyanine crystal in which a halogenated titanium is not used as a material for synthesis is suitably used as the synthesisy method of the titanyl phthalocyanine crystal for use in the present invention. The merit thereof is that the synthesized titanyl phthalocyanine crystal is free from halogenation. When titanyl phthalocyanine crystal contains a halogenated titanyl phthalocyanine crystal as an impurity, such a titanyl phthalocyanine may have an adverse effect on electrostatic characteristics such as photosensitivity and chargeability of an image bearing member (for example, refer to "Japan Hardcopy, 1989 collections of articles, P103, published in 1989). In the present invention, halogenation free titanyl phthalocyanine crystal as described in JOP 2001-19871 is the main target and these materials are suitably used. To synthesize a halogenated free titanyl phthalocyanine, the key is not to use a halogenated material as a raw material for synthesizing titanyl phthalocyanine. Specifically, the method described later is used.

Next, a method of synthesizing amorphous titanyl phthalocyanine (titanyl phthalocyanine having low crystalline property) is described. In this method, a phthalocyanine is dissolved in sulfuric acid and then diluted with water for re-precipitation. Specific examples of the methods include methods referred to as an acid paste method or an acid slurry method.

Specifically, the coarsely synthesized compound obtained in the manner mentioned above is dissolved in strong sulfuric acid. The amount ratio of the sulfuric acid to the compound is 10 to 50. Undissolved material is removed by, for example, filtration, if desired. The solution is slowly put into sufficiently cooled water or iced water having an amount of 10 to 50 times as much as that of the sulfuric acid to re-precipitate titanyl phthalocyanine. Subsequent to filtration of the precipitated phthalocyanine, the titanyl phthalocyanine is washed with deionized water and filtered. Washing and filtration are fully repeated until the filtered liquid shows neutrality. Lastly, subsequent to washing the obtained titanyl phthalocyanine with clean deionized water, filtration is performed to obtain a water paste having a solid portion density of from about 5 to about 15% by weight.

It is important to sufficiently wash titanyl phthalocyanine with deionized water to remove the strong sulfuric acid as much as possible. To be specific, it is preferred that the deionized water after washing shows the following physicality. That is, to quantitatively representing the remaining amount of the sulfuric acid, pH or the specific electric conductivity of the deionized water can be used. When the physicality is represented by pH, it is preferred to have a pH of from 6 to 8. In this range, it can be determined that the remaining amount of the sulfuric acid does not have an affect on the characteristics of an image bearing member formed of the titanyl phhtalocyanine. The value of pH can be easily measured by a marketed pH meter. When the physicality is represented by specific electric conductivity, the specific electric conductivity is preferably not greater than 8 μS/cm, more preferably not greater than 5 μS/cm, and furthermore preferably 3 μS/cm. In this range, it can be determined that the remaining amount of the sulfuric acid does not have an effect on the characteristics of an image bearing member formed of the titanyl phhtalocyanine. The value of the specific electric conductivity can be easily measured by a marketed specific electric conductivity meter. The lowest limit of the specific electric conductivity is the specific electric conductivity of the deionized water for use in washing. In either measurement, when the result is in a range outside the range mentioned above, the amount of the remaining sulfuric acid is too large, resulting in decrease of the chargeability of an image bearing member and deterioration of the photosensitivity thereof, which is not preferred.

The thus obtained compound is the titanyl phthalocyanine having an amorphous form (titanyl phthalocyanine having low crystalline property) for use in the present invention. The titanyl phthalocyanine having an amorphous form (titanyl phthalocyanine having low crystalline property) preferably has a CuKα X ray diffraction spectrum having a wavelength of 1.542 Å such that the maximum diffraction peak (±0.2°) is observed at a Bragg (2θ) angle of from 7.0 to 7.5°. Especially, the half value width of the diffraction peak is preferably not less than 1°. Further, the titanyl phthalocyanine preferably has a primary particle size of not greater than 0.1 μm.

Next, the method of crystal conversion is described.

The crystal conversion is a process in which an amorphous titanyl phthalocyanine (titanyl phthalocyanine having low crystalline property) is converted into a titanyl phthalocyanine crystal having a crystal form having a CuKα X ray diffraction spectrum having a wavelength of 1.542 Å such that the maximum diffraction peak is observed at a Bragg (2θ) angle of 27.2±0.2°, the main peaks at a Bragg (2θ) angle of 9.4±0.2°, 9.6±0.2°, and 24.0±0.2°, and a peak at a Bragg (2θ) angle of 7.3±0.2° as the lowest angle diffraction peak and having no peak between 9.4°±0.2° and 7.30±0.2° and no peak at 26.3±0.2°.

A specific method thereof is that amorphous titanyl phthalocyanine (titanyl phthalocyanine having low crystalline property) is mixed and stirred with an organic solvent under the presence of water without drying to obtain the crystal form mentioned above.

Any organic solvent can be used as long as a desired crystal form is obtained. Among these, one of tetrahydrofuran, toluene, methylene chloride, carbon disulfide, orthodichlorobenzene, and 1,1,2-trichloroethane is preferably selected to obtain a good result. These organic solvents can be preferably used singly but can be used in combination or mixed with another solvent. The content by weight of the organic solvent for use in crystal conversion is at least 10 times that of the amorphous titanyl phthalocyanine (titanyl phthalocyanine having low crystalline property) and preferably at least 30 times. This is desired to rapidly and sufficiently perform crystal conversion and sufficiently remove impurities contained in the amorphous titanyl phthalocyanine (titanyl phthalocyanine having low crystalline property). The amorphous titanyl phthalocyanine (titanyl phthalocyanine having low crystalline property) used here is prepared by an acid paste method. But, as described above, it is preferred to use the titanyl phthalocyanine which has been sufficiently washed to remove sulfuric acid. When crystal conversion is performed under the condition in which sulfuric acid undesirably remains, sulfuric acid ion remains in the crystalline particles and cannot be completely removed from the obtained crystal by a treatment such as water-washing. Sulfuric acid remaining in the obtained crystal particle causes reduction of the sensitivity and the chargeability of an image bearing member, which is not preferred. For example, JOP H08-110649 describes a method of crystal conversion in its comparative example in which titanyl phthalocyanine dissolved in sulfuric acid is put in an organic solvent together with deionized water. The titanyl phthalocyanine obtained by this method is close to the titanyl phthalocyanine obtained in the present invention in terms of X ray diffraction spectrum. However, the density of the sulfuric acid ion in the titanyl phthalocyanine obtained by the method is high, resulting in an image bearing member having a poor dark decay property (photosensitivity). Therefore, the titanyl phthalocyanine obtained by this method is not suitable as the titanyl phthalocyanine for use in the present invention due to the reason described above.

The crystal conversion method described above is according to JOP 2001-19871. With regard to the charge generating material contained in the electrophotographic image bearing member of the present invention, the effect becomes clearer by reducing the particle size of the titanyl phthtalocyanine crystal. Therefore, the background fouling prevention effect increases. Below is the description of the method of manufacturing titanyl phthalocyanine having a small particle size.

There are two typical major methods of controlling the particle size of titanyl phthalocaynine crystal contained in a photosensitive layer. One is a method in which crystal particulates having a particle diameter not greater than 0.25 μm are synthesized when titanyl phthalocyanine crystal particles are synthesized. The other is that coarse particles having a particle diameter greater than 0.25 μm are removed after titanyl phthalocyanine crystal is dispersed. It is more effective to use both methods in combination.

The method of synthesizing titanyl phthalocyanine crystal particulates is described first.

According to the observation by the inventors of the present invention, it is found that the amorphous titanyl phthalocyanine mentioned above (titanyl phthalocyanine having low crystalline property) has a primary particle diameter not greater than 0.1 μm (most of which is from about 0.01 to about 0.05 μm (refer to FIG. 6, in which the scale bar is 0.2 μm) but the crystal grows while the crystal is converted. In this type of crystal conversion, typically, the time to be taken to perform crystal conversion is sufficiently secured to prevent a raw material from remaining. After the crystal conversion is fully performed, the resultant is filtered to obtain a titanyl phthalocyanine crystal having a desired crystal type. Therefore, although a raw material having a sufficiently small particle diameter is used, the crystal obtained after crystal conversion has a large particle diameter (about from 0.3 to 0.5 μm) (refer to FIG. 7, in which the scale bar is 0.2 μm).

When the titanyl phthalocyanine crystal prepared as described above is dispersed, a strong shearing force is imparted to obtain a crystal having a small particle diameter (not greater than about 0.2 μm) after dispersion. Further, a strong energy is imparted to pulverize a primary particle for dispersion if desired. As a result, as described above, there is a possibility that some crystals are transferred to crystals having undesired crystal types.

Figure 6:
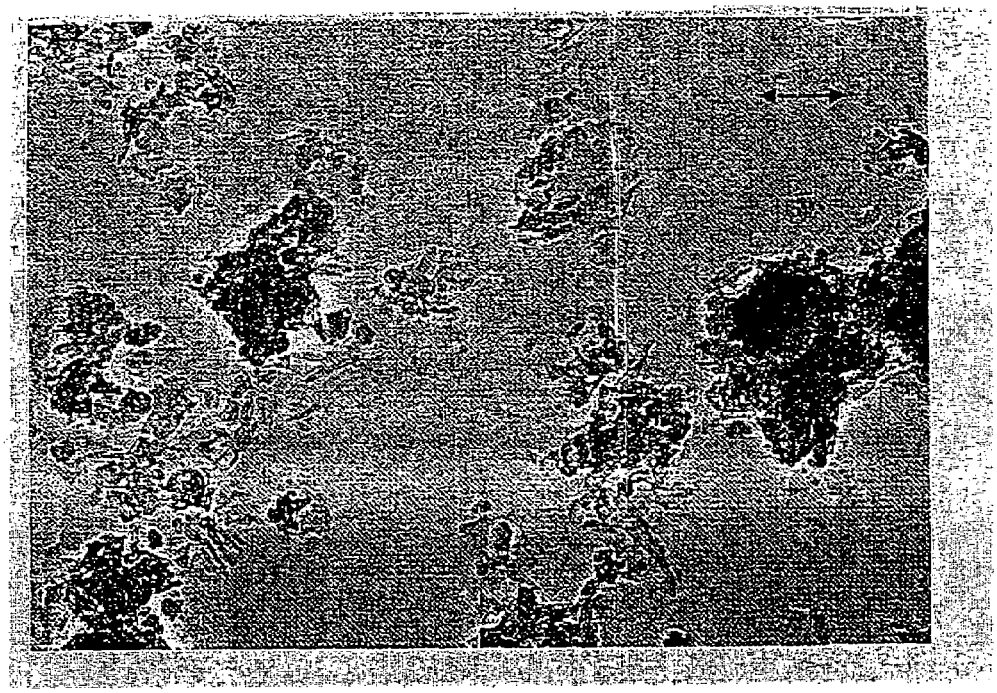
FIG. 6 is a photograph illustrating titanyl phthalocyanine amorphous having a primary particle diameter not greater than 0.1 μm.
Figure 7:
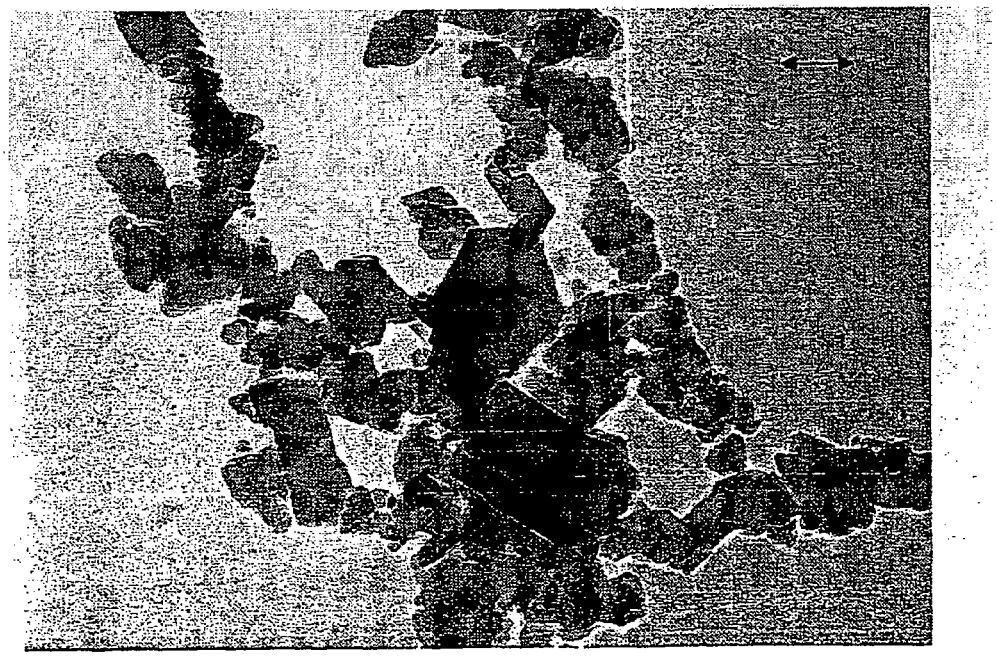
FIG. 7 is a photograph illustrating a titanyl phthalocyanine crystal having a large primary particle diameter after crystal conversion.

On the other hand, in the present invention, titanyl pththalocyanine crystal having a small primary particle size is obtained by nailing down when the crystal conversion is complete, i.e., when the particle size is still in the range where crystal growth has hardly occurred. The range is that the size of titanyl phthalocyanine having an irregular form observed in FIG. 6 is kept after crystal conversion, i.e., about 0.2 μm. The size of the particle after crystal conversion increases in proportion to the time taken for crystal conversion. Therefore, as described above, it is desired to improve the efficiency of crystal conversion and complete the crystal conversion in a short time. To achieve this, there are points to be mentioned.

One is to select a suitable organic solvent as described above to improve the efficiency of crystal conversion. The other is to violently stir the solvent and titanyl phthalocyanine water paste manufactured from titanyl phthapcyanine having an amorphous form as described above to sufficiently contact each other and to complete crystal conversion in a short time. Specifically, a device having a propeller having a violent stirring (dispersion) force, or a stirring (dispersion) device such as a homogenizer (HOMOMIXER), etc. is used to complete crystal conversion in a short time. Under these conditions, crystal can be sufficiently converted to titanyl phthapcyanine crystal in a state in which crystal growth does not occur. The optimization of the amount of an organic solvent for use in crystal conversion is effective again. The desired amount of an organic solvent is at least 10 times and preferably at least 30 times based on the solid portion of titanyl phthapcyanine having an amorphous form. Thereby, crystal conversion can be securely completed in a short time and the contaminants contained in the titanyl phthapcyanine having an amorphous form can be also securely removed.

In addition, since the crystal particle size is in proportion to the crystal conversion time as described above, it is effective to stop the reaction immediately after the target reaction (crystal conversion) is complete. To stop the reaction, for example, a solvent in which crystal conversion can hardly occur is added in a large amount immediately after the crystal conversion. Specific examples of such solvents include an alcohol based solvent and an ester based solvent. It is possible to stop crystal conversion by adding such a solvent in an amount about 10 times as much as the solvent for use in crystal conversion.

The smaller the size of the thus obtained primary particle is, the better the result is with regard to the issues involved in an image bearing member. However, considering the next process, i.e., the process of preparing a pigment (filtration process), and dispersion stability of a liquid dispersion, too small a primary particle size causes a side effect. Namely, it takes an extremely long time to filter too small a primary particle size in the filtration process. In addition, when a primary particle size is too small, a pigment particle in a liquid dispersion has a large superficial area. Such pigment particles easily re-agglomerate. Therefore, the suitable particle size of a pigment particle is from about 0.05 to about 0.2 μm.

Figure 8:
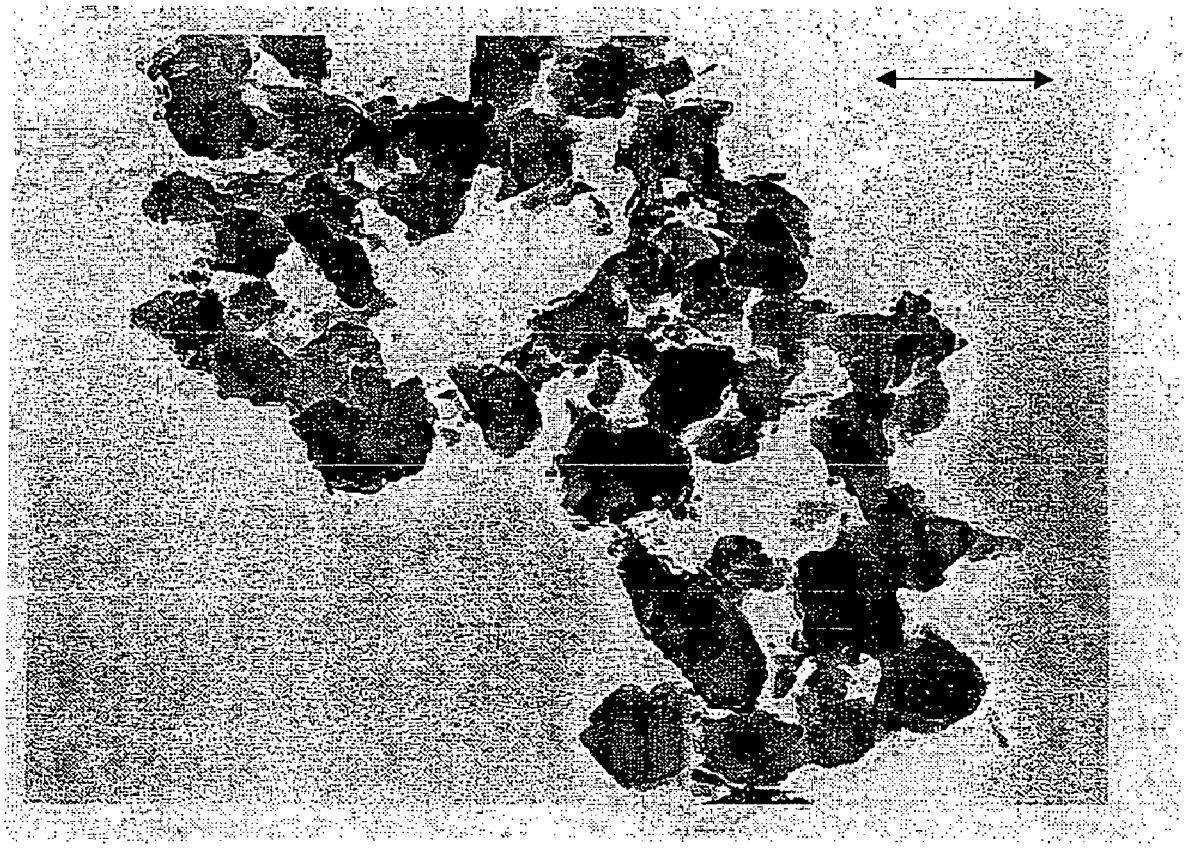
FIG. 8 is a photograph illustrating a transmission electron microscope (TEM) image obtained when the crystal conversion is completed in a short time.

FIG. 8 is a transmission electron microscope (TEM) image illustrating a titanyl phthtlaocyanine crystal when crystal conversion is performed in a short time. The scale in FIG. 8 is 0.2 μm. Different from the image illustrated in FIG. 7, there is no coarse particle observed in FIG. 8 and the particle sizes therein are small and almost uniform.

When the titanyl phthalocyanine crystals having a small primary particle size as illustrated in FIG. 8 are dispersed, it is desired that a shearing force is imparted to break a secondary particle formed by agglomeration of the primary particles to obtain a particle having a small size, i.e., not greater than 0.25 μm and preferably not greater than 0.2 μm. As a result, since energy is not excessively provided, different from the result described above, the particle obtained hardly has an undesired crystal type. Therefore, it is possible to easily prepare a liquid dispersion having a sharp particle distribution.

The particle size mentioned above is the volume average particle size which is obtained using an ultracentrifugal automatic particle size measuring device (CAPA-700, manufactured by Horiba Ltd.) The volume average particle size calculated is the median radius (corresponding to 50% of cumulative distribution). However, since this method has a possibility that a minute quantity of coarse particles is not detected, it is desired to directly observe crystal powder or liquid dispersion of titanyl phthalocyanine with an electron microscope to obtain the size thereof.

As a result of a study on the minute defect based on further observation of the liquid dispersion, the phenomenon is recognized as follows. In a typical method of measuring an average particle size, when particles having an extremely large size are present in an amount of not less than a couple of percent, these particles can be detected. But the measuring device cannot detect large particles present in a small amount, for example, about less than 1% based on the total amount. Consequently, such large particles cannot be detected by simply measuring the average particle size, which makes understanding the minute defect mentioned above difficult.

Figure 9:
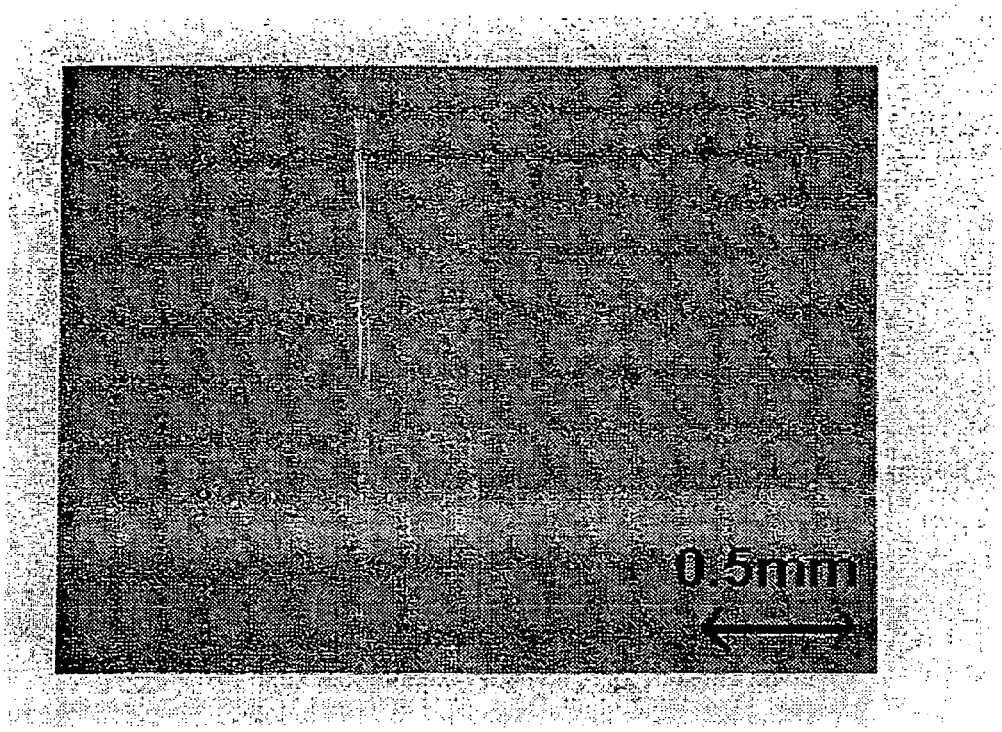
FIG. 9 is a photograph illustrating a liquid dispersion obtained in a short dispersion time under a fixed condition.
Figure 10:
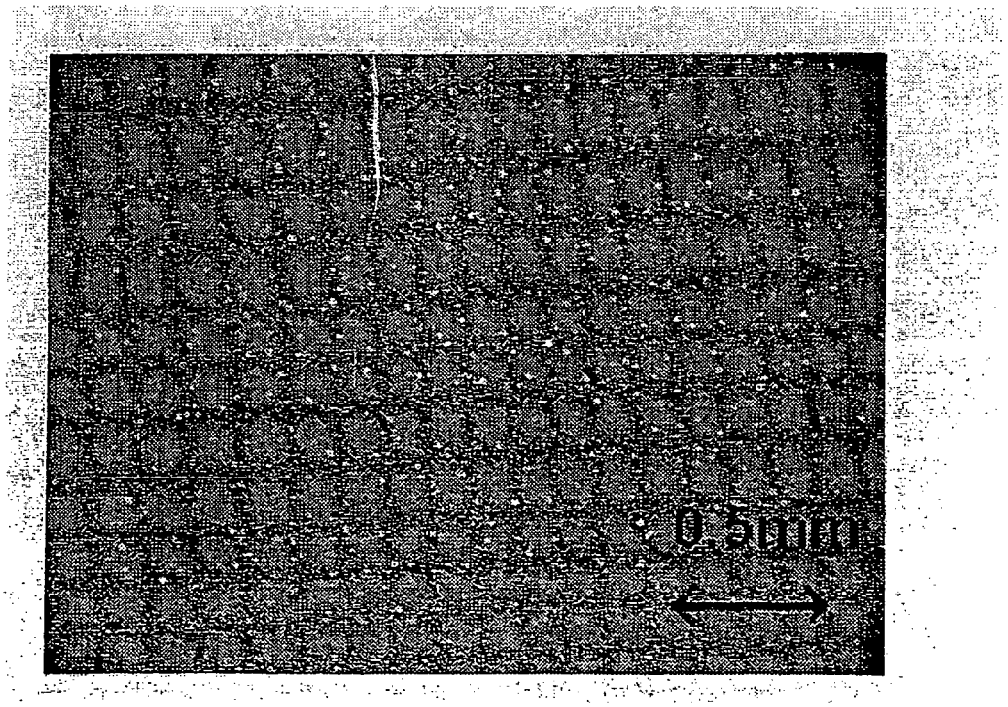
FIG. 10 is a photograph illustrating a liquid dispersion obtained in a long dispersion time under a fixed condition.

FIGS. 9 and 10 are photographs illustrating the states of two kinds of liquid dispersion formed under the same dispersion conditions except for the dispersion time. FIG. 9 is a photograph of liquid dispersion formed in a short dispersion time. Black particles, which are remaining coarse particles, are observed in the photograph of FIG. 9 as compared with the photograph of liquid dispersion of FIG. 10 which is formed in a relatively long dispersion time.

Figure 11:
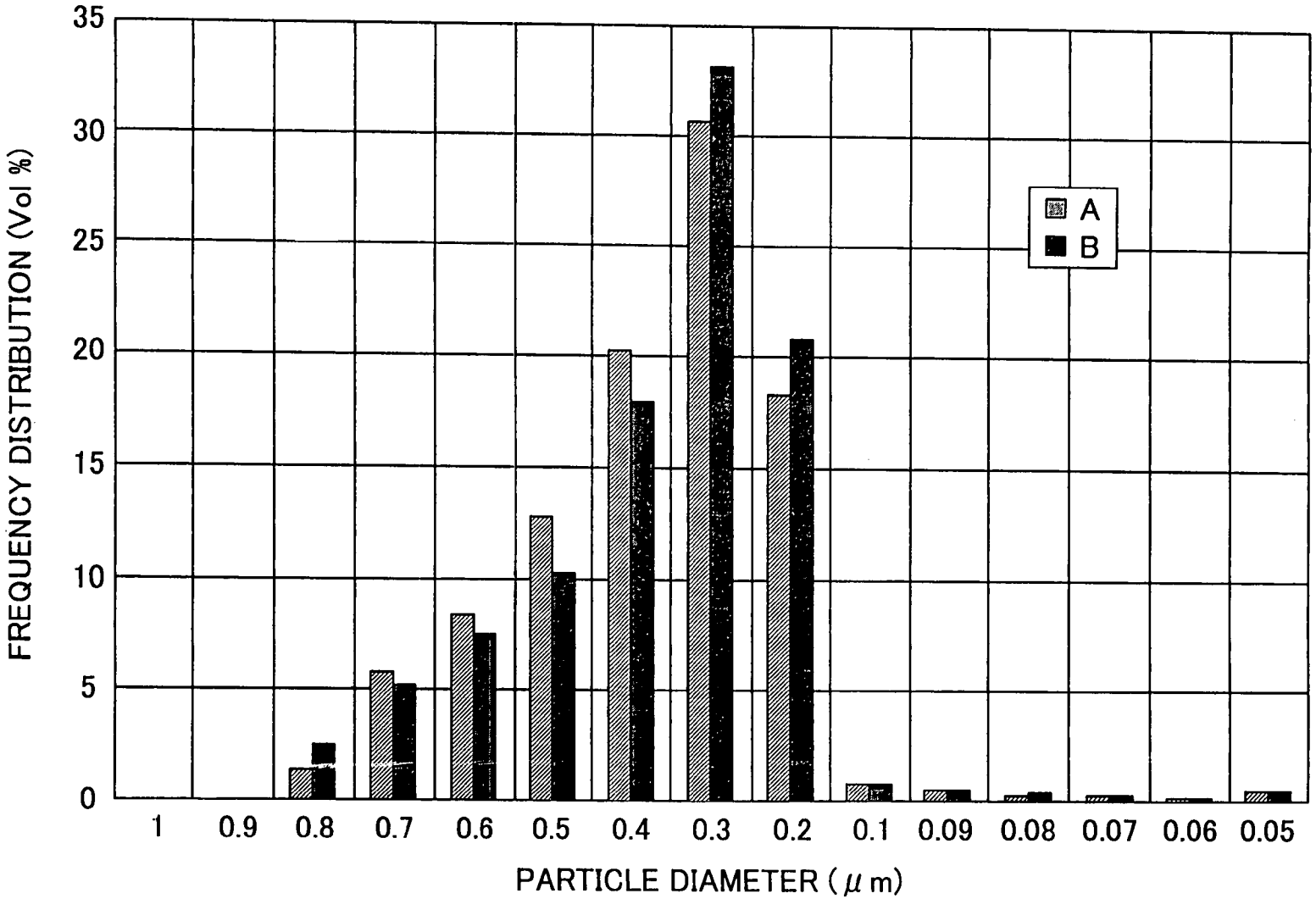
FIG. 11 is a graph illustrating the average particle diameter and the particle size distribution of the liquid dispersion illustrated in FIGS. 9 and 10 measured with a marketed particle size distribution measuring device according to a known method.

The average particle diameter and the particle size distribution of these two kinds of distribution liquid are measured by a known method using a marketed ultracentrifugal automatic particle size measuring device (CAPA-700, manufactured by Horiba Ltd.). The results are shown in FIG. 11. A in FIG. 11 corresponds to these particle diameter and the particle size of the liquid dispersion of FIG. 9 and B in FIG. 11 corresponding to these particle diameter and the particle size of the liquid dispersion of FIG. 10. When both are compared, there is actually no difference with regard to the particle size distribution. The average particle diameters of A and B are 0.29 μm and 0.28 μm, respectively. Considering the measuring error, it is difficult to determine that there is a difference between A and B.

Therefore, it is difficult to detect a minute quantity of large particles remaining in liquid dispersion simply by a known method for measuring an average particle size. Therefore, it is understood that such a method is not sufficient to obtain particles suitable for the current negative-positive development having a high definition. Such large particles existing in a minute quantity are recognized only when the liquid of application is observed with a microscope.

To deal with the fact, violent stirring by which a solvent and the titanyl phthalocyanine water paste prepared as described above fully contact each other is effective to complete crystal conversion in a short time while improving the efficiency of crystal conversion by a crystal conversion solvent suitably selected as described above to make the primary particle prepared during the crystal conversion as small as possible.

By adopting such a crystal conversion method, titanyl phthalocyanine crystal having a small primary particle diameter, i.e., not greater than 0.25 μm and preferably not greater than 0.2 μm, can be obtained. In addition to the technology described in JOP 2001-19871, it is effective to use the technologies mentioned above (the crystal conversion method of obtaining minute titanyl phthalocyanine crystal) in combination therewith to improve the effect of the present invention.

Sequentially, titanyl phthalocyanine crystal obtained after crystal conversion is separated from the crystal conversion solvent by filtration performed immediately after the crystal conversion. A suitably sized filter is used for the filtration. It is desired to perform the filtration with a reduced pressure.

Thereafter, the separated titanyl phthalocyanine crystal is heated and dried if desired. Any known drying device for heating and drying can be used. An air blasting type dryer is preferably used when performed in atmosphere. Further, it is extremely effective to dry the crystal under a reduced pressure to fully obtain the effect of the present invention. Especially, this is extremely effective to a material decomposed or changing its crystal form at a high temperature. Further, it is especially effective to perform drying at a high vacuum degree greater than 10 mmHg.

The thus obtained titanyl phthalocyanine crystal having a specific crystal form is extremely suitable as a charge generating material forming an electrophotographic image bearing member. However, this specific crystal form has a drawback in that the crystal form is not stable as described above, i.e., the specific crystal form is easily transferred during forming liquid dispersion. However, when a primary particle has a small size as in the present invention, it is possible to prepare liquid dispersion in which the average particle size of the particles dispersed is small without imparting an excessive shearing force during preparing the liquid dispersion. In addition, the crystal form can be stably manufactured without changing the synthesized crystal form.

Next, a method of removing coarse particles after dispersing titanyl phthalocyanine crystal is described.

Liquid dispersion can be prepared by a known method. The titanyl phthalocyanine crystal mentioned above and an optional binder resin are dispersed in a suitable solvent with a ball mill, an attritor, a sand mill, a bead mill or supersonic. Such a binder resin can be selected based on the electrostatic characteristics of an image bearing member and such a solvent can be selected based on wettability to a pigment and dispersability thereof.

As described above, it is well known that the titanyl phthalocyanine crystal having a crystal form having a CuKα X ray diffraction spectrum having a wavelength of 1.542 Å such that at least the maximum diffraction peak is observed at a Bragg (2θ) angle of 27.2±0.2° is easily transferred to another crystal form under a stress such as thermal energy and mechanical shearing. This is true to the titanyl phthalocyanine crystal for use in the present invention. That is, it is desired to devise a dispersion method to prepare liquid dispersion containing minute particles. But the stability of a crystal form and the size reduction of the particles tend to have a trade-off relationship. It is possible to avoid the trade-off relationship by optimizing the dispersion condition. But such optimization extremely limits the preparation conditions. Therefore, an easy method is desired. To solve this problem, the following method is effective.

The method is that, after preparing a liquid dispersion in which particles have a possible small size within the range in which crystal conversion does not occur, the liquid dispersion is filtered with a suitable filter. In this method, it is possible to remove large particles present in a minute amount which cannot be observed or detected by particle size measurement. In addition, the method is also extremely effective in light of obtaining a sharp particle size distribution. Specifically, the liquid dispersion prepared as described above is subject to filtration with a filter having an effective mesh size of not greater than 3 μm and preferably not greater than 1 μm. Liquid dispersion containing only titanyl phthalocyanine crystal having a small particle size, i.e., not greater than 0.25 μm and preferably not greater than 0.2 μm, can be prepared by this method. When an image bearing member formed of this titanyl phthalocyanine is installed in an image forming apparatus, the effects of the present invention is further significant.

Selection of the filters filtering liquid dispersion depends on the size of coarse particles to be removed. According to the study by the inventors of the present invention, it is found that coarse particles having a size of about 3 μm existing in an image bearing member for use in an image forming apparatus performing image formation with a definition of about 600 dpi have an adverse effect on images. Therefore, a filter used preferably has an effective mesh size not greater than 3 μm and more preferably not greater than 1 μm. When such filtration is performed, undesired coarse particles can be removed. Further, liquid dispersion having a sharp particle distribution and not having such coarse particles can be prepared. With regard to the effective mesh size, it is more effective to remove large particles with a smaller effective mesh size. But when the effective mesh size is too small, the desired pigment particles may be filtered as well. Therefore, there is a suitable effective mesh size. In addition, when the effective mesh size is too small, there are problems such that it takes a long time to complete filtration, the filter is clogged, and the burden is too heavy when a pump, etc., is used to send liquid. It is natural to use a material insoluble in a solvent for use in liquid dispersion to be filtered for such filters.

With regard to filtration, when large particles are present in too great an amount in the liquid dispersion, the amount of pigment removed increases. This leads to, for example, fluctuation in the density of the solid portion in the liquid dispersion after filtration, which is not preferred. Therefore, there is a suitable particle size distribution (particle size and standard deviation) for filtration. As in the present invention, to efficiently perform filtration such that pigment is not lost and the filter is not clogged, it is desired that the volume average particle size in the liquid dispersion before filtration is not greater than 0.3 μm and its standard deviation is not greater than 0.2 μm.

Coarse particles can be removed when such filtration operation for liquid dispersion is added. Further, background fouling ascribable to an image bearing member prepared by using a liquid dispersion can be reduced. As described above, when a filter having a small mesh size is used, the effect is secured. However, proper pigment particles may be filtered as well. In this case, the combinational use of the filtration and the technology in which titanyl phthalocyanine primary particles are miniatuarized during synthesis is extremely effective.

Namely, when synthesized minute titanyl phthalocyanines are used, the dispersion time and stress can be reduced, which reduces the possibility of crystal form transfer during dispersion. In addition, the remaining coarse particles prepared with miniaturization are relatively small in size in comparison with those prepared without miniaturization. Therefore, a filter having a small mesh size can be used and thereby the effect of removing large particles is secured. In addition, the amount of titanyl phthalocyanine particles removed is reduced so that the dispersion component does not vary between before and after filtration. Therefore, a pigment can be stably prepared. As a result, an image bearing member manufactured as such has a stable durability against background fouling.

The charge generating layer can be formed by dispersing the pigment mentioned above in a suitable solvent together with an optional binder resin with a ball mill, an attritor, a sand mill or supersonic wave, and applying the resultant to an electroconductive substrate followed by drying.

Specific examples of the optional binder resins for use in a charge generating layer include polyamides, polyurethanes, epoxy resins, polyketones, polycarbonates, silicone resins, acrylic resins, polyvinyl butyrals, polyvinyl formals, polyvinyl ketones, polystyrenes, polysulfones, poly-N-vinyl carbazoles, polyacrylamides, polyvinyl benzals, polyesters, phenoxy resins, copolymers of vinylchloride-vinyl acetates, polyvinyl acetates, polyphenylene oxidos, polyvinyl pyridines, cellulose-based resins, caseine, polyvinyl alcohols, and polyvinyl pyrrolidones. Among these, polyvinyl acetal such as polyvinyl butyral are suitably used. The content of the optional binder resin is from 0 to 500 parts by weight and preferably from 10 to 300 parts by weight based on 100 parts by weight of a charge generating material.

Specific examples of the solvents include isopropanol, acetone, methlethylketone, cyclohexane, tetrahydrofuran, dioxane, ethylcellosolve, ethyl acetate, methyl acetate, dichloromethane, dichloroethane, monochlorobenzene, cyclohexane, toluene, xylene, and ligroin. Especially, keton based solvents, ester based solvents and ether based solvents are suitably used. Usable methods of coating a liquid of application are, for example, a dip coating method, a spray coating method, a beat coating method, a nozzle coating method, a spinner coating method and a ring coating method.

The layer thickness of a charge generating layer is from about 0.01 to about 5 μm and preferably from 0.1 to 2 μm.

Next, the charge transport layer is described.

The charge transport layer can be formed by dispersing or dissolving a charge transport material and a binder resin in a suitable resin, and applying the resultant to a charge generating layer followed by drying. In addition, a plasticizer, a leveling agent and an anti-oxidization agent can be added if desired.

There are two types of the charge transport materials, which are a positive hole transport material and an electron transport material. Specific examples of such electron transport material include electron acceptance materials such as chloranil, bromanil, tetracyano ethylene, tetracyanoquino dimethane, 2,4,5,7-tetranitro-9-fluorenone, 2,4,5,7-tetranitroxanthone, 2,4,8-trinitrothioxanthone, 2,6,8-trinitro4H-indeno[1,2-b]thiophene-4-on, 1,3,7-trinitrodibenzo thhiophene-5,5-dioxide, and benzoquinone derivatives.

Specific examples of such positive hole transport materials include poly-N-vinylcarbazols and their derivatives, poly-γ-carbazolyl ethyl glutamates and their derivatives, pyrene-formaldehyde condensation compounds and their derivatives, polyvinyl pyrenes, polyvinyl phenanthrenes, polysilanes, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives and other known materials. These charge transport materials can be used alone or in combination.

Specific examples of the binder resins include thermal curing resins and thermal plastic resins such as polystyrenes, styrene-acrylonitrile copolymers, styrene-butadiene copolymers, styrene-maleic acid anhydride copolymers, polyesters, polyvinyl chlorides, vinyl chloride-vinyl acetate copolymers, polyvinyl acetates, polyvinyl vinylidenes, polyarates, phenoxy resins, polycarbonates, cellulose acetate resins, ethyl cellulose resins, polyvinyl butyrals, polyvinyl formals, polyvinyl toluene, poly-N-vinylcarbazols, acrylic resins, silicone resins, epoxy resins, melamine resins, urethane resins, phenol resins, and alkyd resins.

The content of such a charge transport material is from 20 to 300 parts by weight and preferably from 40 to 150 parts by weight based on 100 parts by weight of a binder resin. In addition, the layer thickness of the charge transport layer is preferably from about 5 to about 100 μm.

Specific examples of the solvents include tetrahydrofuran, dioxane, toluene, dichloromethane, monochlorobenzne, dichloroethane, cyclohexanone, methyl ethyl ketone, and acetone. Among these, to reduce the burden on the environment, the use of a non-halogenated solvent is preferred. Preferred specific examples thereof include cyclic ethers such as tetrahydrofuran, dioxolane and dioxane, aromatic hydrocarbons such as toluene and xylene and their derivatives.

In addition, a charge transport polymer which can function as a charge transport material and a binder resin can be suitably used in a charge transport layer. A charge transport layer formed of such a charge transport polymer has an excellent anti-abrasion property. Any known materials can be used as the charge transport polymer and especially polycarbonate having a triaryl amine structure in its main and/or side chain is suitably used. In particular, charge transport polymers represented by the following formulae of 2, 5 to 13 are preferably used:

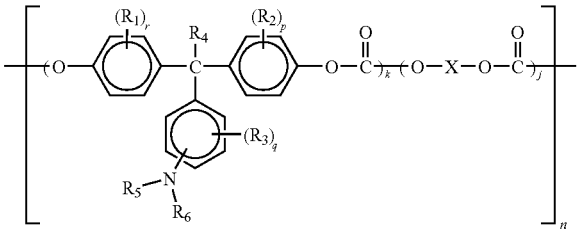

(1)

wherein $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aryl group; r, p and q independently represent 0 or an integer of from 1 to 4; k is a number of from 0.1 to 1.0 and j is a number of from 0 to 0.9; n is an integer of from 5 to 5000; and X represents a divalent aliphatic group, a divalent alicyclic group or a divalent group having the following formula:

Chemical formula 3

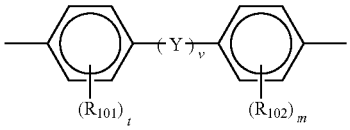

wherein $R_{101}$ and $R_{102}$ independently represent a substituted or unsubstituted alkyl group, a substituted or unsubstituted aryl group, or a halogen atom; t and m represent 0 or an integer of from 1 to 4; v is 0 or 1; and Y represents a linear, branched or cyclic alkylene group having 1 to 12 carbon atoms, —O—, —S—, —SO—, —$SO_2$—, —CO—, —CO—O-Z-O—CO— (Z represents a divalent aliphatic group), or a group having the following formula:

Chemical formula 4

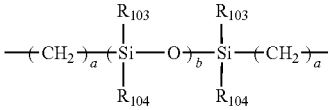

wherein a is an integer of from 1 to 20; b is an integer of from 1 to 2,000; and $R_{103}$ and $R_{104}$ independently represent a substituted or unsubstituted alkyl group, or a substituted or unsubstituted aryl group, wherein $R_{101}$, $R_{102}$, $R_{103}$ and $R_{104}$ can be the same or different from the others.

Chemical formula 5

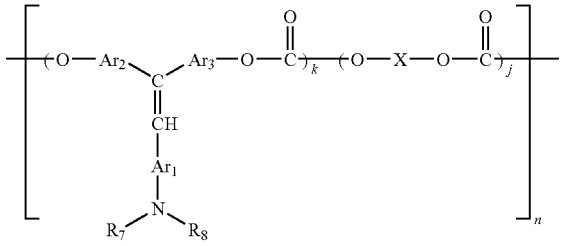

wherein $R_7$ and $R_8$ independently represent a substituted or unsubstituted aryl group; $Ar_1$, $Ar_2$ and $Ar_3$ independently represent an arylene group; and X, k, j and n are defined above in chemical formula 2.

Chemical formula 6

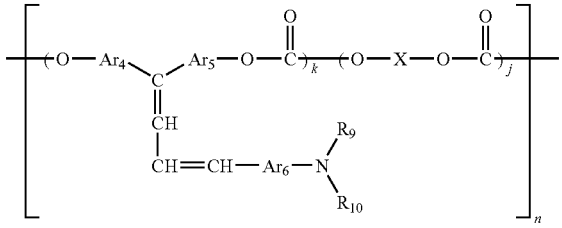

wherein $R_9$ and $R_{10}$ independently represent a substituted or unsubstituted aryl group; $Ar_4$, $Ar_5$ and $Ar_6$ independently represent an arylene group; and X, k, j and n are defined above in Chemical formula 2.

Chemical formula 7

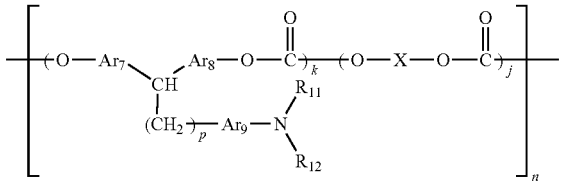

wherein $R_{11}$ and $R_{12}$ independently represent a substituted or unsubstituted aryl group; $Ar_7$, $Ar_8$ and $Ar_9$ independently represent an arylene group; p is an integer of from 1 to 5; and X, k, j and n are defined above in Chemical formula 2.

Chemical formula 8

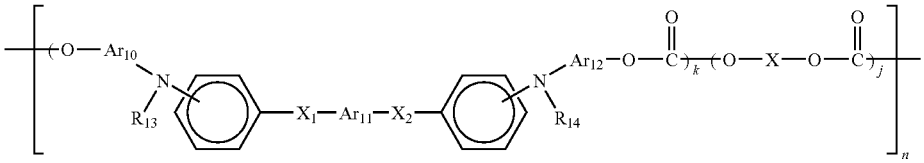

wherein $R_{13}$ and $R_{14}$ independently represent a substituted or unsubstituted aryl group; $Ar_{10}$, $Ar_{11}$ and $Ar_{12}$ independently represent an arylene group; $X_1$ and $X_2$ independently represent a substituted or unsubstituted ethylene group, or a substituted or unsubstituted vinylene group; and X, k, j and n are defined above in Chemical formula 2.

Chemical formula 9

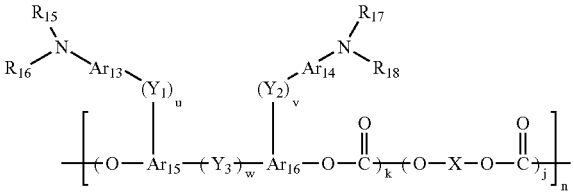

wherein $R_{15}$, $R_{16}$, $R_{17}$ and $R_{18}$ independently represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a substituted or unsubstituted alkylene group, a substituted or unsubstituted cycloalkylene group, a substituted or unsubstituted alkyleneether group, an oxygen atom, a sulfur atom, or a vinylene group; u, v and w independently represent 0 or 1; and X, k, j and n are defined above in Chemical formula 2.

Chemical formula 10

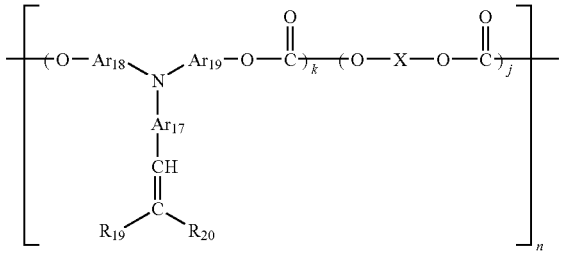

wherein $R_{19}$ and $R_{20}$ independently represent a hydrogen atom, or substituted or unsubstituted aryl group, and $R_{19}$ and $R_{20}$ optionally share bond connectivity to form a ring; $Ar_{17}$, $Ar_{18}$ and $Ar_{19}$ independently represent an arylene group; and X, k, j and n are defined above in Chemical formula 2.

Chemical formula 11

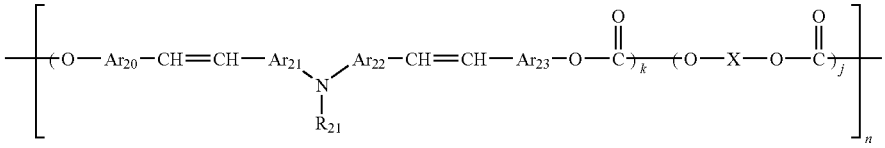

wherein $R_{21}$ represents a substituted or unsubstituted aryl group; $Ar_{20}$, $Ar_{21}$, $Ar_{22}$ and $Ar_{23}$ independently represent an arylene group; and X, k, j and n are defined above in Chemical formula 2.

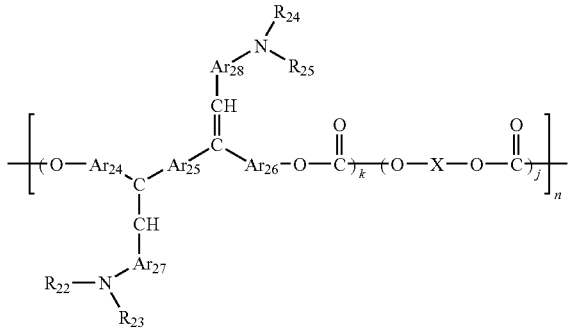

wherein $R_{22}$, $R_{23}$, $R_{24}$ and $R_{25}$ independently represent a substituted or unsubstituted aryl group; $Ar_{24}$, $Ar_{25}$, $Ar_{26}$, $Ar_{27}$ and $Ar_{28}$ independently represent an arylene group; and X, k, j and n are defined above in Chemical formula 2.

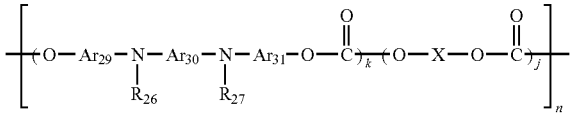

wherein $R_{26}$ and $R_{27}$ independently represent a substituted or unsubstituted aryl group; $Ar_{29}$, $Ar_{30}$ and $Ar_{31}$ independently represent an arylene group; and X, k, j and n are defined above in Chemical formula 2.

Chemical formulae 2 and 5 to 13 are illustrated in the form of block copolymers, but the polymers are not limited thereto, and may be random copolymers.

In addition, the charge transport layer can also be formed by coating more monomers or oligomers having one or more electron donating groups, and thereafter subjecting the monomers or oligomers to a cross-linking (curing) reaction such that the layer finally has a two- or three-dimensional cross-linking structure.

A charge transport layer formed of such a polymer or cross-linked polymer having one or more electron donating group, has good abrasion resistance. In the electrophotographic process, the potential of charges formed on an image bearing member (i.e., the potential of a non-irradiated area) is generally set to be constant. Therefore, the heavier the abrasion loss of the photosensitive layer of the image bearing member, the larger the intensity of electric field formed on the image bearing member.

When the intensity of electric field increases, background fouling occurs in the resultant images. Namely, an image bearing member having a good abrasion resistance hardly causes the background fouling problem. The above-mentioned charge transport layer formed of a polymer having an electron donating group has a good film formability because the layer itself is a polymer. In addition, the charge transport layer has a good charge transportability since charge transport moieties can be formed therein at a relatively high concentration in comparison with a charge transport layer containing a polymer and a low molecular weight charge transport material. Namely, the image bearing member including a charge transport layer formed of a charge transport polymer has a high response property.

Known copolymers, block polymers, graft polymers, and star polymers can also be used as a polymer having an electron donating group. In addition, a cross-linking polymer including an electron donating group described in JOP 03-109406, 2000-206723, and 2001-34001, can also be used to form the charge transport layer.

The charge transport layer for use in the present invention can include additives such as a plasticizer and a leveling agent. Specific examples of the plasticizers include known plasticizers such as dibutyl phthalate and dioctyl phthalate. The content of the plasticizer in the charge transport layer is from 0 to 30% by weight based on the binder resin included in the charge transport layer. Specific examples of the leveling agents include silicone oils such as dimethyl silicone oils and methyl phenyl silicone oils, and polymers and oligomers, which include a perfluoroalkyl group in their side chain. The content of the leveling agent in the charge transport layer is from 0 to 1% by weight based on the binder resin included in the charge transport layer.

Hereinbefore, the layer accumulated photosensitive layer is described. However, the photosensitive layer of the image bearing member of the present invention is not limited to the layer accumulated photosensitive layer, and a single-layered photosensitive layer can also be used. In this case, the photosensitive layer includes at least a charge generating material (i.e., titanyl phthalocyanine having a specific crystal form and particle size) and a binder resin. Suitable materials for use as the binder resin include the materials mentioned above for use as the binder resin in the charge generating layer and the charge transport layer. In addition, a charge transport material is preferably added to the single-layered photosensitive layer so that the resultant image bearing member has high photosensitivity, high carrier transportability and low residual potential. The proper charge transport material is chosen from either of a hole transport material or an electron transport material depending on the charge formed on the surface of the image bearing member. In addition, the charge transport polymer mentioned above can also be preferably used for the single-layered photosensitive layer.

In the image bearing member of the present invention, a protective layer is optionally provided on a photosensitive layer for protection. Recently, computers have been used in daily life, and therefore, a high-speed printing and size reduction are demanded for a printer. Such a protective layer on a photosensitive layer can improve the durability of an image bearing member. Therefore, the image bearing member of the present invention having a high sensitivity can be fully utilized without producing abnormal images.

Specific examples of the materials for use in the protective layer include ABS resins, ACS resins, olefin-vinyl monomer copolymers, chlorinated polyether, allyl resins, phenolic resins, polyacetal, polyamide, polyamideimide, polyallysulfone, polybutylene, polybutyleneterephthalate, polycarbonate, polyarylate, polyethersulfone, polyethylene, polyethyleneterephthalate, polyimide, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins, etc. Among these resins, polycarbonate and polyarylate are preferably used.

In addition, to improve the anti-abrasion property of such a protective layer, fluorine-containing resins such as polytetrafluoroethylene, and silicone resins can be used therefor. Further, combinations of such resins and an inorganic filler such as titanium oxide, aluminum oxide, tin oxide, zinc oxide, zirconium oxide, magnesium oxide, potassium titanate and silica or an organic filler can also be used therefor. These inorganic fillers may be subjected to a surface-treatment.

In addition, organic and inorganic fillers can be used in the protective layer. Suitable organic fillers include powders of fluorine-containing resins such as polytetrafluoroethylene, silicone resin powders, amorphous carbon powders, etc. Specific examples of the inorganic fillers include powders of metals such as copper, tin, aluminum and indium; metal oxides such as alumina, silica, tin oxide, zinc oxide, titanium oxide, alumina, zirconia, indium oxide, antimony oxide, bismuth oxide, calcium oxide, tin oxide doped with antimony, indium oxide doped with tin; potassium titanate, etc. In terms of the hardness of a filler, the inorganic fillers are preferred. In particular, silica, titanium oxide and alumina are preferred.

The content of the filler in the protective layer is preferably determined depending on the species of the filler used and the application conditions of the resultant image bearing member, but the content of a filler on the uppermost surface side of a protective layer is preferably not less than 5% by weight, more preferably from 10 to 50% by weight, and even more preferably from 10 to 30% by weight, based on the total weight of the solid potion of the side.

The filler included in the protective layer preferably has a volume average particle diameter of from 0.1 to 2 μm, and more preferably from 0.3 to 1 μm. When the average particle diameter is too small, the anti-abrasion property of the resultant image bearing member is not satisfactory. In contrast, when the average particle diameter is too large, the surface of the resultant protective layer significantly becomes irregular or a protective layer is not formed.

The average particle diameter of a filler described in the present invention means a volume average particle diameter unless otherwise specified, and is measured using an ultracentrifugal automatic particle size measuring device (CAPA-700, manufactured by Horiba Ltd.). Therein, the cumulative 50% particle diameter (i.e., the median particle diameter) is defined as the average particle diameter. In addition, it is preferred that the standard deviation of the particle diameter distribution curve of the filler used for the protective layer is not greater than 1 μm. When the standard deviation is too large (i.e., when the filler has too broad particle diameter distribution), the effect of the present invention is not obtained.

In addition, pH of a filler for use in the present invention has a large effect on the resolution of images produced and the dispersability thereof in liquid of application. One of the thinkable reasons is as follows. Hydrochloric acid used in the preparation of the filler (in particular, metal oxides) may remain therein. When the content of the remaining hydrochloric acid is large, the resultant image bearing member tends to produce blurred images. In addition, hydrochloric acid can have an adverse effect on the dispersibility of the filler depending on the remaining amount thereof.

Another reason therefor is that the chargeability of a filler (in particular, a metal oxide) is greatly affected by the pH of the fillers. In general, particles dispersed in a liquid are positively or negatively charged for electric neutralization. As a result, an electric double layer is formed and thereby the particles are stably dispersed in the liquid. As the distance from the particle increases, the potential (i.e., zeta potential) dwindles to zero in an electrically neutral area. As the absolute value of zeta potential increases, the repulsion between particles is strong, meaning that the stability of the dispersion is high. As the absolute value of zeta potential approaches to zero, the particles easily aggregate. The zeta potential of a system greatly depends on the pH thereof. The zeta potential becomes zero at a particular pH, meaning that the system has an isoelectric point. Therefore, to stabilize a dispersion system, it is preferred to increase the absolute value of zeta potential, meaning away from the isoelectric point of the system.

It is preferred that the protective layer contains a filler having a pH of 5 or higher at the isoelectric point to prevent production of a blurred image. In other words, a filler having a highly basic property is preferably used in the image bearing member of the present invention to increase the prevention effect. A filler having a high basic property at an isoelectirc point has a high zeta potential (i.e., the filler is stably dispersed) in an acidic system.

In this invention, the pH of a filler means the pH value of the filler at the isoelectric point, which is determined by the zeta potential of the filler. Zeta potential can be measured by a laser beam potential meter manufactured by Otsuka Electronics Co., Ltd.

In addition, to prevent production of blurred images, a filler having a high electric resistance (i.e., not less than $1\times10^{10}$ Ω·cm in resistivity) is preferably used. Further, a filler having a pH not less than 5 and a filler having a dielectric constant not less than 5 can be particularly preferably used. A filler having a dielectric constant not less than 5 and/or a pH not less than 5 can be used alone or in combination. In addition, a filler having a pH not less than 5 and a filler having a pH less than 5, or a filler having a dielectric constant not less than 5 and a filler having a dielectric constant less than 5 can also be used in combination. Among these fillers, α-alumina, which has a high insulating property, a high heat stability and an anti-abrasion property due to its hexagonal close-packed structure, is particularly preferred in terms of prevention of formation of blurred images and improvement of anti-abrasion property of the resultant image bearing member.

In the present invention, the resistivity of a filler is defined as follows. The resistivity of a powder such as a filler fluctuates depending on the filling factor thereof. Therefore, it is desired to measure the resistivity under a constant condition. In the present invention, the resistivity is measured by a device having a similar structure to that of device illustrated in FIG. 1 of JOP H05-113688. The surface area of the electrodes of the device is 4.0 $cm^2$. Before the resistivity of a sample powder is measured, a load of 4 kg is applied to one of the electrodes for 1 minute and the amount of the sample powder is adjusted such that the distance between the two electrodes is 4 mm.

The resistivity of the sample powder is measured while the sample powder is under pressure of the weight (i.e., 1 kg) of the upper electrode without any other load. The voltage applied to the sample powder is 100 V. HIGH RESISTANCEMETER (from Yokogawa Hewlett-Packard Co.) is used to measure the resistivity not less than $10^6$ Ω·cm. A digital multimeter (from Fluke Corp.) is used to measure the resistivity less than $10^6$ Ω·cm. The thus obtained resistivity is defined as the resitivity of the present invention.

The dielectric constant of a filler is measured as follows. A cell similar to that used in measuring the resistivity is also used to measure a dielectric constant. After a load is applied to a sample powder, the electric capacity of the sample powder is measured using a dielectric loss measuring instrument (from Ando Electric Co., Ltd.) to determine the dielectric constant of the powder.

These fillers can be subject to surface treatment using at least one surface treatment agent to improve the dispersion property of the fillers in a protective layer. When a filler is poorly dispersed in a protective layer, the following problems occur.

(1) the residual potential of the resultant image bearing member increases;

(2) the transparency of the resultant protective layer decreases;

(3) coating defects occur in the resultant protective layer;

(4) the anti-abrasion property of the protective layer deteriorates;

(5) the durability of the resultant image bearing member deteriorates; and (6) the image qualities of the images produced by the resultant image bearing member deteriorate.

Suitable surface treatment agents include known surface treatment agents. Among these, surface treatment agents which can maintain the highly insulative property of a filler used are preferred.

As the surface treatment agents, titanate coupling agents, aluminum coupling agents, zircoaluminate coupling agents, higher fatty acids, combinations of these agents with a silane coupling agent, $Al_2O_3$, $TiO_2$, $ZrO_2$, silicones, aluminum stearate, and the like, can be preferably used to improve the dispersibility of fillers and to prevent formation of blurred images. These materials can be used alone or in combination.

When a filler treated with a silane coupling agent is used, the resultant image bearing member tends to produce blurred images. However, when a silane coupling agent is used in combination with one of the surface treatment agents mentioned above, the affect of the silane coupling is possibly restrained.

The coating weight of a surface treatment agents is preferably from 3 to 30% by weight, and more preferably from 5 to 20% by weight, based on the weight of the treated filler although the weight is determined depending on the average primary particle diameter of the filler.

When the content of the surface treatment agent is too low, the dispersibility of the filler is not improved. In contrast, when the content is too high, the residual potential of the resultant image bearing member significantly increases.

These fillers can be dispersed using a proper dispersion machine. In this case, the fillers are preferably dispersed to an extent such that the aggregated particles are dissociated and primary particles of the fillers are dispersed to improve the transparency of the resultant protective layer.

In addition, a charge transport material can be contained in the protective layer to enhance the photo-responsive property and to reduce the residual potential of the resultant image bearing member. The charge transport materials mentioned above for use in the charge transport layer can also be used for the protective layer.

When a low molecular weight charge transport material is used in a protective layer, the concentration of the charge transport material may be gradated in the thickness direction of the protective layer with the surface side being thinner. Specifically, it is preferred to reduce the concentration of the charge transport material at the surface portion of the protective layer to improve the anti-abrasion property of the resultant image bearing member. The concentration of the charge transport material means the ratio of the weight of the charge transport material to the total weight of the protective layer.

It is extremely advantageous to use a charge transport polymer in the protective layer to improve the durability of the image bearing member.

The protective layer can be formed by any known coating method. The thickness thereof is preferably from about 0.1 to about 10 μm. In addition, known materials such as a-C and a-SiC formed by a vacuum thin layer forming method can be used as a protective layer.

As another form of the protective layer, a cross-linking type protective layer having a charge transport structure is effectively used. By using such a cross-linking type protective layer having a charge transport structure, the increase of the intensity of electric field during repetitive use can be more effectively restrained, which is effective to restrain the background fouling. Further, the surface of an image bearing member can have a good anti-scratch property and anti-filming property. Therefore, the occurrence of image deficiency can be reduced and it is effective and suitable for an image bearing member to have a good durability. Furthermore, in comparison with a filler dispersed type protective layer, the cross-linking type protective layer is relatively uniform. That is, the abrasion of the surface layer of the cross-linking type protective layer of an image bearing member by a cleaning member is uniform and the image bearing member has uniform electrostatic characteristics in a minute area.

In the cross-linking type protective layer having a charge transport structure, a three-dimensional mesh structure is developed because the protective layer has a cross-linking structure formed by curing a radical polymeric monomer having at least 3 functional groups. Therefore, the resultant surface layer has an extremely high cross linking density with a high hardness and a high elasticity. Further, the surface is uniform and smooth and obtains a high anti-abrasion property and a high anti-damage property. As described above, it is important to increase the cross-linking density of the surface, i.e., the number of the cross-linkings per unit area. However, an internal stress is generated due to volume contraction since a number of linkings are formed instantly during curing reaction. This internal stress increases as the layer thickness of a cross-linking type protective layer thickens. Therefore, curing the entirety of a cross-linking type protective layer tends to invite cracking and peeling-off thereof. This phenomenon may not occur initially. But while electrophotography processes such as charging, developing, transferring and cleaning are repetitively performed, such cracking and peeling-off tend to occur due to cleaning hazard, thermal fluctuation, etc. over time.

There are the following methods for solving this problem: (1) introducing a polymeric component in the cross-linking layer and the cross-linking structure, (2) using a radical polymeric monomer having one or two functional groups in a large amount, and (3) using a monomer having multi-functional groups having a plasticity group. The cured resin layer can be flexible by these methods. However, the cross-linking density is thin in either of these methods and the anti-abrasion property is not significantly improved. To the contrary, the image bearing member of the present invention has a cross linking type protective layer having a charge transport structure with a high cross linking density provided on a charge transport layer. The cross linking type protective layer has a layer thickness of from 1 to 10 μm in which a three-dimensional structure is developed. Thereby, such cracking and peeling-off does not occur to the image bearing member of the present invention and further, an extremely high anti-abrasion property is obtained. When the layer thickness of a cross linking type protective layer having such a charge transport structure is from 2 to 8 μm, the margin against the problem mentioned above is wide. In addition, a material having a high cross-linking density can be selected to further improve the anti-abrasion property.

The reason the image bearing member of the present invention can restrain the occurrence of cracking and peeling-off is, for example, that the internal stress can be limited because the cross linking type protective layer having a charge transport structure can be made to be thin. Another reason is that the internal stress in the cross-linking type protective layer forming the surface can be relaxed because the charge transport layer is provided under the cross linking type protective layer.

Thereby, the cross linking type protective layer having a charge transport structure does not necessarily contain a polymeric material in a large amount, which leads to reduction of incompatibility of a cured compound produced during the reaction between the polymeric material and a radical polymeric composition (radical polymeric monomer or a radical polymeric compound having a charge transport structure). Therefore, scars and toner filming ascribable to the incompatibility hardly occur. Further, when a charge transport layer is entirely cured upon application of optical energy, light transmission inside the charge transport layer is limited due to the absorption thereof by the charge transport structure. Thereby, there is a possibility that the curing reaction does not fully and uniformly proceed inside the layer. In the cross linking type protective layer having a charge transport structure for use in the present invention, the curing reaction uniformly proceeds inside the layer because the layer is thin, i.e., preferably not greater than 10 μm. Therefore, the layer can have a good anti-abrasion property therein as on the surface. Further, the cross linking protective layer having a charge transport structure is formed of a radical polymeric compound having a functional group in addition to the radical polymeric monomer having three functional groups mentioned above. The radical polymeric compound having a functional group and a charge transport structure is trapped in the cross-linking when the radical polymeric monomer having three functional groups is cured. In contrast, when a low molecular weight charge transport material having no functional group is contained in the cross-linking surface layer, the low molecular weight charge transport material precipitates or clouding phenomenon occurs due to its low compatibility. Further, the mechanical strength of the surface of the cross-linking layer deteriorates. On the other hand, when a charge transport material having at least two functional groups is mainly used, the charge transport material is trapped in multiple linkages, which leads to improvement on the cross-linking density. However, the charge transport structure is extremely bulky, which greatly distorts the structure of the resultant curing resin. This can be a cause of increasing the internal stress in a cross-linking type charge transport layer.

Further, the image bearing member of the present invention has good electric characteristics and therefore has a good stability for repetitive use, which leads to high durability and stability. This is because a radical polymeric compound having a functional group and a charge transport structure is used as a composition material forming the cross-linking type protective layer having a charge transport structure and is fixed between the cross linkings in a pendant manner. As described above, a low molecular weight charge transport material having no functional group precipitates or white turbidity phenomenon occurs, which leads to significant deterioration of the electric characteristics, such as deterioration of sensitivity and rise of the residual voltage, during repetitive use. When a charge transport compound having at least two functional groups is mainly used, the charge transport compound is fixed in the cross linking structure with multiple linkings. Therefore, the structure of the intermediary body (cation radical) during charge transport is not stable, which may lead to deterioration of sensitivity and rise of the residual voltage by charge entrapment. The deterioration of the electric characteristics results in the decrease in the image density and an image with thinned lines. Further, the design of a typical image bearing member, which is designed to have a high transportability with less charge entrapment, can be applied to an undercoating layer of the image bearing member of the present invention. Therefore, electric side effects of the cross linking type protective layer having a charge transport structure can be limited to the minimal level.

Further, the cross-linking type protective layer having a charge transport structure is insoluble in an organic solvent during the formation of the cross-linking type protective layer having a charge transport structure. Therefore, the cross-linking type protective layer having a charge transport structure of the present invention is highly anti-abrasive. The cross-linking type protective layer of the present invention is formed by curing a radical polymeric monomer having three functional groups without having a charge transport structure and a radical polymeric compound having a functional group and a charge transport structure. A three-dimensional mesh structure is developed in the cross-linking type protective layer and therefore the density of the cross-linking structure therein is high. However, depending on the other components (additives such as a monomer having one or two functional groups, a polymeric binder, an anti-oxidization agent, a leveling agent and a plasticizer and a dissolved component commingling from the layer disposed under the protective layer) other than the polymeric monomer and the compound mentioned above and the curing conditions, the cross linking density may locally be thin or a collective body of fine cured cross-linked materials having a high density is formed. In this type of cross-linking type protective layer, the linkage force among cured materials is weak and soluble in an organic agent. Further, during repetitive use in the electrophotography process, the cross linking type charge transport layer tends to be locally abraded and the fine cured material is easily detached in a minute piece. As in the present invention, when a cross-linking type protective layer having a charge transport structure is insoluble in an organic solvent, the proper three-dimensional mesh structure is developed with a high density. In addition, since the chain reaction proceeds in a wide area and the cured material grows and has a high molecular weight, the anti-abrasion property is highly improved.

Below is a description about the composition materials of the liquid of application for use in forming the cross linking type protective layer having a charge transport structure.

The radical polymeric monomer having three functional groups without having a charge transport structure represents a monomer having at least three radical polymeric functional groups and not having a positive hole structure such as triaryl amine, hydrazone, pyrazoline, and carbazole, nor an electron transport structure such as condensed polycyclic quinone, diphenoquinone and electron absorbing aromatic ring having a cyano group, a nitro group, etc. Any radical polymeric functional group which has one or more carbon-carbon double linkages and can perform radical polymerization can be used. For example, 1-substituted ethylene functional group and 1,1-substituted ethylene functional group can be used as suitable radical polymeric functional groups.

A specific example of 1-substituted ethylene functional groups is the functional group represented by the following chemical formula 14:

$$CH_2{=}CH{-}X_1{-} \qquad \text{Chemical formula 14}$$

wherein $X_1$ represents an arylene group such as a substituted or non-substituted phenylene group and naphthylene group, a substituted or non-substituted alkenylene group, —CO— group, —COO— group, —CON($R_{10}$) group (wherein, $R_{10}$ represents hydrogen, an alkyl group such as methyl group and ethyl group, an aralkyl group such as benzyl group, naphthyl methyl group, and an aryl group such as phenethyl group and naphthyl group), or —S— group.

Specific examples of such functional groups include vinyl group, styryl grup, 2-methyl-1,3-butadienyl group, vinyl carbonyl group, acryloyloxy group, acryloyl amide group, and vinylthio ether group.

A specific example of 1,1-substituted ethylene functional groups is the functional group represented by the following chemical formula 15:

$$CH_2{=}C(Y){-}(X_2)_d{-} \qquad \text{Chemical formula 15,}$$

Wherein Y represents a substituted or non-substituted alkyl group, a substituted or non-substituted aralkyl group, an aryl group such as a substituted or non-substituted phenyl group and naphtyl group, a halogen atom, cyano group, nitro group, an alokoxy group such as methoxy group and ethoxy group, —$COOR_{11}$ ($R_{11}$ represents hydrogen atom, an alkyl group such as a substituted or non-substituted methyl group or ethyl group, an aralkyl group such as a substituted or non-substituted benzyl group and phenylthyl group, an aryl group such as substituted or non-substituted phenyl group and naphtyl group or —$CONR_{12}R_{13}$ ($R_{12}$ and $R_{13}$ independently represent a hydrogen atom, an alkyl group such as a substituted or non-substituted methyl group or ethyl group, an aralkyl group such as a substituted or non-substituted benzyl group, naphthyl methyl group, and phenethyl group, or an aryl group such as substituted or non-substituted phenyl group and naphtyl group) $X_2$ represents the same substitution group as $X_1$, or an alkylene group and d represents 0 or 1. At least one of Y and $X_2$ is an oxycarbonyl group, cyano group, an alkenylene group and an aromatic ring.

Specific examples of these functional groups include α-cyanoacryloyloxy group, methacryloyloxy group, α-cyanoethylene group, α-cyanoacryloyloxy group, α-cyanophneylene group and methacryloyl amino group.

Specific examples of substitution groups further substituted to the substitution groups of $X_1$, $X_2$ and Y include a halogen atom, nitro group, cyano group, an alkyl group such as methyl group and ethyl group, an alkoxy group such as methoxy group and ethoxy group, an aryloxy group such as phenoxy group, an aryl group such as phenyl group and naphtyl group, and an aralkyl group such as benzyl group and phenetyl group.

Among these radical polymeric functional groups, an acryloyloxy group and a methacyloyloxy group are particularly suitable. A compound having at least three acryloyloxy groups can be obtained by performing ester reaction or ester conversion reaction using, for example, a compound having at least three hydroxyl groups therein and an acrylic acid (salt), a halide acrylate and an ester of acrylate. Similarly, a compound having at least three methacryloyloxy groups can be obtained. In addition, the radical polymeric functional groups in a monomer having at least three radical polymeric functional groups can be the same or different from each other.

The radical polymeric monomer having three functional groups without having a charge transport structure are specifically the following compounds but not limited thereto.

Specific examples of the radical polymeric monomer mentioned above for use in the present invention include trimethylol propane triacrylate (TMPTA), trimethylol propane trimethacrylate, trimethylol propane alkylene modified triacrylate, trimethylol propane ethyleneoxy modified (hereinafter referred to as EO modified) triacrylate, trimethylol propane propyleneoxy modified (hereinafter referred to as PO modified) triacrylate, trimethylol propane caprolactone modified triacrylate, trimethylol propane alkylene modified triacrylate, pentaerythritol triacrylate, pentaerythritol tetra acrylate (PETTA), glycerol triacrylate, glycerol epichlorohydrin modified (hereinafter referred to as ECH modified) triacrylate, glycerol EO modified triacrylate, glycerol PO modified triacrylate, tris (acryloxyrthyl) isocyanulate, dipenta erythritol hexacrylate (DPHA), dipenta erythritol caprolactone modified hexacrylate, dipenta erythritol hydroxyl dipenta acrylate, alkylized dipenta erythritol tetracrylate, alkylized dipenta erythritol triacrylate, dimethylol propane tetracrylate (DTMPTA), penta erythritol ethoxy tetracrylate, phosphoric acid EO modified triacrylate, and 2,2,5,5-tetrahydroxy methyl cyclopentanone tetracrylate. These can be used alone or in combination.

In addition, the radical polymeric monomer having three functional groups without having a charge transport structure for use in the present invention preferably has a ratio (molecular weight/the number of functional groups) of the molecular weight to the number of functional groups in the monomer is not greater than 250 to form a dense cross-linking in a cross linking type charge transport layer. Further, since a cross-linking type charge transport layer formed of such a monomer is slightly soft, when the ratio (molecular weight/the number of functional groups) is too large, the anti-abrasion property thereof tends to deteriorate. Therefore, among the monomers mentioned above, it is not preferred to singly use a monomer having an extremely long modified (EO, PO, caprolactone modified) group. In addition, the content ratio of the radical polymeric monomer having three functional groups without having a charge transport structure is from 20 to 80% by weight and preferably from 30 to 70% by weight based on the total weight of a cross-linking type protective layer having a charge transport structure. When the monomer content ratio is too small, the density of three-dimensional cross-linking in a cross-linking type protective layer tends to be small. Therefore, the anti-abrasion property thereof is not drastically improved in comparison with a case in which a typical thermal plastic binder resin is used. When the monomer content ratio is too large, the content of a charge transport compound decreases, which may cause deterioration of the electric characteristics. Desired electric characteristics and anti-abrasion property vary depending on the process and the layer thickness of the cross linking type protective layer having a charge transport structure for use in the present invention varies. Therefore, it is difficult to jump to any conclusion but considering the balance, the range of from 30 to 70% by weight is preferred.

The radical polymeric monomer having a functional group and a charge transport structure for use in the cross-linking type protective layer having a charge transport structure represents a monomer having a radical polymeric functional group which has a positive hole structure such as triaryl amine, hydrazone, pyrazoline, and carbazole, or an electron transport structure such as condensed polycyclic quinone, diphenoquinone and electron absorbing aromatic ring having a cyano group, a nitro group, etc. As the radical polymeric functional group, the radical polymeric functional group mentioned in the radical polymeric monomer mentioned above can be suitably used. Especially, acryloyloxy group and methcryloyloxy group are suitable. In addition, a triaryl amine structure is high effective as charge transport structure. Among these, when a compound having the structure represented by the following chemical formulae 16 and 17 is used, the electric characteristics such as sensitivity and residual voltage are preferably maintained during repetitive use.

Chemical formula 16

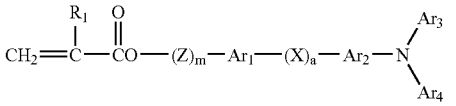

Chemical formula 17

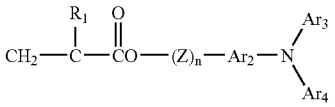

wherein, $R_1$ represents hydrogen atom, a halogen atom, an alkyl group, an aralky group, an aryl group, a cyano group, a nitro group, an alkoxy group, —$COOR_7$, wherein $R_7$ represents hydrogen atom, a substituted or non-substituted alkyl group, a substituted or non-substituted aralkyl group or a substituted or non-substituted aryl group, a halogenated carbonyl group or $CONR_8R_9$, wherein $R_8$ and $R_9$ independently represent hydrogen atom, a halogen atom, a substituted or non-substituted alkyl group, a substituted or non-substituted aralkyl group or a substituted or non-substituted aryl group, $Ar_1$ and $Ar_2$ independently represent a substituted or unsubstituted arylene group, $Ar_3$ and $Ar_4$ independently represent a substituted or unsubstituted aryl group, X represents a single bond, a substituted or non-substituted alkylene group, a substituted or non-substituted cycloalkylene group, a substituted or non-substituted alkylene ether group, oxygen atom, sulfur atom or a vinylene group, Z represents a substituted or non-substituted alkylene group, a substituted or non-substituted alkylene ether divalent group or an alkyleneoxy carbonyl divalent group, and a represents 0 or 1, m and n represent an integer of from 0 to 3.

Specific examples of the structure represented by the chemical formulae 16 and 17 are as follows.

In the chemical formulae 16 and 17, the alkyl group of $R_1$ is, for example, methyl group, ethyl group, propyl group, and butyl group. The aryl group thereof is, for example, phenyl group and naphtyl group. The aralkyl group thereof is, for example, benzyl group, phenthyl group, naphtyl methyl group. The alkoxy group thereof is, for example, methoxy group, ethoxy group and propoxy group. These can be substituted by a halogen atom, nitro group, cyano group, an alkyl group such as methyl group and ethyl group, an alkoxy group such as methoxy group and ethoxy group, an aryloxy group such as phenoxy group, an aryl group such as phenyl group and naphtyl group and an aralkyl group such as benzyl group and phenthyl group.

Among these substitution groups for $R_1$, hydrogen atom and methyl group are especially preferred.

$Ar_3$ and $Ar_4$ represent a substituted or non-substituted aryl group. Specific examples thereof include condensed polycyclic hydrocarbon groups, non-condensed ring hydrocarbon groups and heterocyclic groups.

Specific examples of the condensed polycyclic hydrocarbon groups include a group in which the number of carbons forming a ring is not greater than 18 such as pentanyl group, indenyl group, naphtyl group, azulenyl group, heptalenyl group, biphenylenyl group, as-indacenyl group, s-indacenyl group, fluorenyl group, acenaphtylenyl group, pleiadenyl group, acenaphtenyl group, phenalenyl group, phenanthryl group, anthryl group, fluorantenyl group, acephenantrirenyl group, aceantrirenyl group, triphenylene group, pyrenyl group, chrysenyl group, and naphthacenyl group.

Specific examples of the non-condensed ring hydrocarbon groups include a single-valent group of monocyclic hydrocarbon compounds such as benzene, diphenyl ether, polyethylene diphenyl ether, diphenylthio ether and phenylsulfon, a single-valent group of non-condensed polycyclic hydrocarbon compounds such as biphenyl, polyphenyl, diphenyl alkane, diphenyl alkene, diphenyl alkyne, triphenyl methane, distyryl benzene, 1,1-diphenyl cycloalkane, polyphenyl alkane and polyphenyl alkene or a single-valent group of ring aggregated hydrocarbon compounds such as 9,9-diphenyl fluorene.

Specific examples of the heterocyclic groups include a single-valent group such as carbazol, dibenzofuran, dibenzothiophene, oxadiazole, and thiadiazole.

The aryl groups represented by $Ar_3$ and $Ar_4$ can have a substitution group. Specific examples thereof are as follows:

(1) a halogen atom, cyano group, and nitro group;

(2) an alkyl group, preferably a straight chained or side chained alkyl group having 1 to 12, more preferably 1 to 8 and furthermore preferably from 1 to 4 carbons. These alkyl groups can have a fluorine atom, a hydroxyl group, an alkoxy group having 1 to 4 carbons, a phenyl group or a phenyl group substituted by a halogen atom, an alkyl group having 1 to 4 carbon atoms or an alkoxy group having 1 to 4 carbon atoms. Specific examples thereof include methyl group, ethyl group, n-butyl group, I-propyl group, t-butyl group, s-butyl group, n-propyl group, trifluoromethyl group, 2-hydroxy ethyl group, 2-ethoxyethyl group, 2-cyanoethyl group, 2-methoxyethyl group, benzyl group, 4-chlorobenzyl group, 4-methyl benzyl group and 4-phenyl benzyl group;

(3) an alkoxy group (—$OR_2$), wherein $R_2$ is the alkyl group represented in (2). Specific examples thereof include methoxy group, ethoxy group, n-propoxy group, i-propoxy group, t-butoxy group, n-butoxy group, s-butoxy group, i-butoxy group, 2-hydroxyethoxy group, benzyl oxy group and trifluoromethoxy group;

(4) an aryloxy group. As an aryl group, phenyl group, and naphtyl group are included. These can contain an alkoxy group having 1 to 4 carbon atoms, an alkyl group having a 1 to 4 carbon atoms or a halogen atom as a substitution group. Specific examples include phenoxy group, 1-naphtyloxy group, 2-naphtyloxy group, 4-methoxyphenoxy group, and 4-methylphenoxy group;

(5) an alkyl mercapto group or an aryl mercapto group. Specific examples thereof include methylthio group, ethylthio group, phenylthio group, and p-methylphenylthio group;

(6)

Chemical formula 18

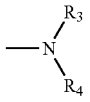

In Chemical formula 18, $R_3$ and $R_4$ independently represent a hydrogen atom, the alkyl group defined in (2), or an aryl group. Specific examples of the aryl groups include phenyl group, biphenyl group, or naphtyl group. These can contain an alkoxy group having 1 to 4 carbon atoms, an alkyl group having 1 to 4 carbon atoms or a halogen atom as a substitution group. $R_3$ and $R_4$ can share a linkage to form a ring.

Specific examples thereof include amino group, diethyl amino group, N-methyl-N-phenyl amino group, N,N-diphenyl amino groupo, N,N-di(tril) amino group, dibenzyl amino group, piperidino group, morpholino group, and pyrrolidino group;

(7) an alkylene dioxy group or an alkylene dithio such as methylene dioxy group and methylene dithio group; and (8) a substituted or non-substituted styryl group, a substituted or non-substituted β-phenyl styryl group, diphenyl aminophenyl group, ditril aminophenyl group, etc.

The arylene groups represented by $Ar_1$ and $Ar_2$ are divalent groups derived from the aryl group represented by $Ar_3$ and $Ar_4$ mentioned above.

The X in Chemical formula 16 represents a substituted or non-substituted alkylene group, a substituted or non-substituted cycloalkylene group, a substituted or non-substituted alkylene ether group, an oxygen atom, a sulfur atom, or a vinylene group.

Specific examples of the substituted or non-substituted alkylene groups include a straight chained or side chained alkylene group having 1 to 12, more preferably 1 to 8 and furthermore preferably from 1 to 4 carbons. These alkylene groups can further have a fluorine atom, a hydroxyl group, an alkoxy group having 1 to 4 carbons, a phenyl group or a phenyl group substituted by a halogen atom, an alkyl group having 1 to 4 carbon atoms or an alkoxy group having 1 to 4 carbon atoms. Specific examples thereof include methylene group, ethylene group, n-butylene group, i-propylene group, t-butylene group, s-butylene group, n-propylene group, trifluoromethylene group, 2-hydroxy ethylene group, 2-ethoxyethylene group, 2-cyanoethylene group, 2-methoxyethylene group, benzylidene group, phenyl ethylene group, 4-chlorophenyl ethylene group, 4-methylpheny ethylene group, and 4-biphenyl ethylene group.

Specific examples of the substituted or non-substituted cycloalkylene groups include cyclic alkylene group having 5 to 7 carbon atoms. These cyclic alkylene groups can have a fluorine atom, a hydroxyl group, an alkyl group having 1 to 4 carbon atoms, and an alkoxy group having 1 to 4 carbon atoms. Specific examples thereof include cyclohexylidene group, cyclohexylene group, and 3,3-dimethyl cyclohexylidene group.

Specific examples of the substituted or non-substituted alkylene ether groups include ethyleneoxy, propyleneoxy, ethyleneglycol, propylene glycol, diethylene glycol, tetraethylene glycol, and tripropylene glycol. These alkylene ether groups can have a substitution group such as hydroxyl group, methyl group and ethyl group.

The vinylene group is represented by the following chemical formulae 19 or 20:

Chemical formula 19

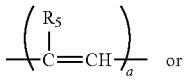

or

Chemical formula 20

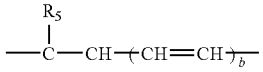

wherein, $R_5$ represents hydrogen or an alkyl group (same as the alkyl groups (defined in Chemical formula 17 mentioned above) and aryl group (same as the aryl groups represented by $Ar_3$ and $Ar_4$ mentioned above), a represents 1 or 2 and b is an integer of from 1 to 3.

The Z mentioned in Chemical formulae 16 and 17 represents a substituted or non-substituted alkylene group, a substituted or non-substituted alkylene ether divalent group or an alkyleneoxy carbonyl divalent group.

Specific examples of the substituted or non-substituted alkylene groups include the same as those mentioned for the X mentioned above.

Specific examples of the substituted or non-substituted alkylene ether divalent groups include the same as those mentioned for the X mentioned above.

Specific examples of the alkyleneoxy carbonyl divalent group include caprolactone modified divalent group.

The compound represented by the following chemical formula 21 as a further suitably preferred radical polymeric compound having a functional group with a charge transport structure:

Chemical formula 21

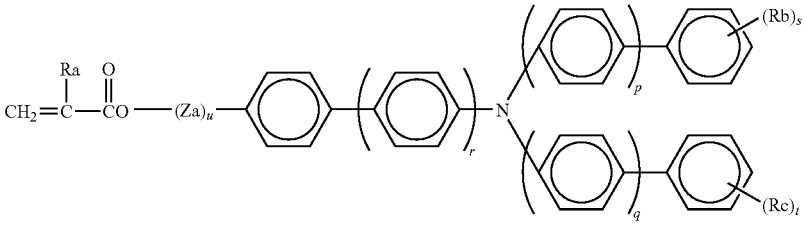

u, r, p, q represent 0 or 1, s and t represent an integer of from 0 to 3, Ra represents hydrogen atom or methyl group, Rb and Rc independently represent an alkyl group having 1 to 6 carbon atoms, and Za represents methylene group, ethylene group, —$CH_2CH_2O$—, —$CHCH_3CH_2O$—, or —$C_6H_5CH_2CH_2$—.

The compound represented by the chemical formula 21 illustrated above is especially preferably a compound having a methyl group or an ethyl group as a substitution group of Rb and Rc.

The radical polymeric compound having a functional group with a charge transport structure for use in the present invention represented by the chemical formulae 16, 17 and especially 21 is polymerized in a manner that both sides of the carbon-carbon double bond are open. Therefore, the radical polymer compound does not constitute an end of the structure and is set in a chained polymer. The radical polymeric compound having a functional group is present in the main chain of a polymer in which cross-linking is formed by polymerization with a radical polymeric monomer having 3 functional groups or a cross-linking chain between the main chains. There are two kinds of the cross-linking chains. One is the cross-linking chain between a polymer and another polymer and the other is the cross-linking chain formed by cross-linking a portion in the main chain present in a folded state in a polymer and a moiety deriving from a monomer polymerized away from the portion. Whether a radical polymeric compound having a functional group with a charge transport structure is present in a main chain or in a cross-linking chain, the triaryl amine structure suspends from the chain portion. The triaryl amine structure has at least three aryl groups disposed in the radial directions relative to the nitrogen atom therein. Such a triaryl amine structure is bulky but does not directly bind with the chain portion and suspends from the chain portion via the carbonyl group, etc. That is, the triaryl amine structure is stereoscopically fixed in a flexible state. Therefore, these triaryl amine structures can be adjacent to each other with a moderate space. Therefore, the structural distortion is slight in a molecule. In addition, when the structure is used in the surface layer of an image bearing member, it can be deduced that the internal molecular structure can have a structure in which there are relatively few disconnections in the charge transport route.

Below are the specific examples of the radical polymeric compounds having a functional group with a charge transport structure of the present invention. But the radical polymeric compounds are not limited thereto.

Chemical formulae 22

No. 1

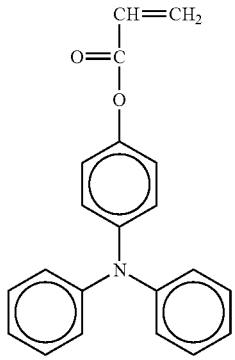

No. 2

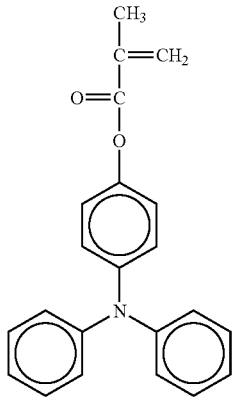

-continued

No. 3

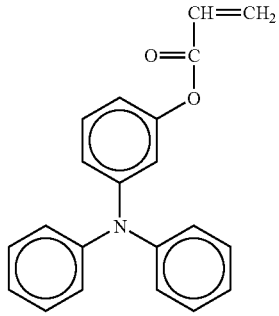

No. 4

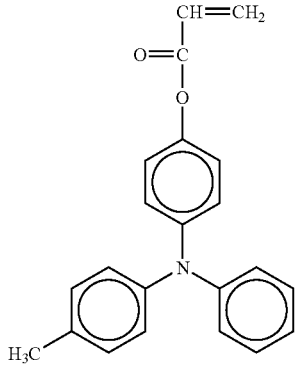

No. 5

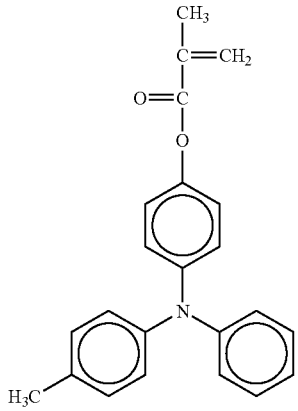

No. 6

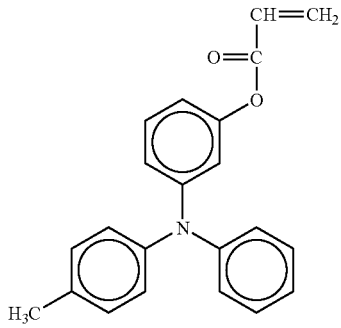

-continued
No. 7
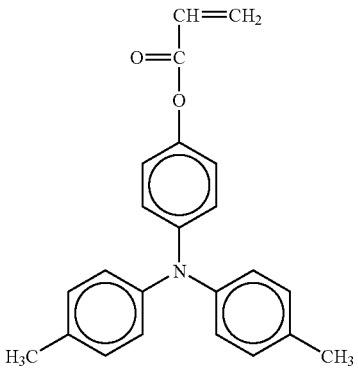
No. 8
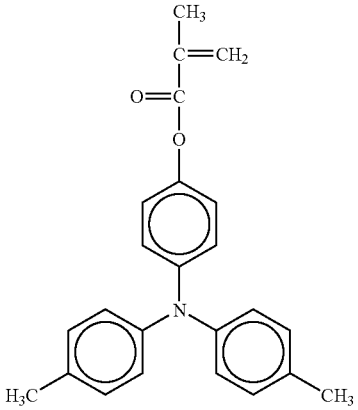
No. 9
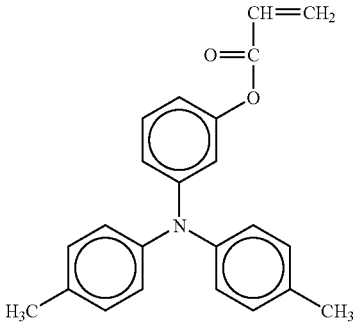
No. 10
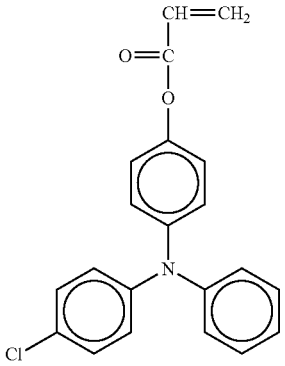
-continued
No. 11
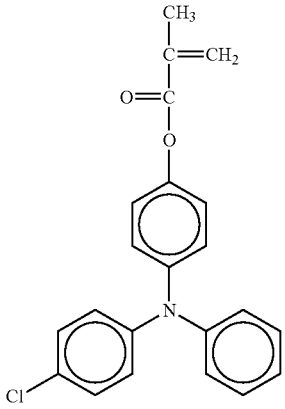
No. 12
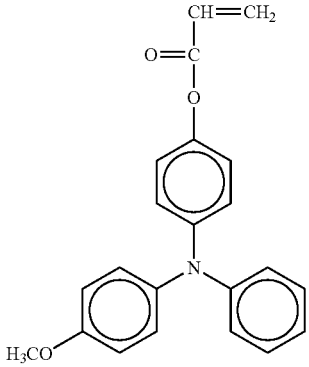
No. 13
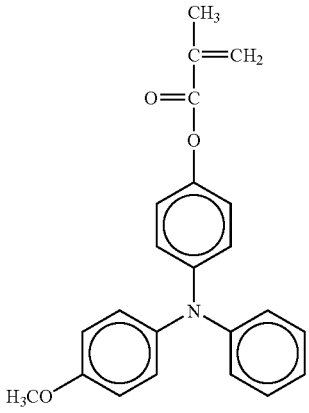
No. 14
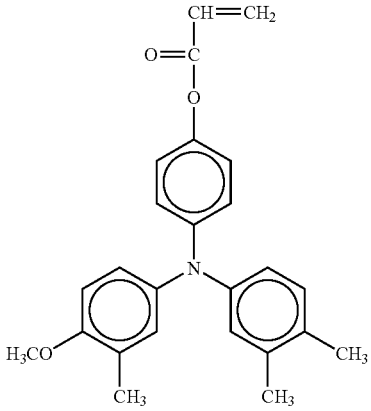

-continued
No. 15
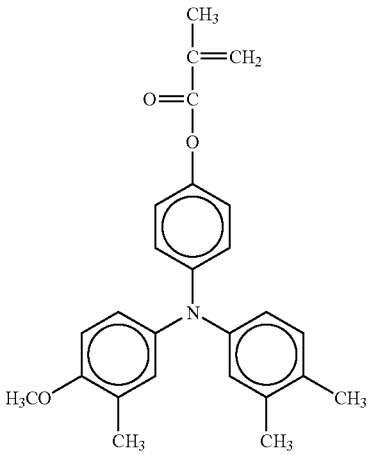
No. 16
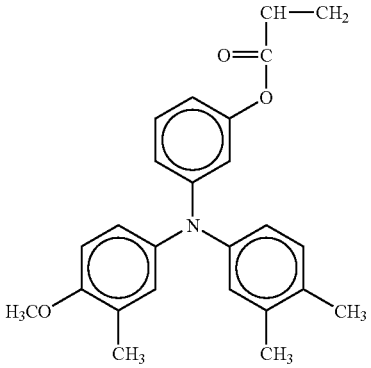
Chemical formula 23
No. 17
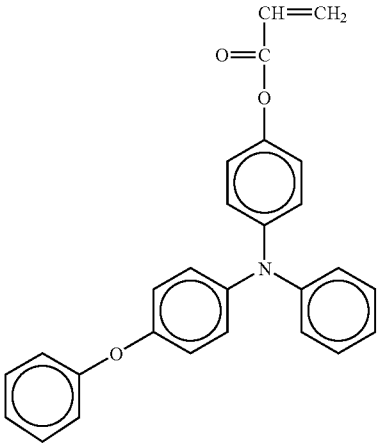
-continued
No. 18
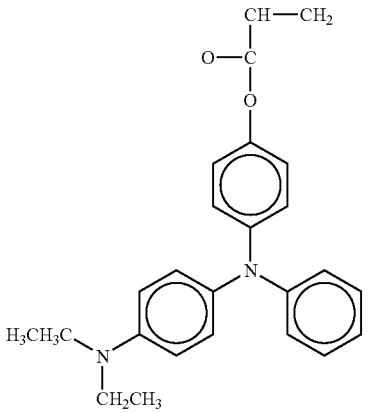
No. 19
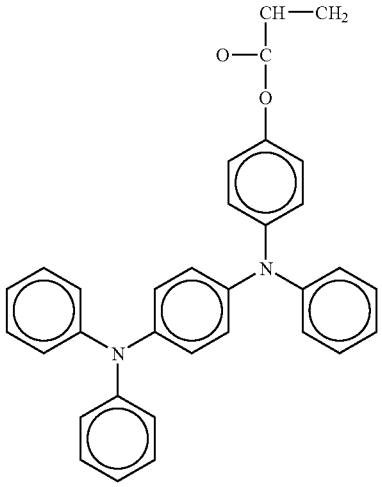
No. 20
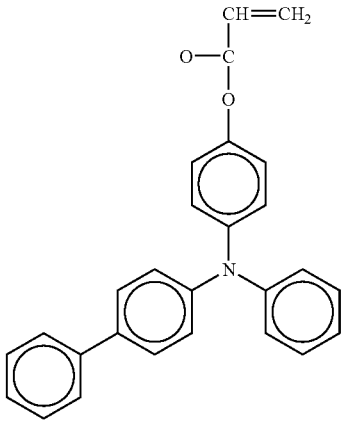

-continued
No. 21
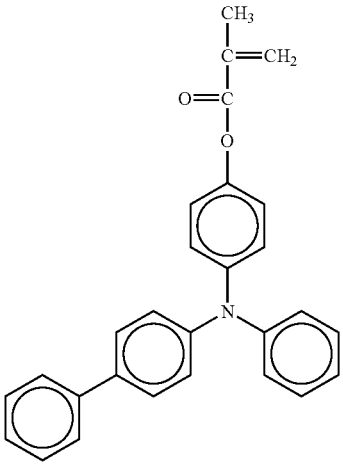
No. 22
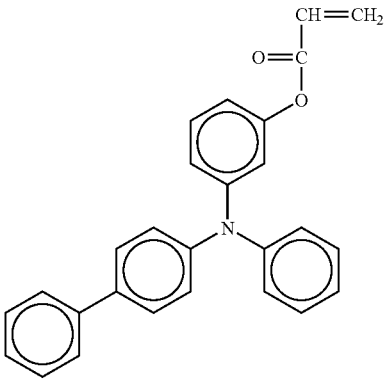
No. 23
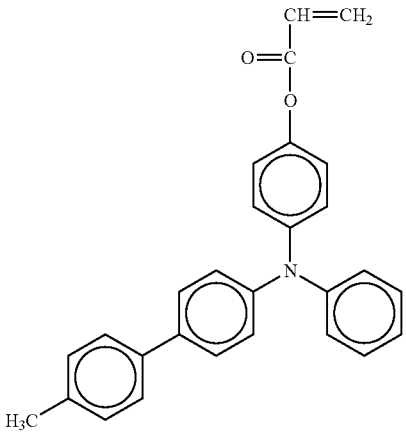
-continued
No. 24
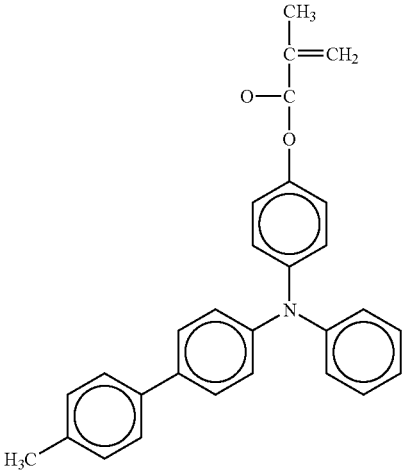
No. 25
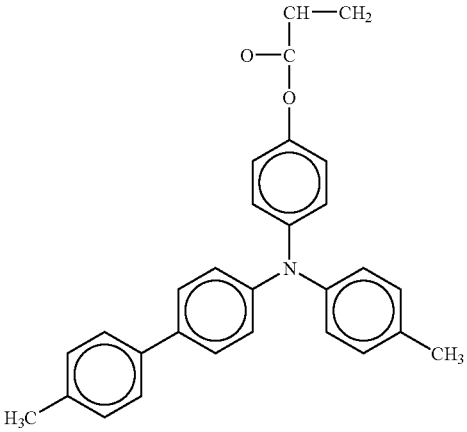
No. 26
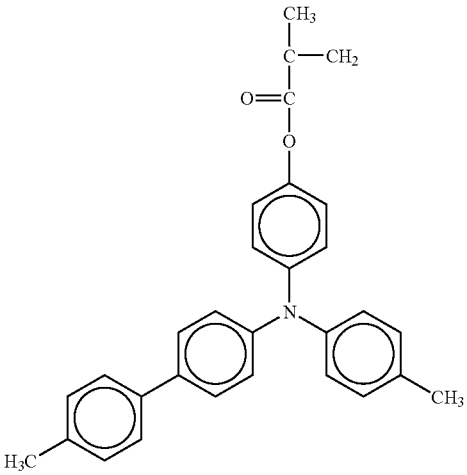

-continued
No. 27
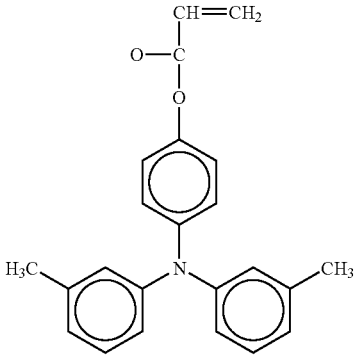
No. 28
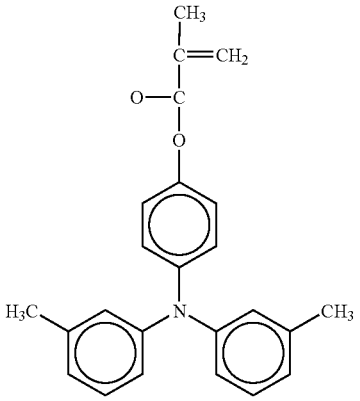
No. 29
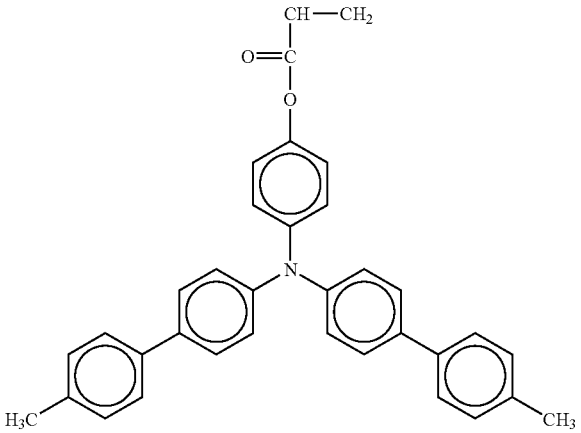
No. 30
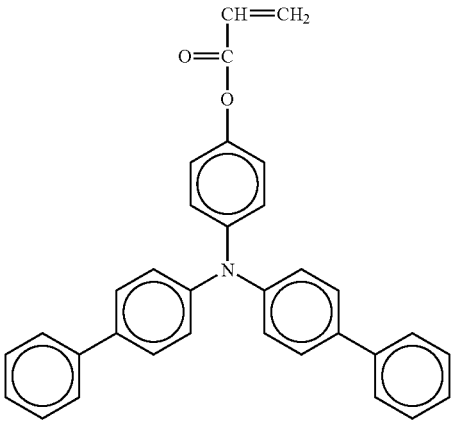
-continued
No. 31
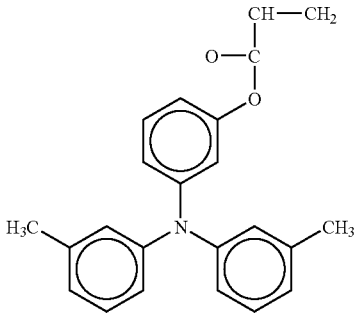
No. 32
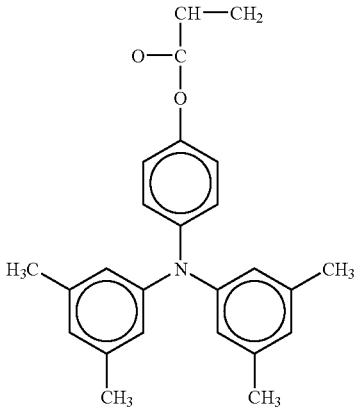
Chemical formula 24
No. 33
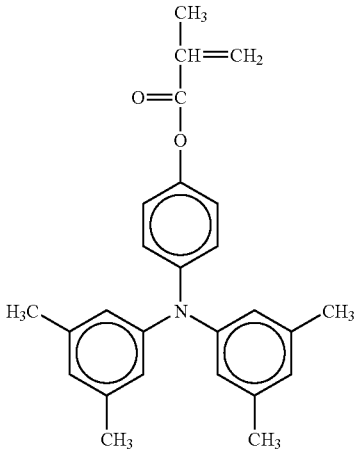
No. 34
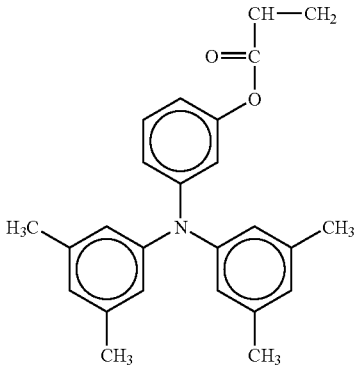

-continued
No. 35
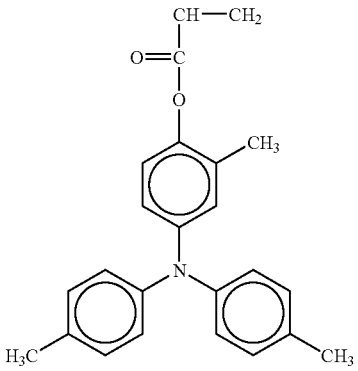
No. 36
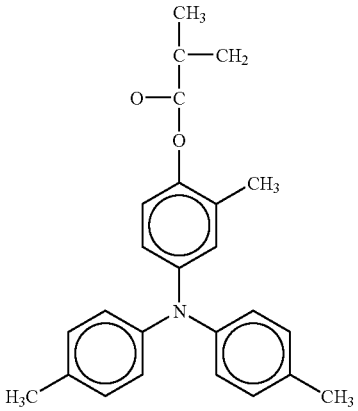
No. 37
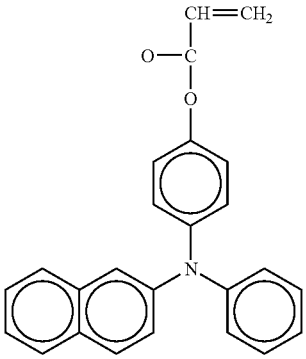
No. 38
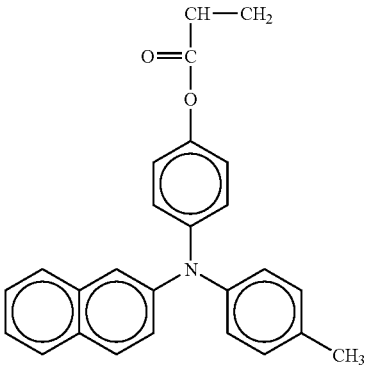
-continued
No. 39
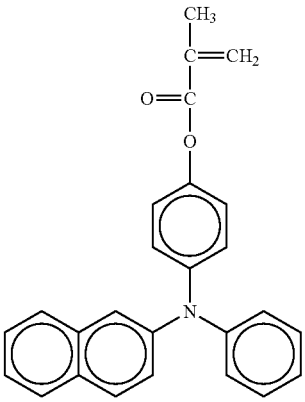
No. 40
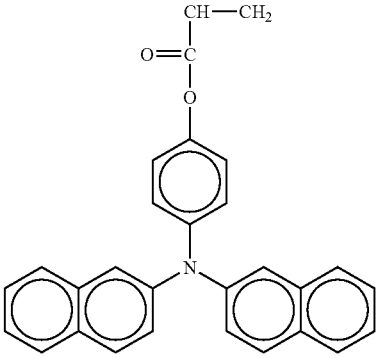
No. 41
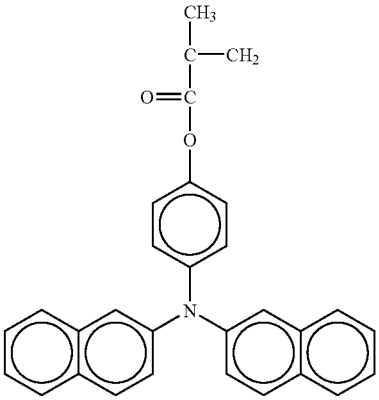

-continued
No. 42
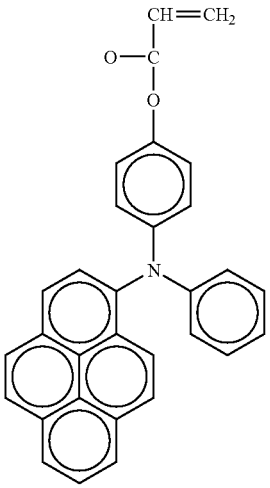
No. 43
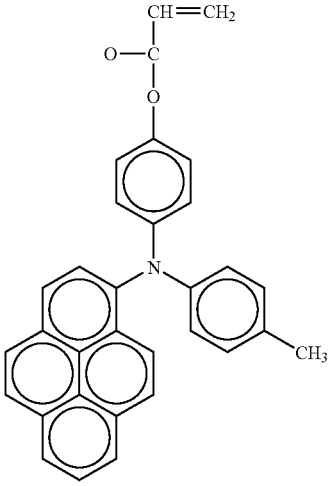
No. 44
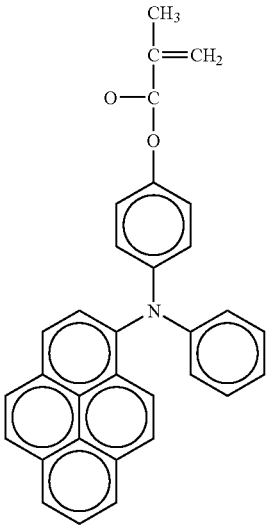
-continued
No. 45
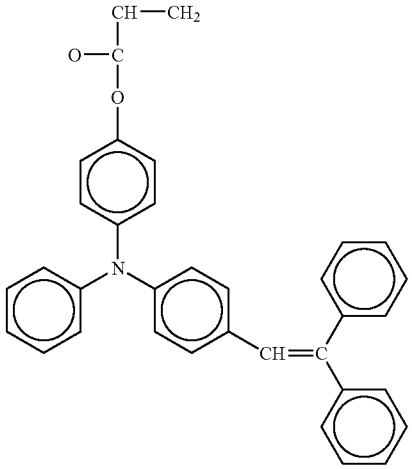
No. 46
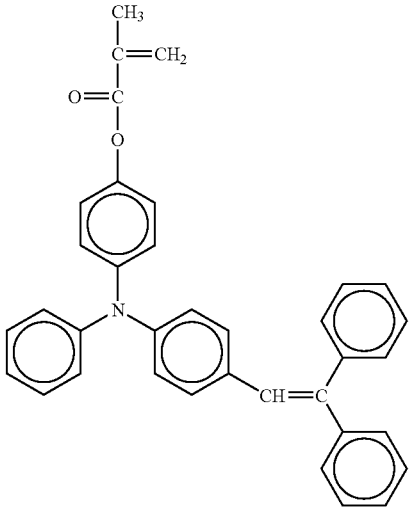
No. 47
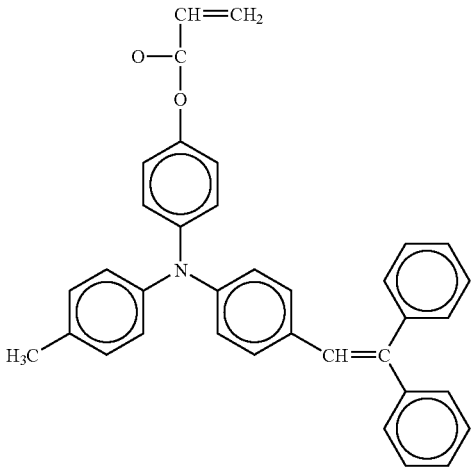

-continued
No. 48
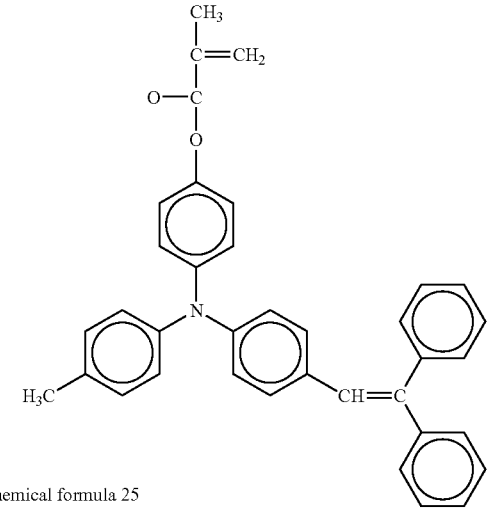
Chemical formula 25
No. 49
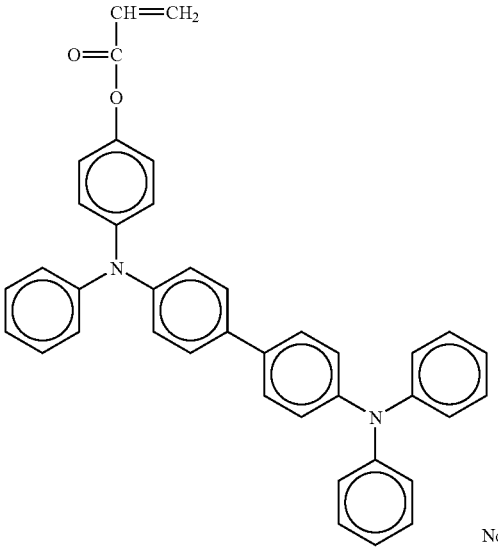
No. 50
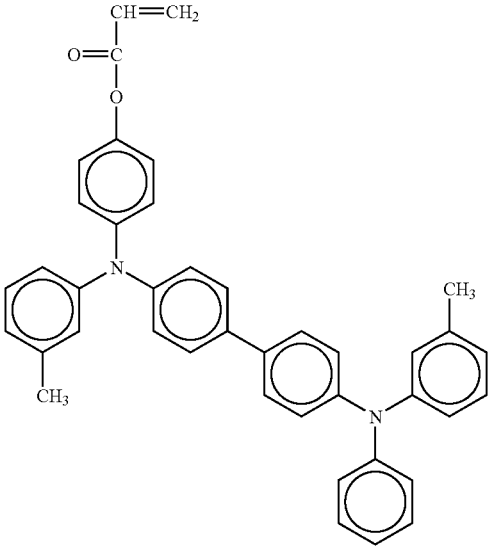
-continued
No. 51
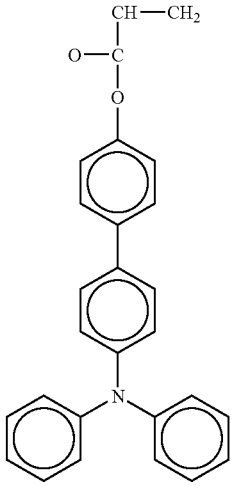
No. 52
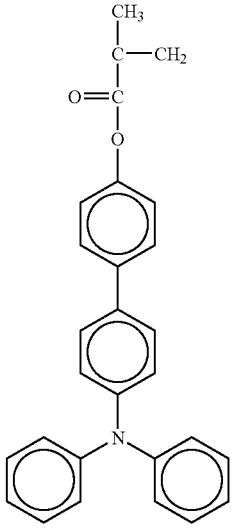
No. 53
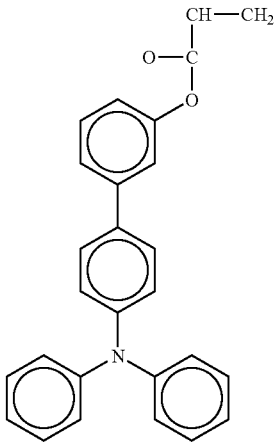

-continued
No. 54
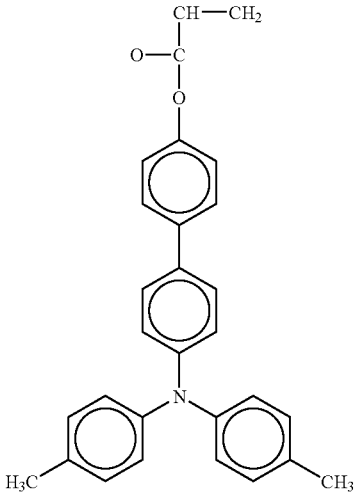
No. 55
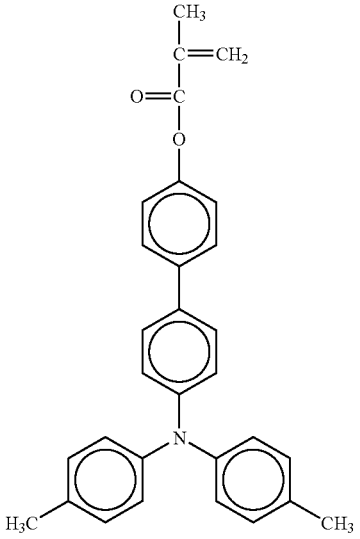
No. 56
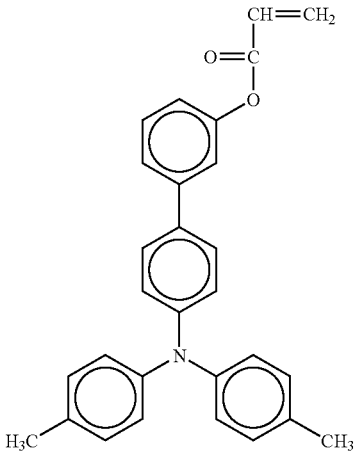
-continued
No. 57
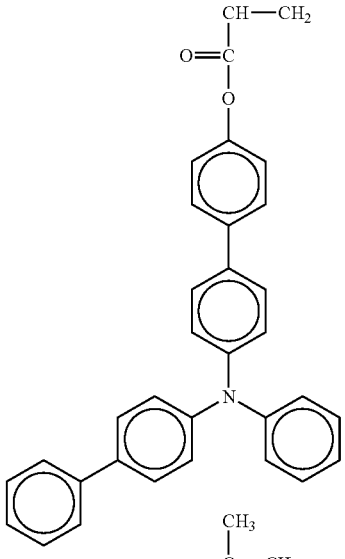
No. 58
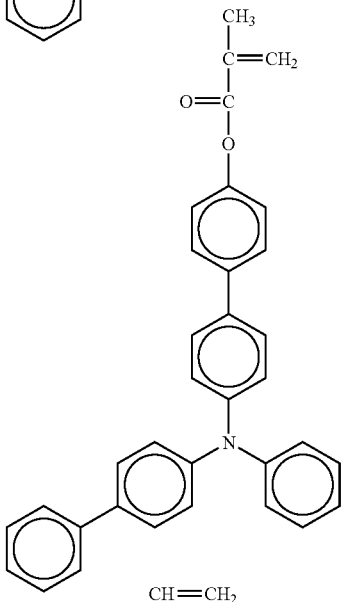
No. 59
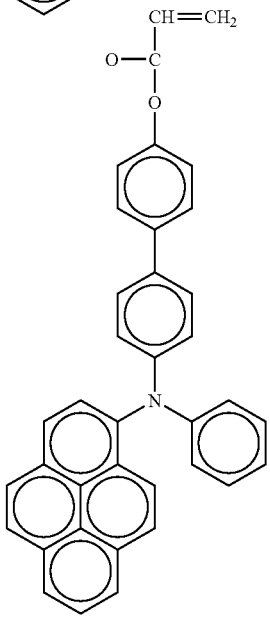

-continued
No. 60
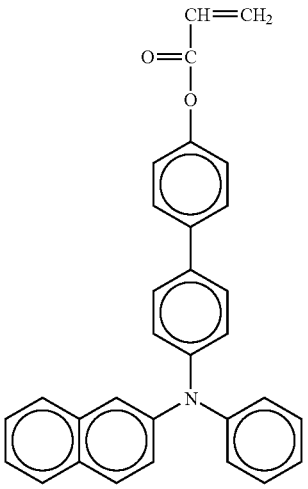
Chemical formula 26
No. 61
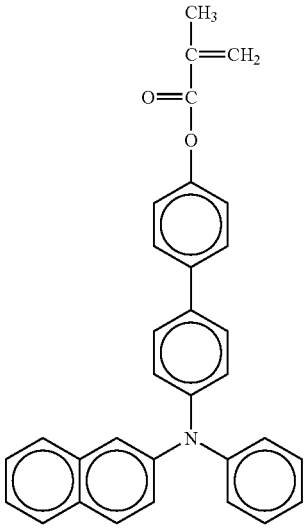
No. 62
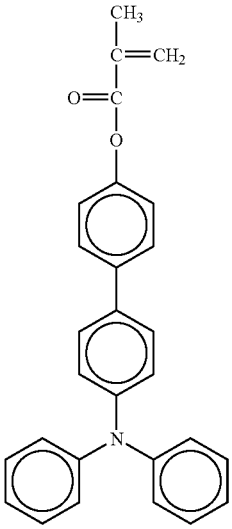
-continued
No. 63
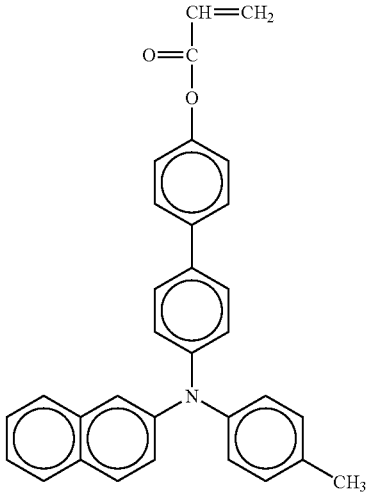
No. 64
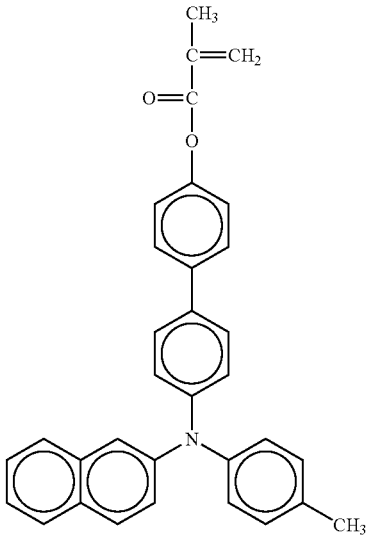
No. 65
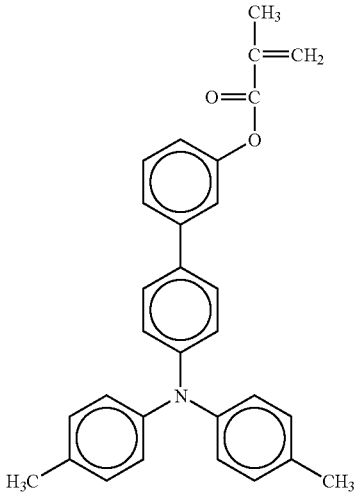

-continued
No. 66
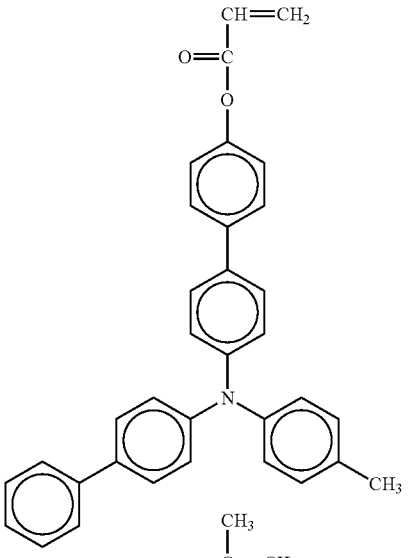
No. 67
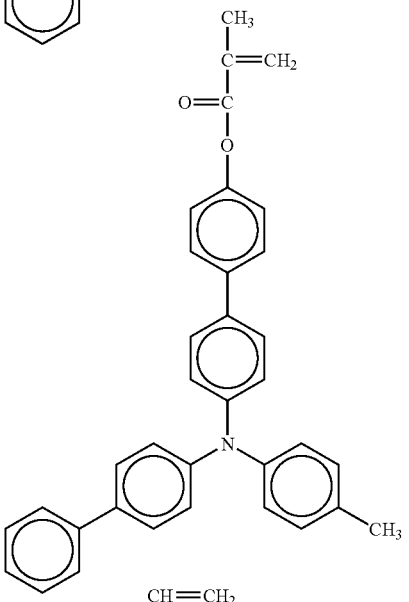
No. 68
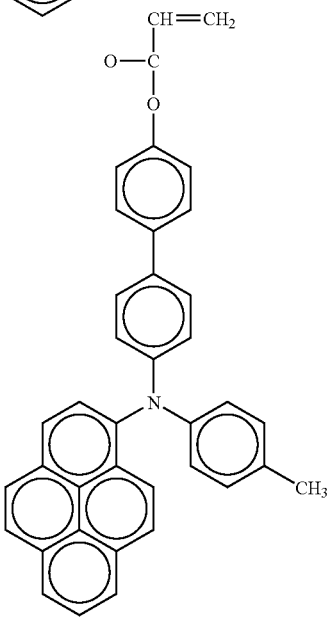
-continued
No. 69
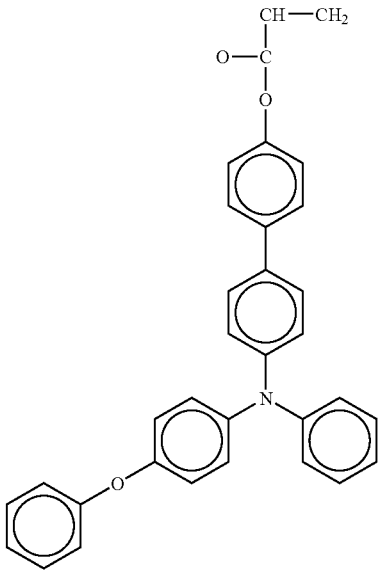
No. 70
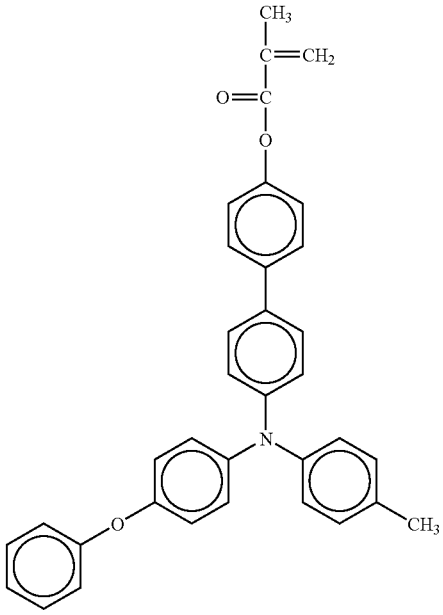

-continued
No. 71
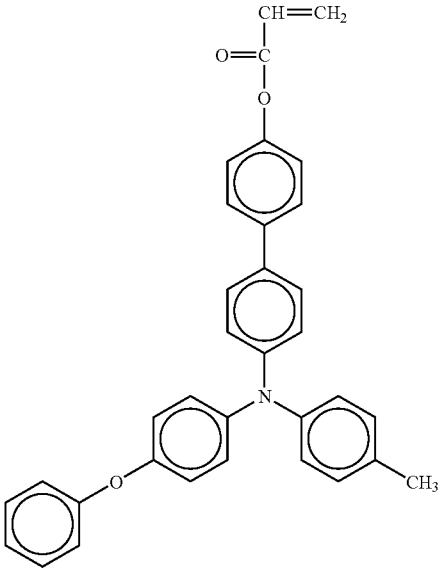
No. 72
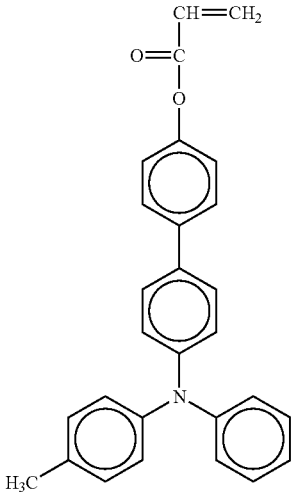
Chemical formula 27
No. 73
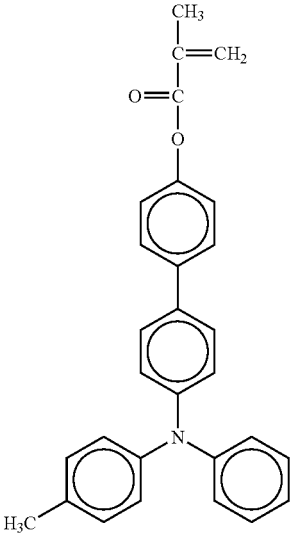
-continued
No. 74
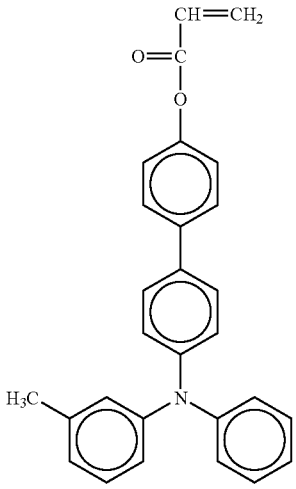
No. 75
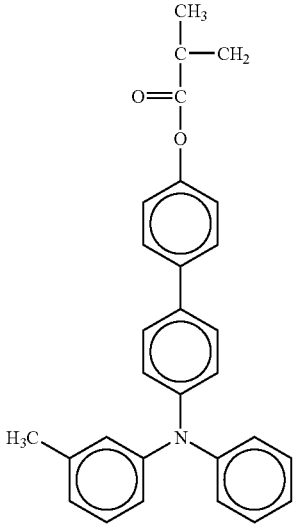
No. 76
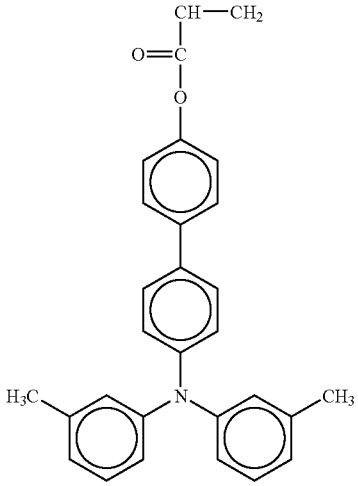

-continued
No. 77
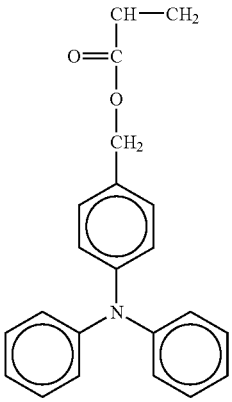
No. 78
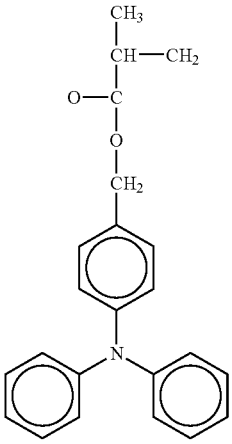
No. 79
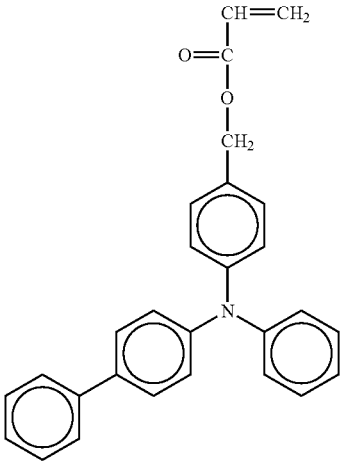
-continued
No. 80
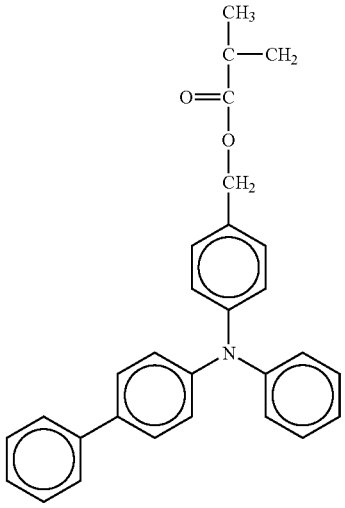
No. 81
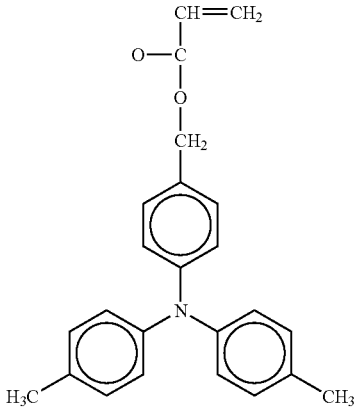
No. 82
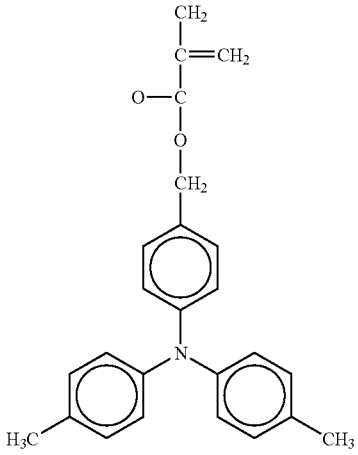

-continued
No. 83
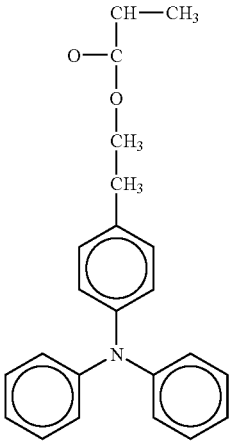
No. 84
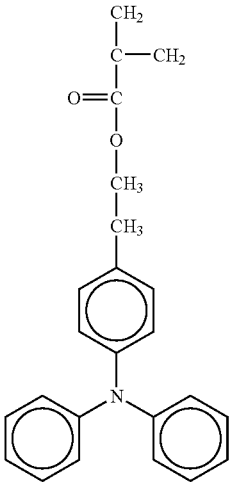
No. 85
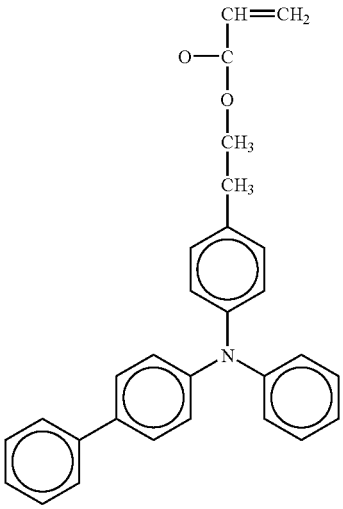
-continued
No. 86
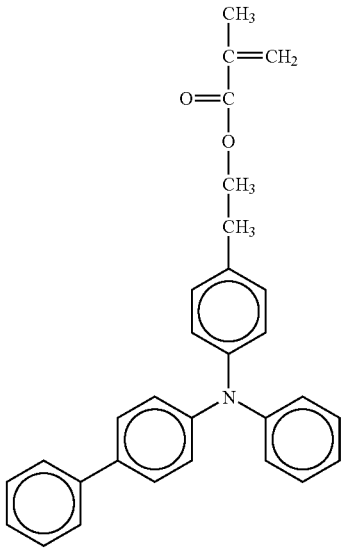
No. 87
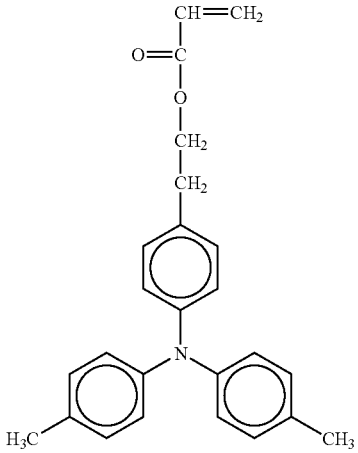
No. 88
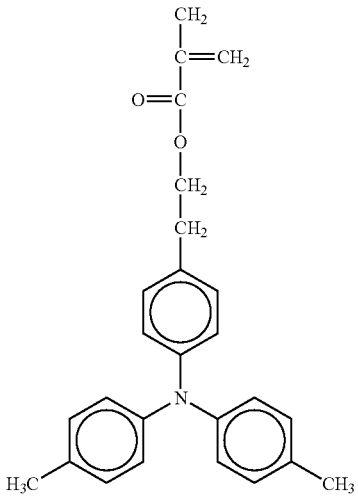

-continued
Chemical formula 28
No. 89
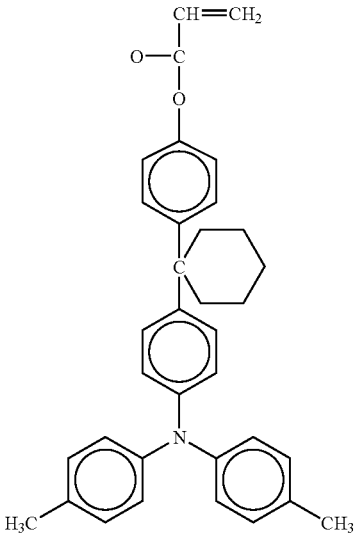
No. 90
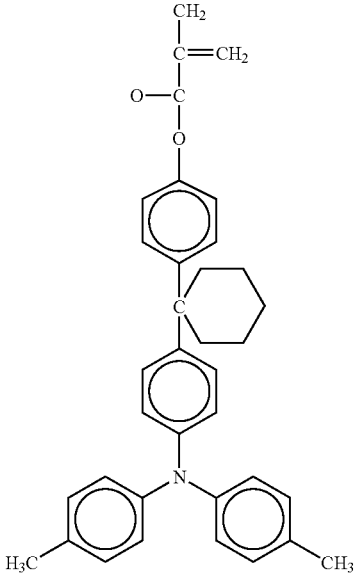
-continued
No. 91
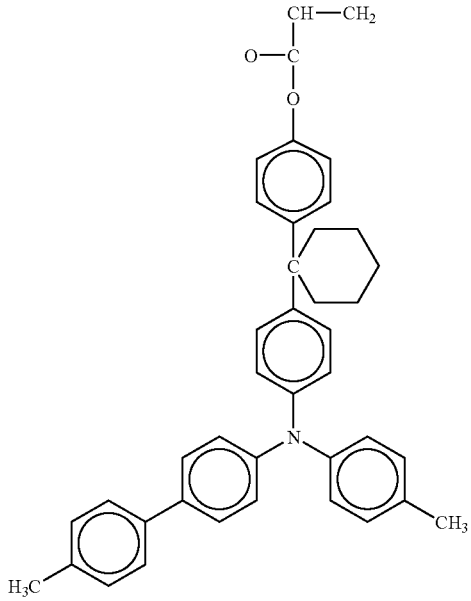
No. 92
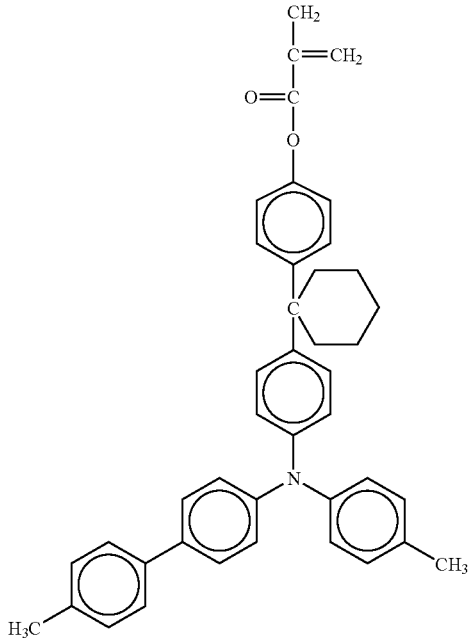

-continued
No. 93
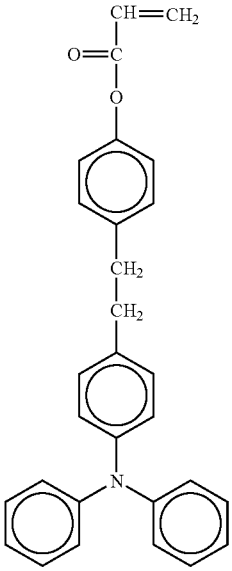
No. 94
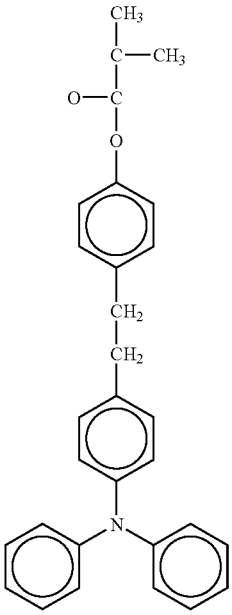
-continued
No. 95
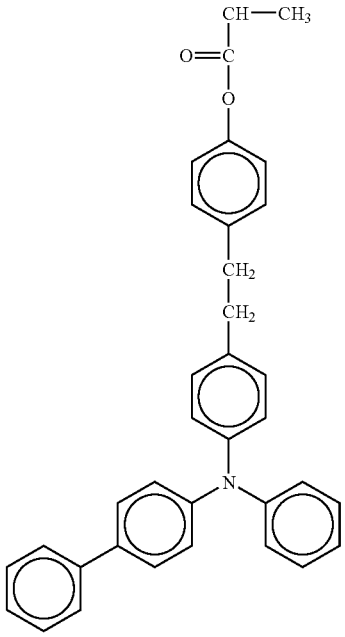
No. 96
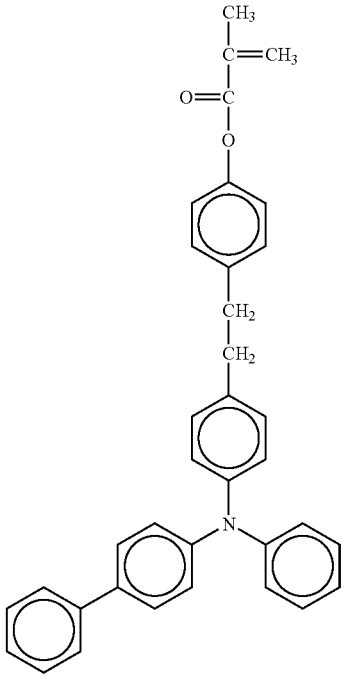

-continued
No. 97
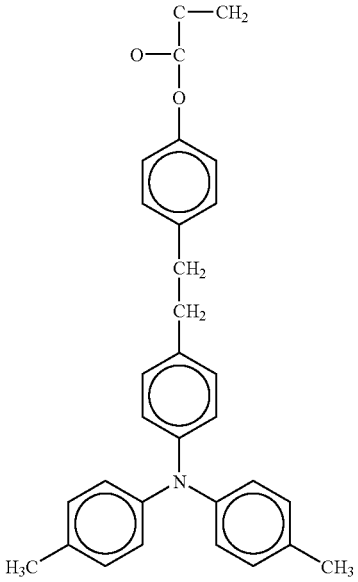
No. 98
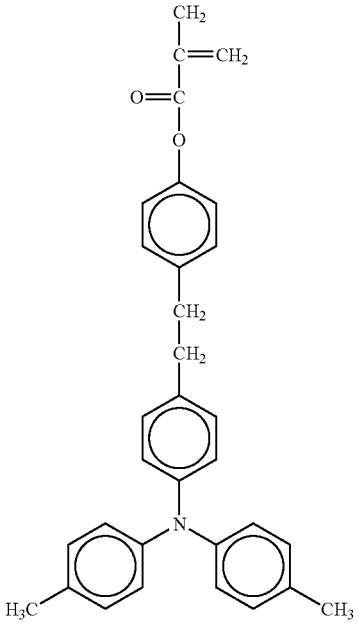
-continued
No. 99
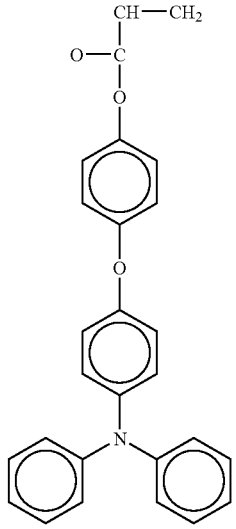
No. 100
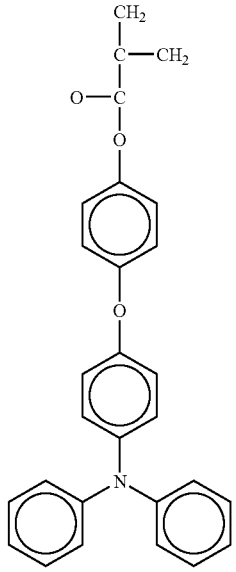

-continued
Chemical formula 29
No. 101
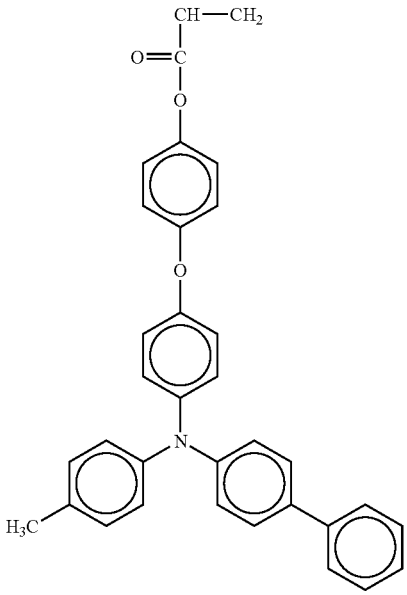
No. 102
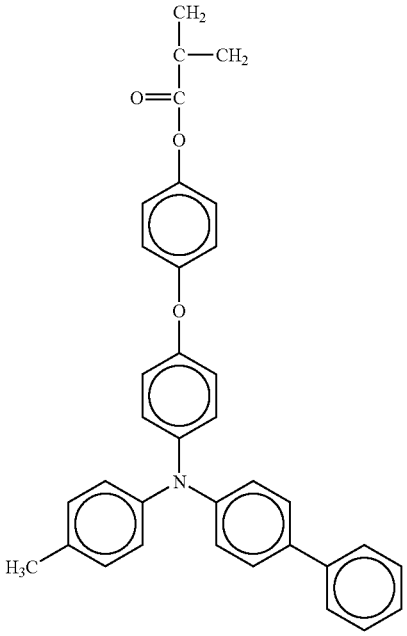
-continued
No. 103
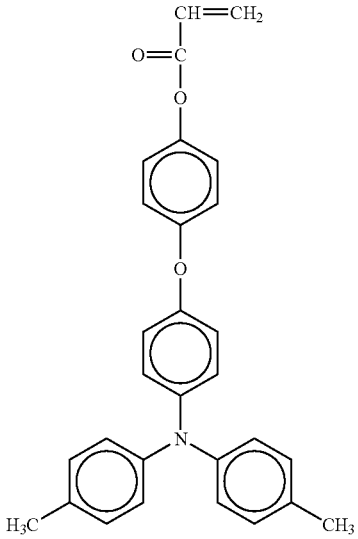
No. 104
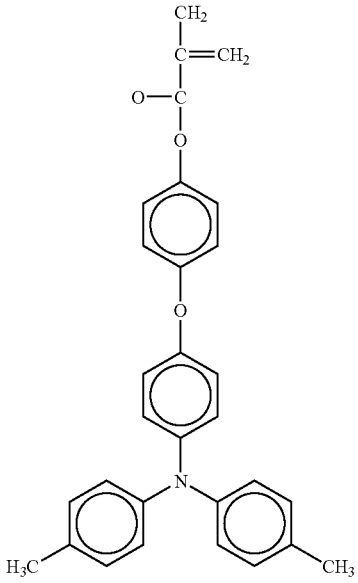

-continued
No. 105
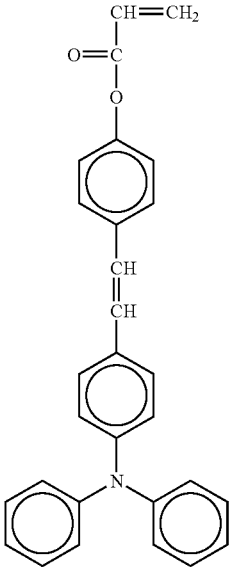
No. 106
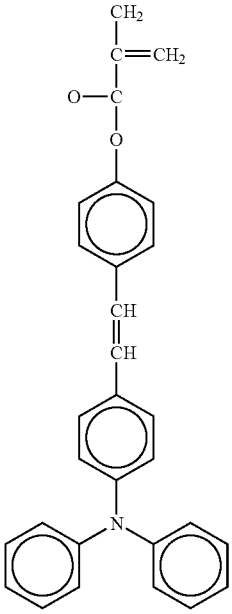
-continued
No. 107
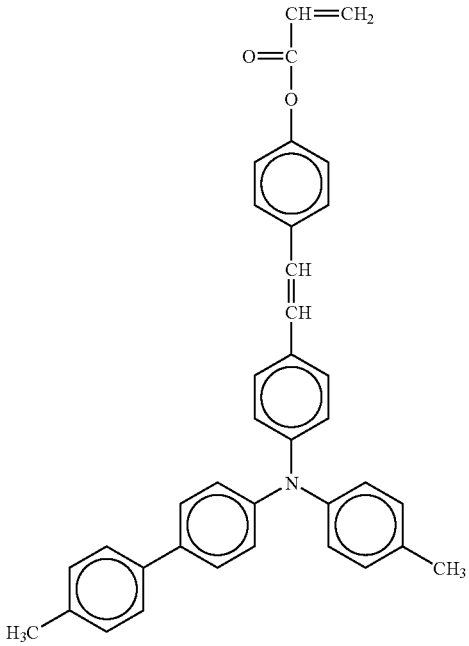
No. 108
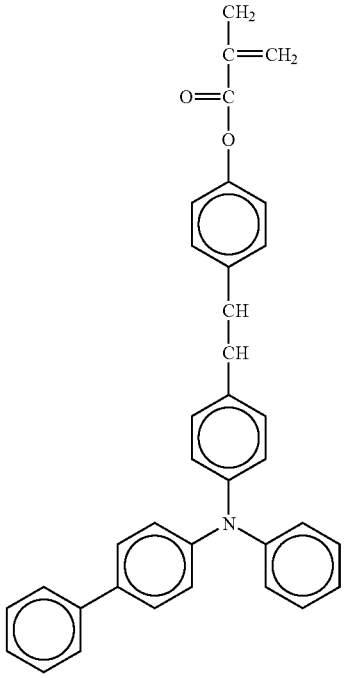

-continued
No. 109
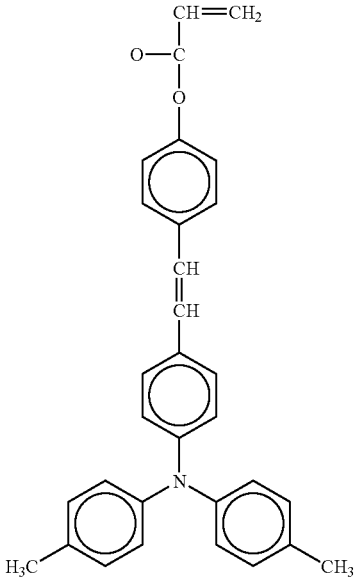
No. 110
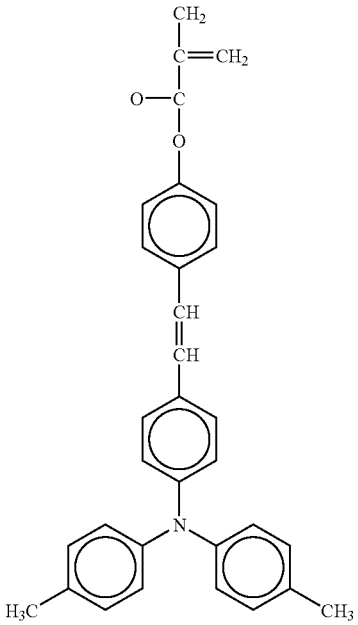
-continued
No. 111
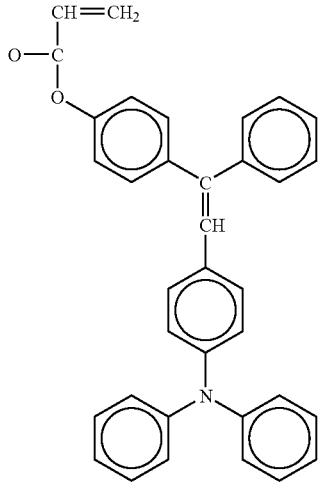
No. 112
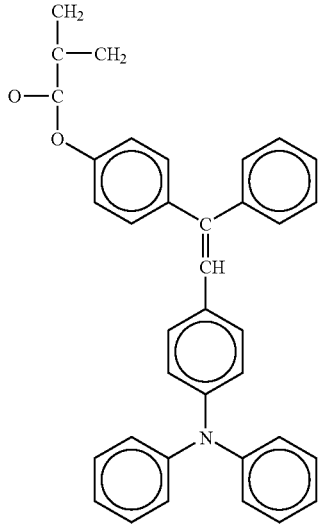
Chemical formula 30
No. 113
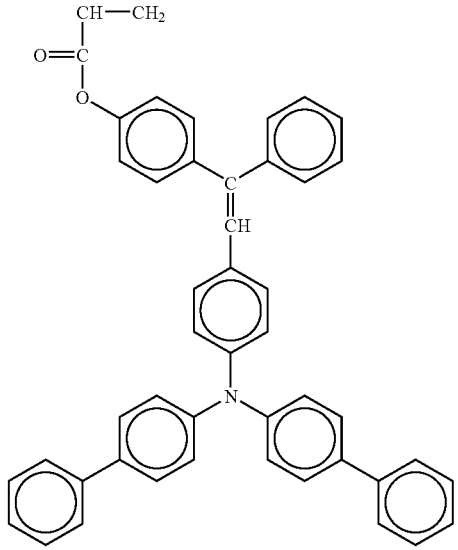

-continued
No. 113
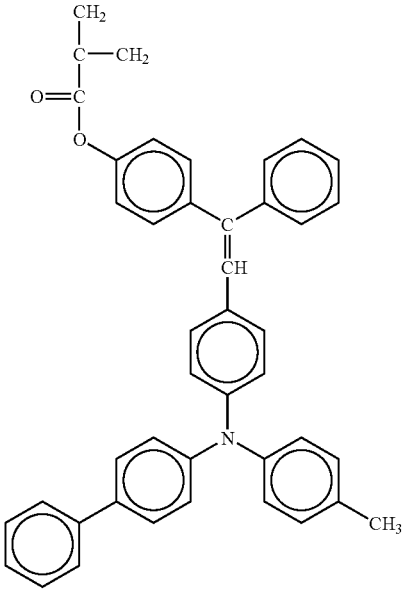
No. 115
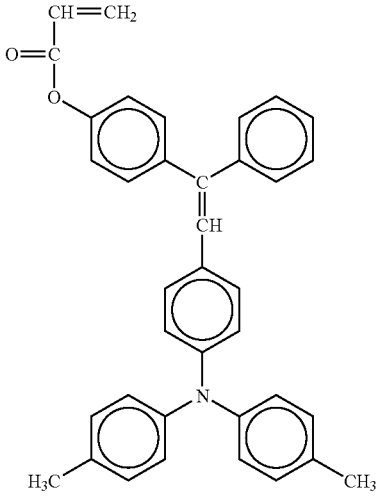
No. 116
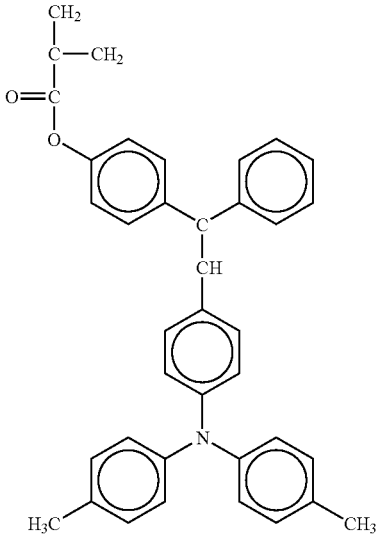
-continued
No. 117
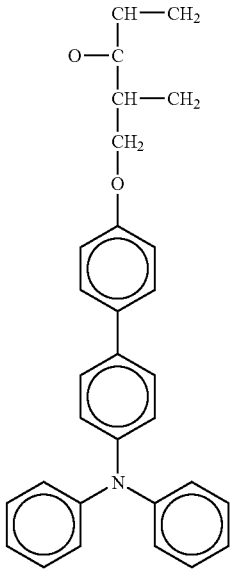
No. 118
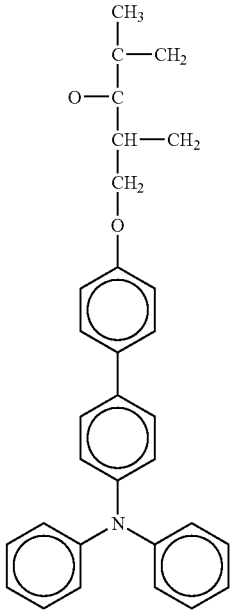

-continued
No. 119
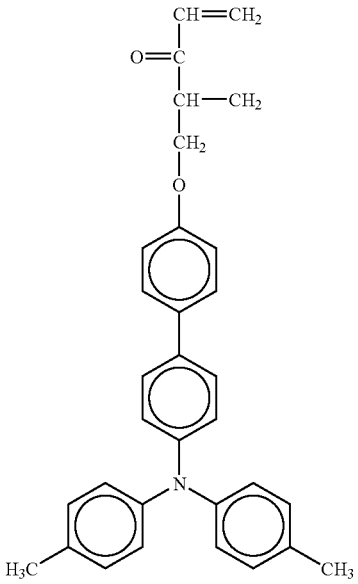
-continued
No. 121
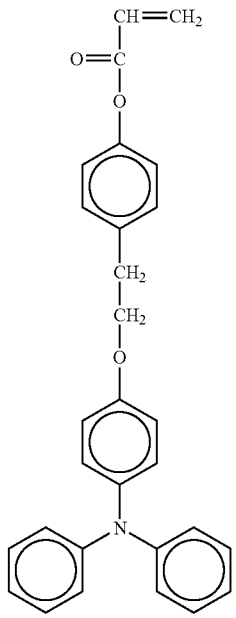
No. 120
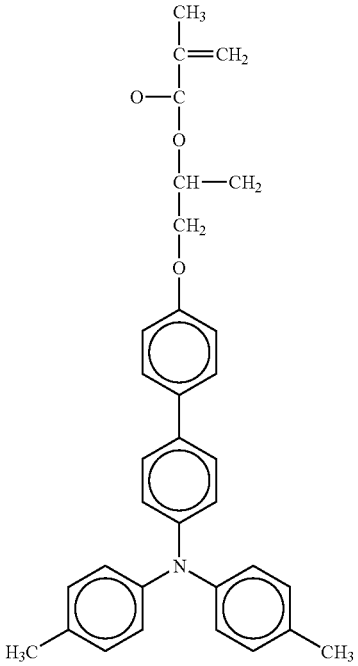
No. 122
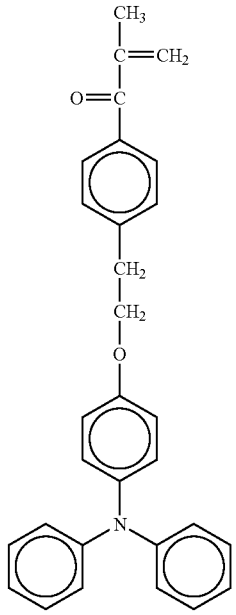

-continued
No. 123
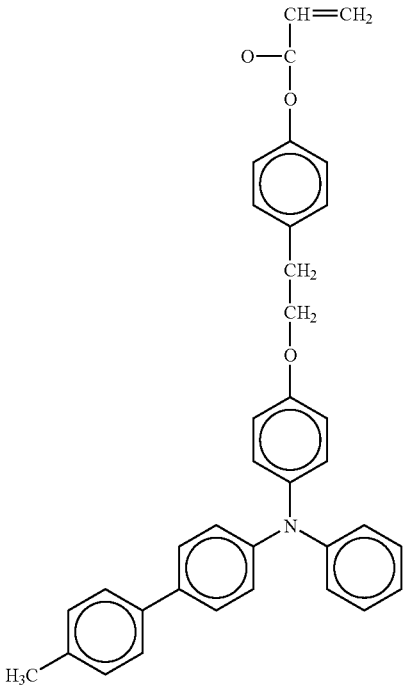
No. 124
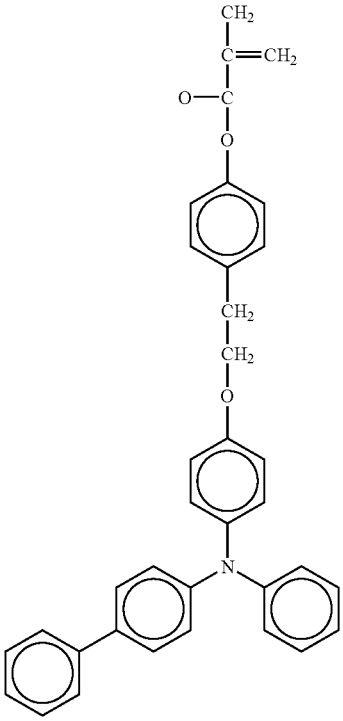
-continued
Chemical formula 31
No. 125
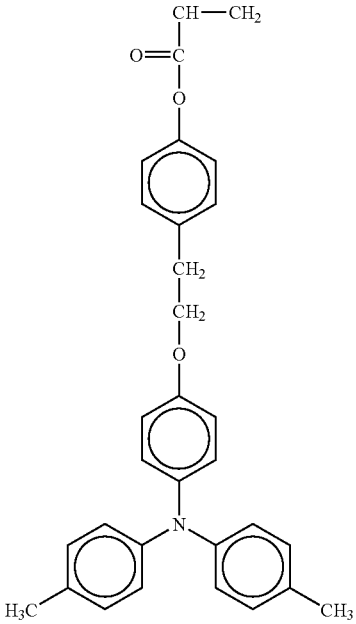
No. 126
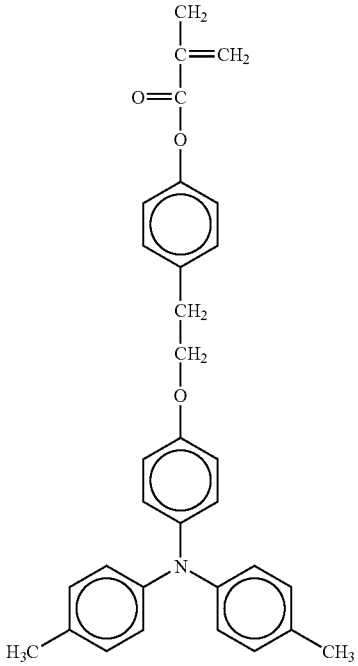

-continued
No. 127
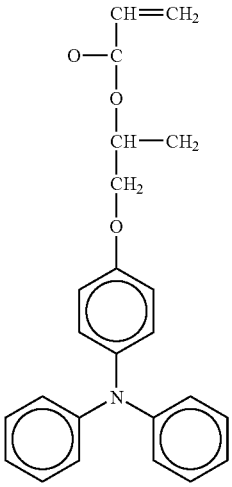
No. 128
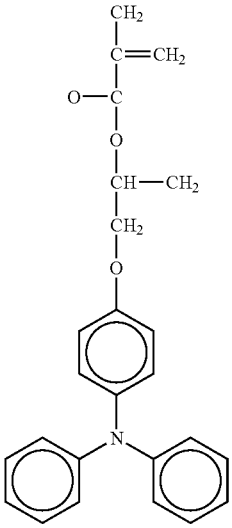
No. 129
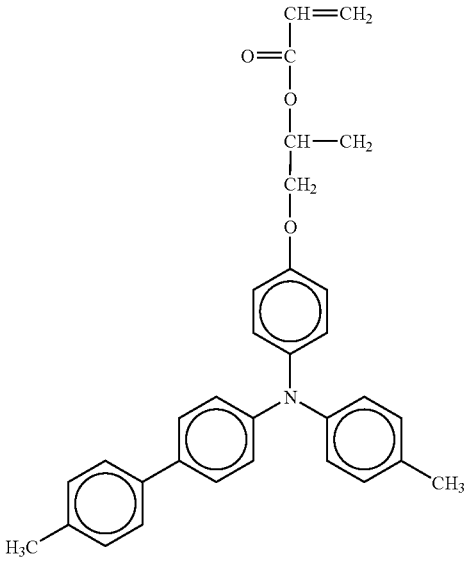
-continued
No. 130
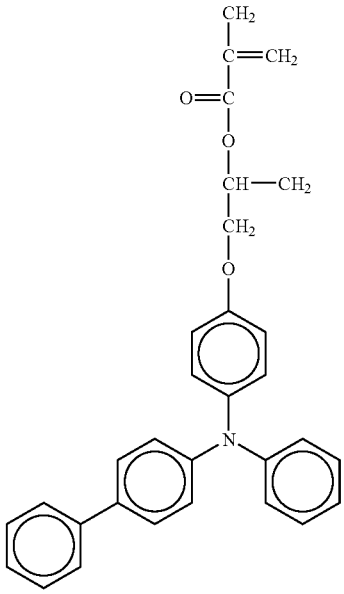
No. 131
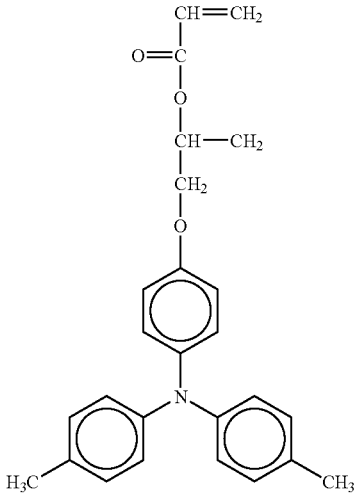
No. 132
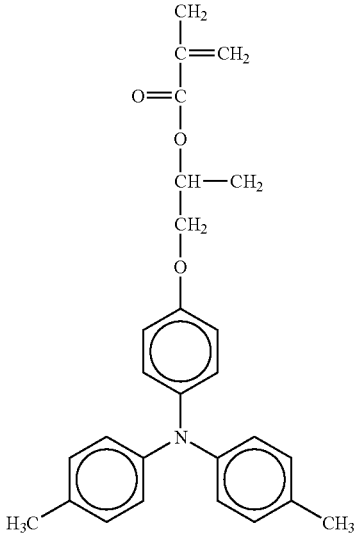

-continued
No. 133
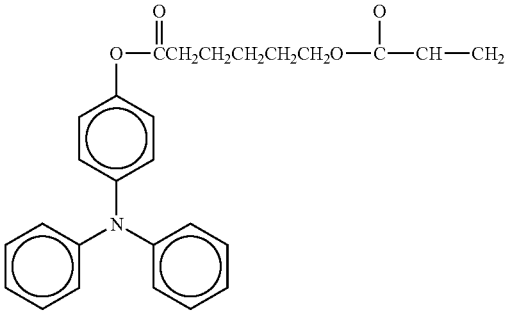
No. 134
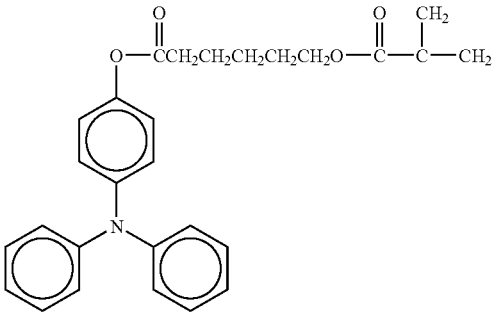
No. 135
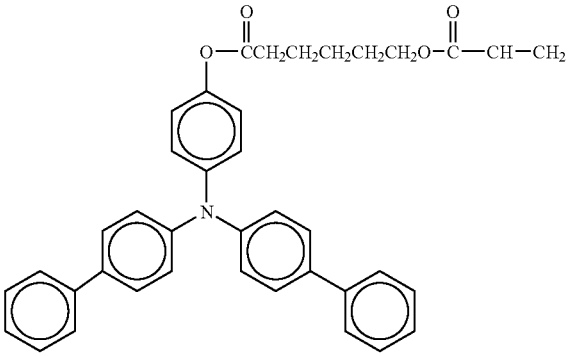
No. 136
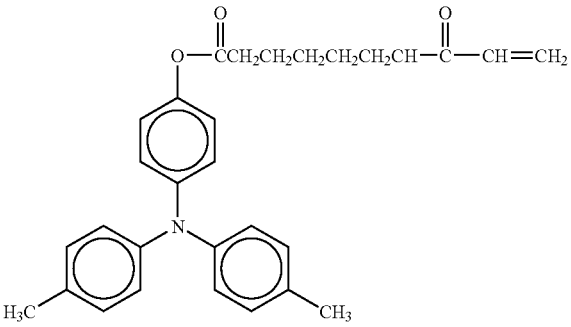
-continued
Chemical formula 32
No. 137
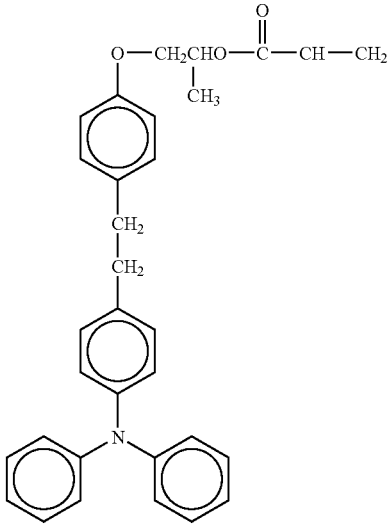
No. 138
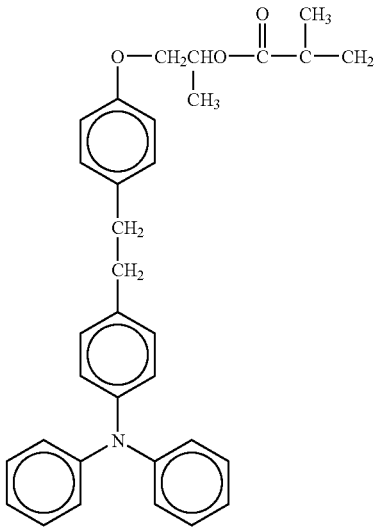

-continued
No. 139
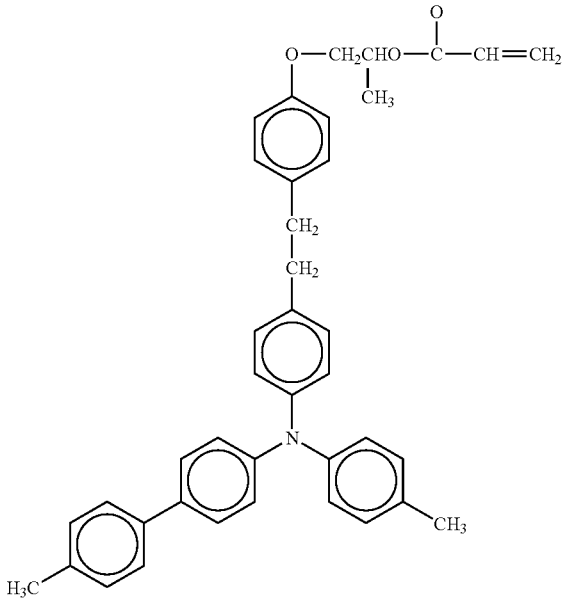
No. 140
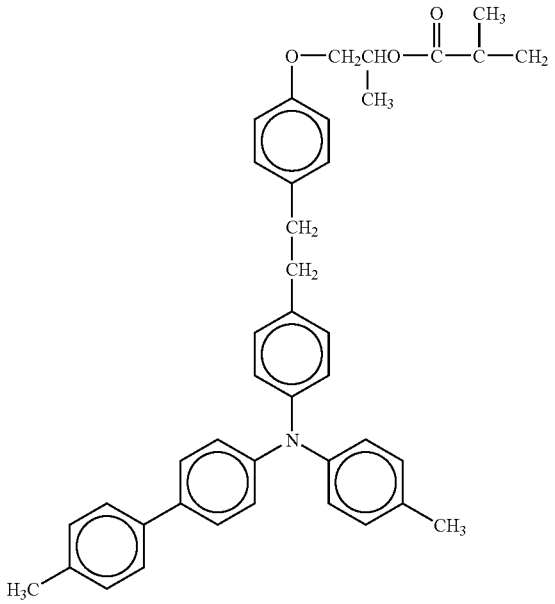
-continued
No. 141
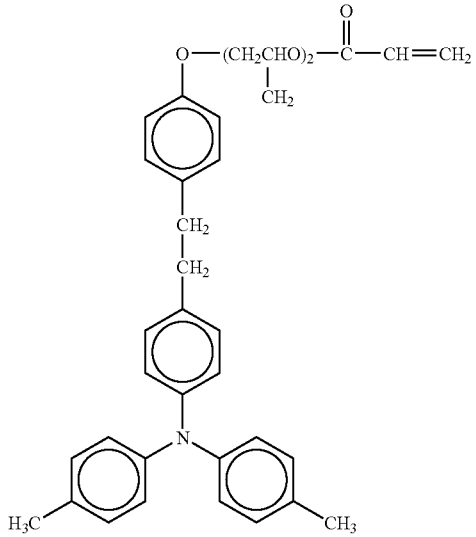
No. 142
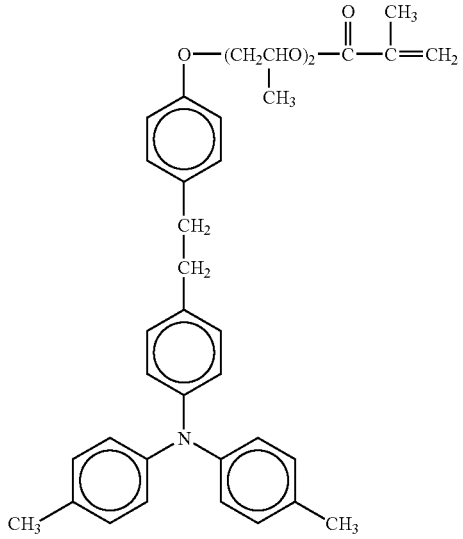
No. 143
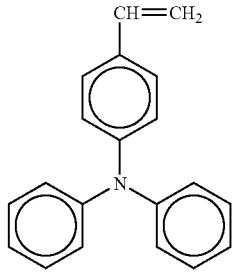

-continued
No. 144
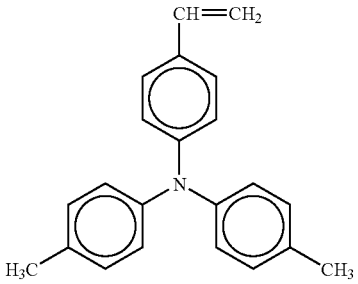
No. 145
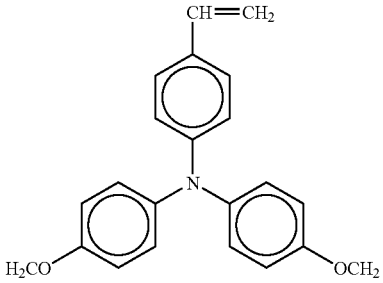
No. 146
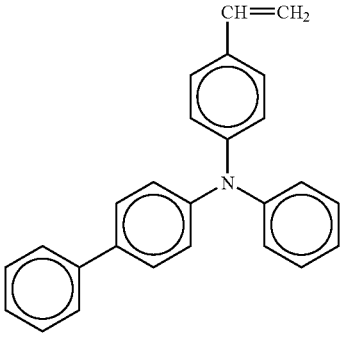
No. 147
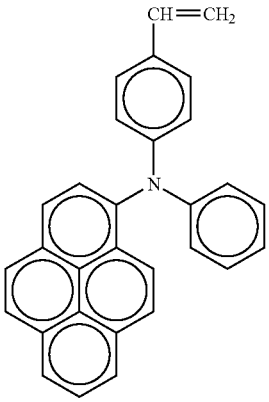
No. 148
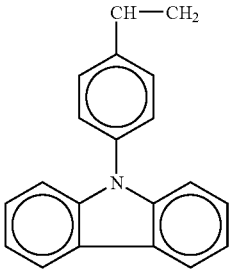
-continued
No. 149
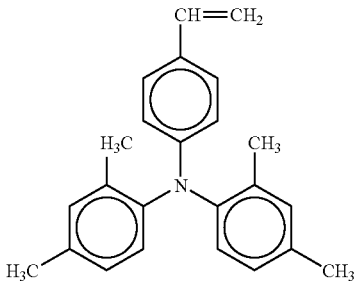
Chemical formula 33
No. 150
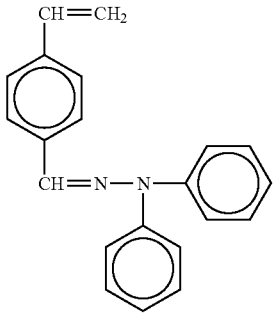
No. 151
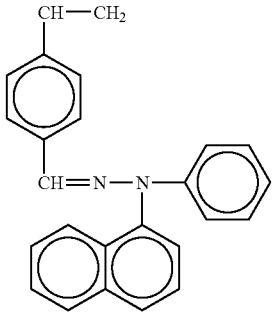
No. 152
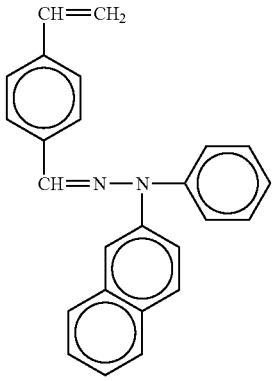
No. 153
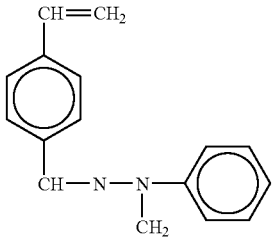

-continued

No. 154

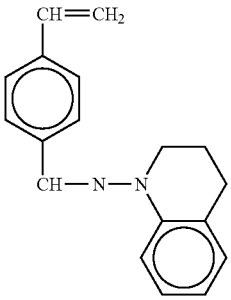

No. 155

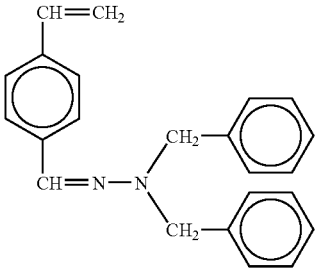

No. 156

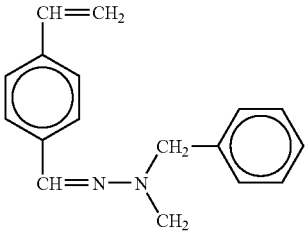

No. 157

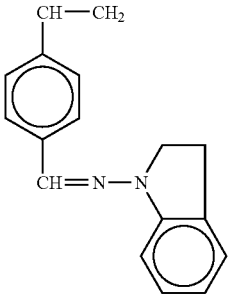

No. 158

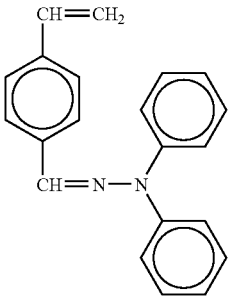

-continued

No. 159

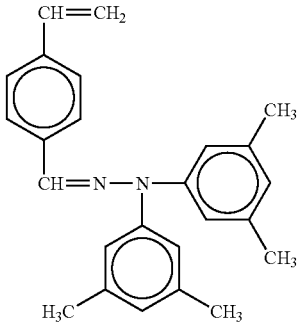

No. 160

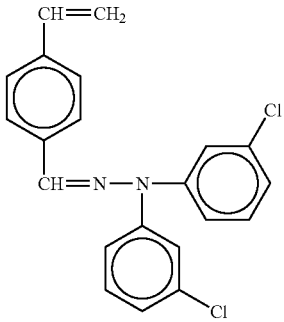

In addition, the radical polymeric compound having a functional group with a charge transport structure for use in the present invention is important to impart the charge transport ability of a cross-linking type protective layer having a charge transport structure. The content ratio of the radical polymeric compound having a functional group with a charge transport structure is from 20 to 80% by weight and preferably from 30 to 70% by weight based on a cross-linking type protective layer a cross-linking type protective layer having a charge transport structure. When the content ratio is too small, the charge transport ability of a cross-linking type protective layer a cross-linking type protective layer having a charge transport structure is not sufficient, which may lead to deterioration of the electric characteristics such as sensitivity and rise in the residual voltage. When the content ratio is too large, the content of a radical polymeric monomer having at least 3 functional groups without having a charge transport structure decreases so that the density of cross-linking decreases and the anti-abrasion property may deteriorate. Desired electric characteristics and anti-abrasion property vary depending on the process and thus the layer thickness of the cross-linking type protective layer a cross-linking type protective layer having a charge transport structure for use in the present invention varies. Therefore, it is difficult to jump to any conclusion but considering the balance of the electric characteristics and the anti-abrasion property, the range of from 30 to 70% by weight is preferred.

As described above, the cross linking type protective layer having a charge transport structure is formed by curing a radical polymeric monomer having three functional groups without having a charge transport structure and a radical polymeric compound having a functional group and a charge transport structure. In addition, a radical polymeric monomer having one or two functional groups, a functional monomer and a radical polymeric oligomer can be used in combination therewith to control the viscosity during coating, relax the internal stress within a cross linking type protective layer having a charge transport structure, reduce the surface energy, decrease the friction index, etc. Known radical polymeric monomers and oligomers can be used.

Specific examples of such radical polymeric monomers having a functional group include 2-ethyl hexyl acrylate, 2-hydroxy ethyl acrylate, 2-hydroxy propyl acrylate, tetrahydroflu frylacrylate, 2-ethylhexyl carbitol acrylate, 3-methoxy butyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and a styrene monomer.

Specific examples of the radical polymeric divalent functional groups include 1,3-butane diol acrylate, 1,4-butane diol acrylate, 1,4-butane diol dimethacrylate, 1,6-hexane diol diacrylate, 1,6-hexane diol dimethaacrylate, diethylene glycol diacrylate, neopentyl glycol diacrylate, bisphenol A-EO modified diacrylate, bisphenol F-EO modified diacrylate, and neopentyl glycol diacrylate.

Specific examples of such functional monomers include a substitution product of, for example, octafluoro pentyl acrylate, 2-perfluoro octyl ethyl acrylate, 2-perfluoro octyl ethyl methacrylate, and 2-perfluoroisononyl ethyl acrylate, in which a fluorine atom is substituted; a siloxane repeating unit described in examined published Japanese Patent Applications Nos. (hereinafter referred to as JPP) H05-60503 and H06-45770; and a vinyl monomer, an acrylate or a methacrylate having a polysiloxane group such as acryloyl polydimethyl siloxane ethyl, methacryloyl polydimethyl siloxane ethyl, acryloyl polydimethyl siloxane propyl, acryloyl polydimethyl siloxane butyl, and diacryloyl polydimethyl siloxane diethyl.

Specific examples of the radical oligomers include an epoxy acrylate based oligomer, a urethane acrylate based oligomer, and a polyester acrylate based oligomer.

However, too excessive an amount of a radical polymeric monomer having one or two functional groups and a radical polymeric oligomer substantially decreases the density of three-dimensional cross-linking in a cross-linking type polymeric protective layer, which leads to deterioration of the anti-abrasion property thereof. Therefore, the content of these monomer and oligomer is not greater than 50 parts and preferably not greater than 30 parts based on 100 parts of a radical polymeric monomer having at least three functional groups.

In addition, the liquid of application coated to form a cross-linking type protective layer having a charge transport structure can optionally contain a polymerization initiator to accelerate the curing reaction of a radical polymeric monomer having at least three functional groups without having a charge transport structure and a radical polymeric compound having a functional group and a charge transport structure.

Specific examples of thermal polymerization initiators include a peroxide based initiator such as 2,5-dimethyl hexane-2,5-dihydroperoxide, dicumyl peroxide, benzoyl peroxide, t-butylcumyl peroxide, 2,5-dimethyl-2,5-di (peroxybenzoyl) hexine-3, di-t-butyl beroxide, t-butylhydro beroxide, cumenehydro beroxide, lauroyl peroxide, and 2,2-bis(4,4-di-t-butylperoxy cyclohexane)propane, and an azo based initiator such as azobis isobutyl nitrile, azobis cyalohexane carbonitrile, azobis iso methyl butyric acid, azobis isobutyl amidine hydrochloride, and 4,4'-azobis-4-cyano valeric acid.

Specific examples of photopolymerization initiators include an acetophenon based or ketal based photopolymerization initiators such as diethoxy acetophenone, 2,2-dimethoxy-1,2-diphenyl ethane-1-on, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1, 2-hydroxy-2-methyl-1-phneyl propane-1-on, and 1-phenyl-1,2-propanedion-2-(o-ethoxycarbonyl)oxime; a benzoine ether based photopolymerization initiator such as benzoine, benzoine methyl ether, benzoine ethyl ether, benzoine isobutyl ether, and benzoine isopropyl ether; a benzophenone based photopolymerization initiator such as benzophenone, 4-hydroxy benzophenone, o-benzoyl methyl benzoate, 2-benzoyl naphthalene, 4-benzoyl biphenyl, 4-benzoyl phenyl ether, acrylizes benzophenone and 1,4-benzoyl benzene; a thioxanthone based photopolymerization initiator such as 2-isopropyl thioxanthone, 2-chlorothioxanthone, 2,4-dimethyl thioxanthone, 2,4-diethyl thioxanthone, and 2,4-dichloro thioxanthone; and other photopolymerization initiators such as ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxybenzoyl)-2,4,4-trimethyl pentyl phosphine oxide, a methylphenyl glyoxy ester, 9,10-phenanthrene, an acridine based compound, a triadine based compound and an imidazole based compound. In addition, a compound having an acceleration effect on photopolymerization can be used alone or in combination with the photopolymerization initiator. Specific examples of such compounds include triethanol amine, methyl diethanol amine, 4-dimethyl amino ethyl benzoate, 4-dimethyl amino isoamyl benzoate, ethyl benzoate (2-dimethyl amino), and 4,4'-dimethyl amino benzophenone.

These polymerization initiators can be used alone or in combination. The content of such a polymerization initiator is 0.5 to 40 parts by weight and preferably from 1 to 20 parts by weight based on 100 parts by weight of the compound having a radical polymerization property.

Further, the liquid of application for use in forming the cross linking type protective layer having a charge transport structure include can optionally contain additives such as various kinds of plasticizers (for relaxing stress and improving adhesiveness), a leveling agent, a charge transport material having a low molecular weight having no radical reaction property. Known additives can be used as these additives. As a plasticizer, an additive, such as dibutylphthalate and dioctyl phthalate, which is used in a typical resin can be used. The content thereof is not greater than 20% by weight and preferably not greater than 10% based on the total solid portion of a liquid of application. As a leveling agent, silicone oils such as dimethyl cilicone oil, methyl phenyl silicone oil and a polymer or an oligomer having a perfluoroalkyl group in its side chain can be used. The content thereof is suitably not greater than 3% by weight based on the total solid portion of a liquid of application.

The cross linking type protective layer having a charge transport structure is formed by coating and curing on the charge transport layer mentioned above at least a radical polymeric monomer having three functional groups without having a charge transport structure and a radical polymeric compound having a functional group and a charge transport structure. When a radical polymeric monomer contained in a liquid of application is liquid, it is possible to coat the liquid of application while dissolving other components therein. In addition, a liquid of application can be diluted in a suitable solvent before coating if desired. Specific examples of such solvents include an alcohol based solvent such as methanol, ethanol, propanol and butanol; a ketone based solvent such as acetone, methyl ethyl ketone, methyl isobutyl ketone, and cycle hexanone; an ester based solvent such as ethyl acetate and butyl acetate; an ether based solution such as tetrahydrofuranm dioxane and propyl ether; a halogen based solvent such as dichloromethane, dichloroethane, trichloroethane and chlorobenzene; an aromatic series based solvent such as benzene, toluene and xylene; and a cellosolve based solvent such as methyl cellosolve, ethyl cellosove and cellosolve acetate. These solvents can be used alone or in combination. The dilution ratio by such a solvent depends on solubility, a coating method, and a layer thickness of a composition suitable for desires purposes. A dip coating method, a spray coating method, a beat coating method, a ring coating method, etc., can be used for application.

In the present invention, subsequent to application of a liquid of application, a cross linking type protective layer having a charge transport structure is cured upon application of external energy such as heat, light and radiation ray. As a method of applying heat energy, a cross-linking type protective layer is heated from the application surface side or the substrate side using a gas such as air and nitrogen, vapor, or various kinds of heat media, infra-red radiation and electromagnetic wave. The heating temperature is not lower than 100° C. and preferably not lower than 170° C. When the heating temperature is too low, the reaction speed tends to be slow so that the curing reaction may not be complete. When the heating temperature is too high, the curing reaction may not uniformly proceed. Thereby, the protective layer tends to be significantly distorted inside, non-reaction groups may remain therein and three-dimensional mesh structure is not developed completely. For uniform curing reaction, it is effective to heat a cross-linking type protective layer at a relatively low temperature, for example, lower than 100° C., followed by heating at a relatively high temperature, for example, higher than 100° C. to complete the curing reaction. As light energy, a UV irradiation light source such as a high pressure mercury lamp or a metal halide lamp having an emission wavelength mainly in the ultraviolet area is used. A visible light source can be used according to the absorption wavelength of a radical polymeric compound and a photopolymerization initiator. The irradiation light amount is preferably from 50 mW/cm$^2$ to 1,000 mW/cm$^2$. When the irradiation light amount is too small, it may take a long time to complete the curing reaction. When the irradiation light amount is too large, the reaction may not uniformly proceed, resulting in formation of wrinkle on the surface of a cross linking type protective layer having a charge transport structure and a significant amount of non-reacted groups and polymerization terminated ends. In addition, the internal stress in a cross linking type protective layer having a charge transport structure increases due to such rapid cross linking, which causes cracking and peeling thereof. As radiation ray energy, beam of electron can be used. Among these forms of energies, thermal or light energy is suitably used in terms of easiness of reaction speed control and simplicity of a device.

The layer thickness of the cross-linking protective layer of the present invention is preferably from 1 to 10 μm, and more preferably from 2 to 8 μm. When the layer thickness is too thick, cracking and peeling easily occur as described above. When the layer thickness is in the preferred range, the safety margin is improved so that the density of cross-linking can be increased. Therefore, it is possible to select a material having a high anti-abrasion property and set a curing condition. On the other hand, the radical polymerization reaction is vulnerable to oxygen inhibition. That is, on the surface, which contacts air, cross-linking tends to not proceed at all or uniformly due to the radical trap caused by oxygen. This radical trap has a significant effect on the portion having a depth not greater than 1 μm from the surface. Therefore, in a cross-linking type protective layer having a charge transport structure with a thickness not greater than 1 μm, the anti-abrasion property may deteriorate and non-uniform abrasion may occur. In addition, when a liquid of application for forming a cross linking type protective layer having a charge transport structure is coated, the component of a charge transport layer underlying the cross linking protective layer having a charge transport structure is interfused. When the layer thickness of the cross-linking type protective layer having a charge transport structure is too thin, those contaminants may diffuse in the entire layer, which leads to inhibition of the curing reaction and decrease of the density of cross linking. Considering these, a cross-linking type protective layer having a layer thickness not less than 1 μm has a good anti-abrasion property and anti-damage property. But when the cross-linking type protective layer is locally ground to the charge transport layer provided under the protective layer during repetitive use, the ground portion is significantly abraded, resulting in production of a half tone image with uneven density due to fluctuation of chargeability and sensitivity. Therefore, to obtain a durable image bearing member and improve the image quality, the layer thickness of a cross linking type protective layer having a charge transport structure is preferably at least 2 μm.

In the structure in which a charge generating layer, a charge transport layer, and a cross linking type protective layer having a charge transport structure are accumulated in this order, when the cross linking type protective layer having a charge transport layer provided uppermost is insoluble in an organic solvent, the anti-abrasion property and the anti-damaging property can be significantly improved. A method of testing the solubility in an organic solvent is as follows: drop on the surface of an image bearing member a droplet of an organic solvent such as tetrahydrofuran and dichloromethane having a high solubility in a polymer; and subsequent to natural dry, observe the change in the form of the surface of the image bearing member with a microscope. In the case of an image bearing member having a high solubility, the following phenomenon can be observed: the center portion on the image bearing member where the droplet has been dropped is dented and the portion therearound rises; the charge transport layer precipitates, causing white turbidity or clouding due to crystallization thereof; and wrinkled portion is observed as a result of swelling of the surface and contraction thereafter. To the contrary, an image bearing member insoluble in an organic solvent does not change at all in comparison with before the droplet is dropped and those phenomena are not observed.

In the structure of the present invention, to make a cross linking type protective layer having a charge transport structure insoluble in an organic solvent, the following measures can be taken: (1) controlling the compositions and their content ratio of the liquid of application for a cross-linking type protective layer having a charge transport structure; (2) controlling the diluting solvent and the density of the solid portion of a cross-linking type protective layer having a charge transport structure; (3) selecting the method of coating a cross-linking type protective layer having a charge transport structure; (4) controlling the curing conditions of a cross-linking type protective layer having a charge transport structure; and (5) making a charge transport layer hardly soluble in an organic solvent. It is important to control each factor but desired to be used in combination.

When a binder resin having no radical polymeric functional group and an additive such as an anti-oxidization agent and a plasticizer are contained in a large amount in the composition of a cross linking type protective layer having a charge transport structure in addition to the radical polymeric monomer having at least three functional groups without having a charge transport structure and the radical polymeric compound having a functional group and a charge transport structure mentioned above, the density of cross-linking decreases, and the phase separation occurs between the cured material and the additives. As a result, the composition may be soluble in an organic solvent. Specifically, it is desired to restrain the content of the additives within not greater than 20% by weight based on the total solid portion of the liquid of application. In addition, not to reduce the cross-linking density, it is also desired to restrain the total content of a radical polymeric monomer having one or two monomers, a reactive oligomer, and a reactive polymer within not greater than 20% by weight based on the radical polymeric monomer having three functional groups. Further, when a radical polymeric compound having a charge transport structure having at least two functional groups is contained in a large amount, bulky structure bodies are fixed by multiple bondings in a cross-linking structure, which may cause distortion. Therefore, such a structure tends to become an agglomeration of minute cured materials, which may make the structure soluble in an organic solvent. Although it depends on structures, it is preferred to restrain the content of a radical polymeric compound having a charge transport structure having at least two functional groups within not greater than 10% by weight based on the radical polymeric compound having a charge transport structure having a functional group.

With regard to the dilution solvent for a liquid of application for a cross linking type protective layer having a charge transport structure, when a solvent having a slow evaporation speed is used, the solvent remaining may inhibit curing reaction or the content of contaminants of the layer provided under the cross linking type protective layer having a charge transport structure may increase, which causes non-uniform curing and decrease in the curing density. Therefore, such a protective layer tends to be soluble in an organic solvent. Suitable specific examples of the dilution solvents include tetrahydrofuran, a mixture solvent of tetrahydrofuran and methanol, ethyl acetate, methylethyl ketone and ethylcellosolve. These are selected in combination with a coating method. When the density of solid portion in a liquid of application is too low, a cross linking type protective layer having a charge transport structure formed thereof tends to be solved in an organic solvent because of the same reason as described above. In contrast, due to the restraint on the layer thickness and the viscosity of a liquid of application, the density has an upper limit. Specifically, the density is preferred to be from 10 to 50% by weight. As a method of coating a liquid of application for a cross linking type protective layer having a charge transport structure, as described above, a method is preferred in which the content of the solvent during coating is small and the contact time of the solvent is short. To be specific, spray coating method or ring coating method regulating the amount of a liquid of application is preferred. In addition, to restrain the infusion amount of the components of the layer provided under the cross linking type protective layer having a charge transport structure, it is effective to use a charge transport polymer for a charge transport layer and provide an intermediate layer insoluble in a liquid of application for a cross-linking type protective layer having a charge transport structure.

With regard to the curing conditions for a cross linking type protective layer having a charge transport structure, when the heating energy or light irradiation energy is too low, curing reaction does not progress completely. Thereby, the solubility in an organic solvent rises. To the contrary, extremely high energy causes non-uniform curing reaction, which leads to increase of non-cross linked portions and radical terminated portions and formation of an agglomeration of cured materials. Such a cross-linking type protective layer tends to be dissolved in an organic solvent. To make a cross-linking type protective layer insoluble in an organic solvent, heat curing is preferably performed at a temperature from 100 to 170° C. and for 10 minutes to 3 hours. To prevent non-uniform curing reaction, UV irradiation curing is preferably performed at a range of from 50 to 1,000 mW/cm$^2$ for 5 seconds to 5 minutes while restraining the temperature rise within 50° C.

Below are example methods of making a cross linking type protective layer having a charge transport structure insoluble in an organic solvent in the structure of the present invention. When an acrylate monomer having three acryloyloxy groups and a triaryl amine compound having an acryloyloxy group are used as a liquid of application, the content ratio of the acrylate monomer to the triaryl amine is 3/7 to 7/3 and an polymerization initiator is added in an amount of 3 to 20% by weight based on the total amount of the acrylate compound followed by an addition of a solvent to prepare a liquid of application. For example when a triaryl amine based doner and polycarbonate as a binder resin are used in a charge transport layer provided under the cross-linking type protective layer having a charge transport structure and the surface thereof is formed by a spray method, it is preferred to use teterahydrofuran, 2-butanone or ethyl acetate as the solvent mentioned above for a liquid for application, the content of which is 3 to 10 times as much as the total weight of the acrylate compound.

Next, for example, the liquid of application prepared as described above is applied with, for example, a spray, on an image bearing member in which an underlying layer, a charge generating layer, and the charge transport layer are accumulated on a substrate such as an aluminum cylinder. Subsequent to natural drying or drying at a relatively low temperature (25 to 80° C.) for a short time (1 to 10 minutes), the liquid of application is cured by UV ray irradiation or heat.

In the case of UV ray irradiation, a metal halide lamp, etc., is used. The irradiation level thereof is preferably from 50 to 1,000 mW/cm$^2$. For example, during curing, a plurality of lamps cam be used to uniformly irradiate a drum with a UV light of 200 mW/cm$^2$ for about 30 seconds. The temperature of the drum is desired to be controlled not to surpass 50° C.

In the case of heat curing, the heating temperature is preferably from 100 to 170° C. An air supply oven is used as a heating device and when the heating temperature is set at 150° C., the liquid of application is heated for 20 minutes to 3 hours.

When the curing reaction ends, to reduce the amount of remaining solvent, the liquid of application is heated at 100 to 150° C. for 10 to 30 minutes and thus the image bearing member of the present application is obtained.

Next, an electrophotogtaphic image forming apparatus including the image bearing member of the present invention is now described.

Figure 12:
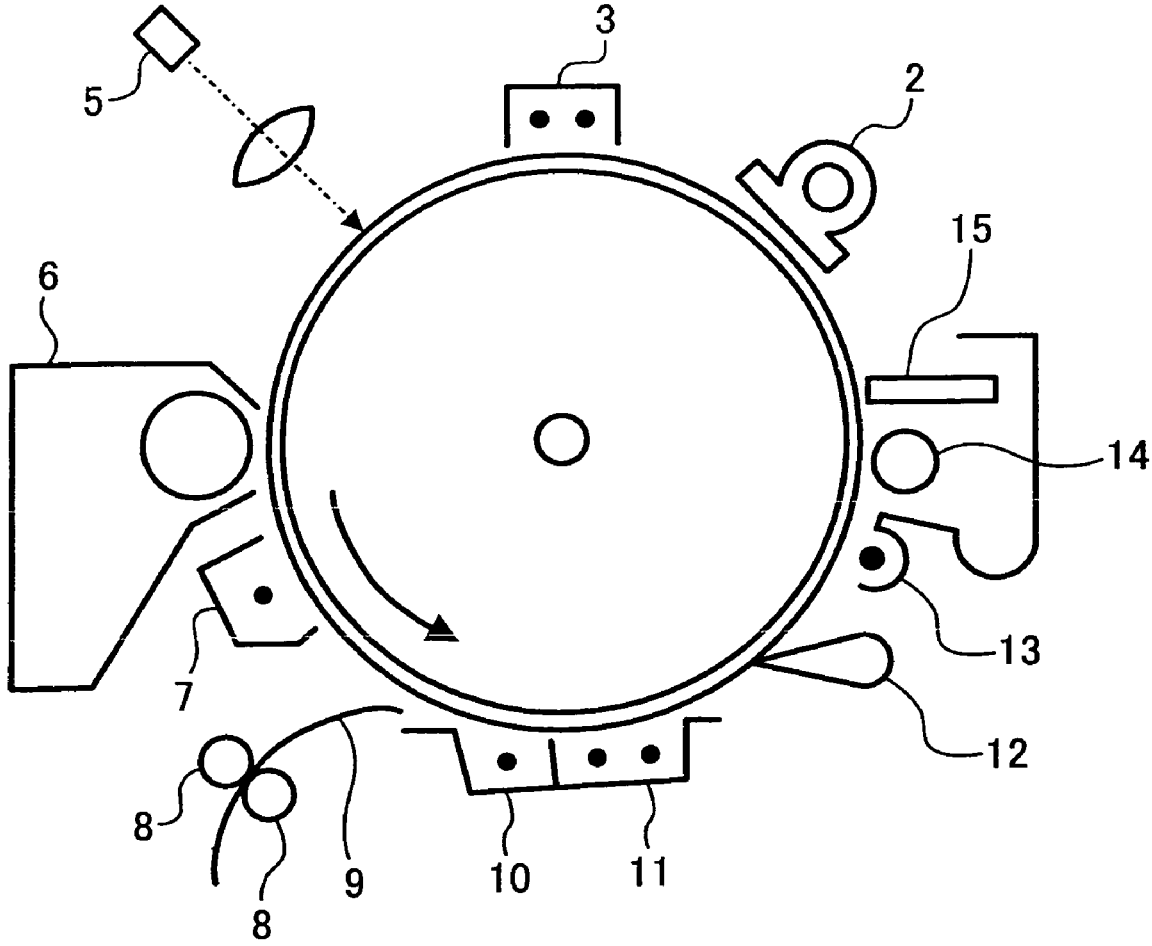
FIG. 12 is a schematic diagram illustrating the image forming apparatus of the present invention.

FIG. 12 is a schematic diagram illustrating the electrophotographic process and the electrophotographic image forming apparatus of the present invention.

The image bearing member illustrated in FIG. 12 includes an electroconductive substrate on which at least a charge blocking layer, a moiré prevention layer and a photosensitive layer are accumulated. The charge blocking layer contains N-alkoxy methylized nylon having a total ion amount of 200 to 400 ppm. The image bearing member illustrated in FIG. 12 has a drum form but can have a sheet form and an endless belt form. Known devices such as a corotron, a scorotron, a solid state chrager, a charging roller and a transfer roller are used as a charging roller, a charger before transfer, a transfer charger, a separation charger, and a charger before cleaning.

Among these charging systems, a contact type charging system and a close disposition (non-contact) system are especially preferred. Such systems have advantages such that such systems is efficient in charging and can be reduced in size with less production of ozone.

In addition, typical luminescent materials such as a fluorine lamp, a tungusten lamp, a halogen lamp, a mercury lamp, a sodium lamp, a light emitting diode (LED), a laser diode (LD), electroluminescence (EL) can be used.

Also, various kinds of filters, such as a sharp cut filer, a bandpass filter, a near-infrared cut filter, a dichroic filter, an interference filter, and a color conversion filter, can be used to irradiate an image bearing member with only a light having a wavelength in a desired range.

Among these light sources, a light emitting diode and a laser diode have a large irradiation energy and emit a light having a long wavelength in the range of from 600 to 800 nm. Therefore, such a light emitting diode and a laser diode are preferably used because the phthalocyanine pigment used as the charge generating material mentioned above is highly sensitive.

These light sources irradiate the image bearing member in processes such as a transfer process, a discharging process, a cleaning process and a pre-irradiation process in addition to the process illustrated in FIG. 12 when light irradiation is used in those processes.

The toner developed on the image bearing member on an image bearing member by a developing unit is transferred to a transfer medium. But not all the toner is transferred and some toner remains on the image bearing member. Such toner is removed by a fur brush and a blade. Cleaning is performed only by a cleaning brush. Known cleaning brushes such as a fur brush and a magfur brush are used.

When an image bearing member is positively (negatively) charged and irradiated with light for an image, a positively (negatively) charged latent electrostatic is formed on the image bearing member. When the latent electrostatic image is developed with negatively (positively) charged toner, a positive image is obtained. When the latent electrostatic image is developed with positively (negatively) charged toner, a negative image is obtained. Known methods are applied to such a developing device and a discharging device.

Next, image forming devices included in the electropohotographic image forming apparatus of the present invention are described.

These image forming elements are structured as a unit including an image bearing member formed of a charge blocking layer, a moiré prevention layer and a photosensitive layer, and around which a charging member, a developing member and a cleaning member are disposed. The charge blocking layer contains N-alkoxymethylized nylon and has a contact angle of water of from 55 to 65° C. In the case of a color image forming apparatus using multiple toners having different colors, the number of image forming units corresponding to the number of colors are contained. Such a unit can be fixed or independently replaced in an image forming apparatus.

Figure 13:
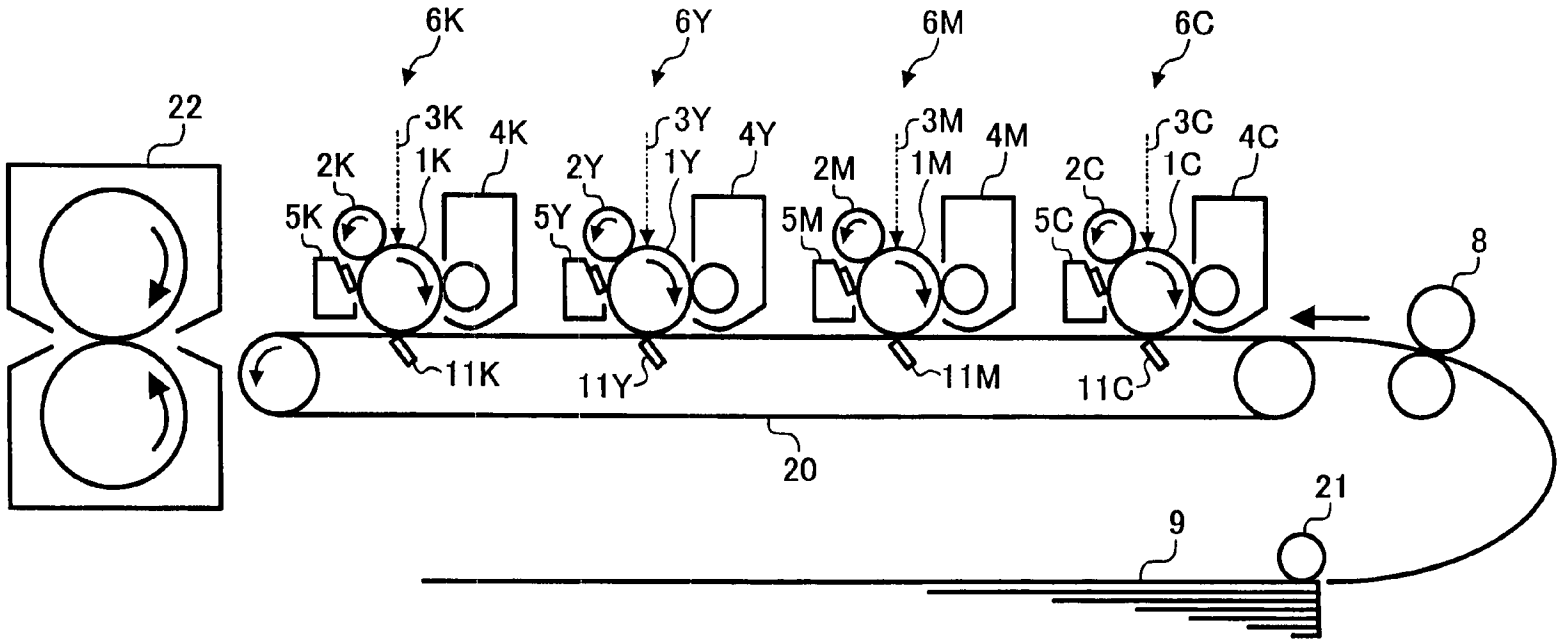
FIG. 13 is a schematic diagram illustrating an image forming apparatus having a plurality of image forming elements.

FIG. 13 is a schematic diagram illustrating an example of an electrophotographic image forming apparatus (generally referred to as full color electrophotographic image forming apparatus taking a tandem system) having a plurality of image forming units. The variations described below are within the scope of the present invention.

In FIG. 13, reference numerals 1C, 1K, 1Y and 1Y are image bearing members having a drum form. These image bearing members rotates in the direction indicated by the arrow illustrated in FIG. 13. Around the image bearing members, at least charging members 2C, 2M, 2Y and 2K, developing members 4C, 4M, 4Y and 4K and cleaning members 5C, 5M, 5Y and 5K are disposed in this order relative to the rotation direction. The charging members 2C, 2M, 2Y and 2K are members including a charging device to uniformly charge the surface of an image bearing member.

Irradiating devices (not shown) irradiate the image bearing members 1C, 1M, 1Y and 1K with laser beams 3C, 3M, 3Y and 3K from the rear side of the image bearing members 1C, 1M, 1Y and 1K between the charging members 2C, 2M, 2Y and 2K and the developing members 4C, 4M, 4Y and 4K to form latent electrostatic images on the image bearing members 1C, 1M, 1Y and 1K. Four image forming units 6C, 6M, 6Y and 6K having the image bearing members 1C, 1M, 1Y and 1K as their center elements are arranged along a transfer conveyer belt 10 functioning as a transfer medium transfer device. The transfer conveyer belt 10 contacts the image bearing members 1C, 1M, 1Y and 1K between the developing members 4C, 4M, 4Y and 4K and the cleaning members 5C, 5M, 5Y and 5K of image forming units 6C, 6M, 6Y and 6K. On the reverse sides of the portions of the transfer conveyer belt 10 contacting the image bearing members, transfer brushes 11C, 11M, 11Y and 11K are disposed to apply a transfer bias. Each image forming unit 6C, 6M, 6Y and 6K has the same structure but the color of the toner contained therein.

In the color image forming apparatus illustrated in FIG. 13, images are formed as follows. In each image forming unit 6C, 6M, 6Y and 6K, the image bearing members 1C, 1M, 1Y and 1K are charged by the charging members 2C, 2M, 2Y and 2K rotating in the direction indicated by the arrow (the same rotation direction as the image bearing members). Next, irradiation portions (not shown) disposed inside the image bearing members 1C, 1M, 1Y and 1K irradiate the image bearing members 1C, 1M, 1Y and 1K with the laser beams 3C, 3M, 3Y and 3K to form latent electrostatic images corresponding to each color.

Next, toner images are formed by developing the latent electrostatic images by the developing members 4C, 4M, 4Y and 4K. The developing members 4C, 4M, 4Y and 4K are developing members to perform development with toners of colors of cyan (C), magenta (M), yellow (Y) and black (K). Each color toner image formed on the four image bearing members 1C, 1M, 1Y and 1K is overlapped on a transfer medium 7.

The transfer medium 7 is fed from a paper feeding roller 8, stopped temporarily at a pair of registration rollers 9 and then synchronously fed to the transfer conveyer belt 10 to the timing of image formation on the image bearing member. The transfer medium 7 held on the transfer conveyer belt 10 is conveyed to the contacting points (transfer portion) with each image bearing member 1C, 1M, 1Y and 1K where each color toner image is transferred.

The toner image on the image bearing member is transferred to the transfer medium 7 by the electric field formed by the voltage difference between the transfer bias applied to transfer brushes 11C, 11M, 11Y and 11K and the voltage at the image bearing member. The transfer medium 7 on which 4 color toner images are overlapped while the transfer medium 7 passes through the four transfer portions is conveyed to a fixing device 12. Then the toner is fixed and the transfer medium 7 is discharged to an output portion. The toner which has not been transferred at the transfer portion but remains on each image bearing member 1C, 1M, 1Y and 1K is retrieved by the cleaning devices 5C, 5M, 5Y and 5K. In the example illustrated in FIG. 13, the image forming units are arranged in the order of cyan (C), magenta (M), yellow (Y), black (K) but not limited thereto. The arrangement of the colors can be arbitral.

When black and white images are formed, it is particularly effective for the present invention to have a mechanism by which the image forming units 6C, 6M, and 6Y other than black can be suspended. Further, in FIG. 13, the charging members contact the corresponding image bearing members. However, it is suitable to provide a gap (about 10 to about 200 μm) between the charging members and the corresponding image bearing members because the abrasion therebetween and the amount of toner filming on the charging members can be reduced.

The image forming units described as mentioned above can be fixedly built in an electrophotographic image forming apparatus such as a photocopier, a facsimile machine and a printer. Also, is it possible to have a structure in which these elements are detachably attached to an electrophotographic image forming apparatus as a form of a process cartridge.

The process cartridge does not mean the image forming unit mentioned above for use in a full color electrophotographic image forming apparatus but has a structure detachably attached to a monochrome image forming apparatus for single color images. Also the process cartridge of the present invention includes the structure mentioned above including an image bearing member formed of the charge blocking layer, which contains N-alkoxymethylized nylon and has a contact angle of water of from 55 to 65° C., a moiré prevention layer and a photosensitive layer, and at least one of a charging device, a developing device, a transfer device, a cleaning device and a discharging device. The image forming elements mentioned above and which are not included in the process cartridge are built in an image forming apparatus.

Figure 14:
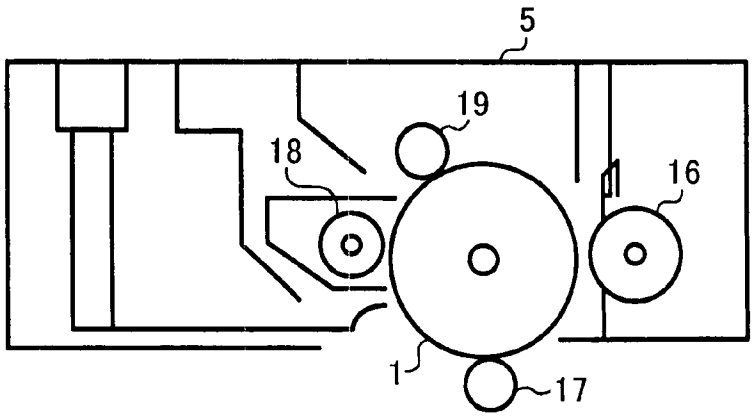
FIG. 14 is a schematic diagram illustrating the typical process cartridge of the present invention.

There are various forms of such a process cartridge. A typical example thereof is illustrated in FIG. 14.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is described with reference to examples below but not limited thereto.

First, synthesis examples of titanyl phthalocyanine used in Examples are described.

Synthesis Example 1 of Pigment

According to JOP 2001-19871, a pigment was prepared. That is, 29.2 g of 1,3-diiminoisoindoline and 200 ml of sulfolane were mixed and 20.4 g of titanium tetrabutoxido was dropped thereto in nitrogen atmosphere. Thereafter, the temperature was raised to 180° C., and the resultant was stirred for reaction for 5 hours while the reaction temperature was maintained in a range of from 170 to 180° C. After the reaction, the resultant was naturally cooled down and the precipitation was filtered. The filtered resultant was washed with chloroform until the obtained powder indicates the color of blue. Next, the resultant powder was washed with methanol several times. Further, subsequent to washing with hot water of 80° C. several times and drying, a coarse titanyl phthalocyanine was obtained. The titanyl phthalocyanine was dissolved in strong sulfuric acid the amount of which was 20 times as much as that of the titanyl phthalocyanine. The resultant was dropped to iced water the amount of which was 100 times as much as the resultant. The precipitated crystal was filtered and water-washing was repeated with deionized water until the washing water was neural to obtain a wet cake (water paste) of titanyl phthalocyanine pigment. The pH value of the deionized water after washing was 6.8. 40 g of the thus obtained wet cake (water paste) was put in 200 g of tetrahydrofuran and stirred for 4 hours. After filtration and drying, titanyl phthalocyanine powder was obtained as Pigment No. 1.

The solid portion density of the wet cake was 15 weight %. The weight ratio of the solvent for crystal conversion to the wet cake was 33. No halogenated material was used in the raw material of Synthesis Example 1.

Figure 15:
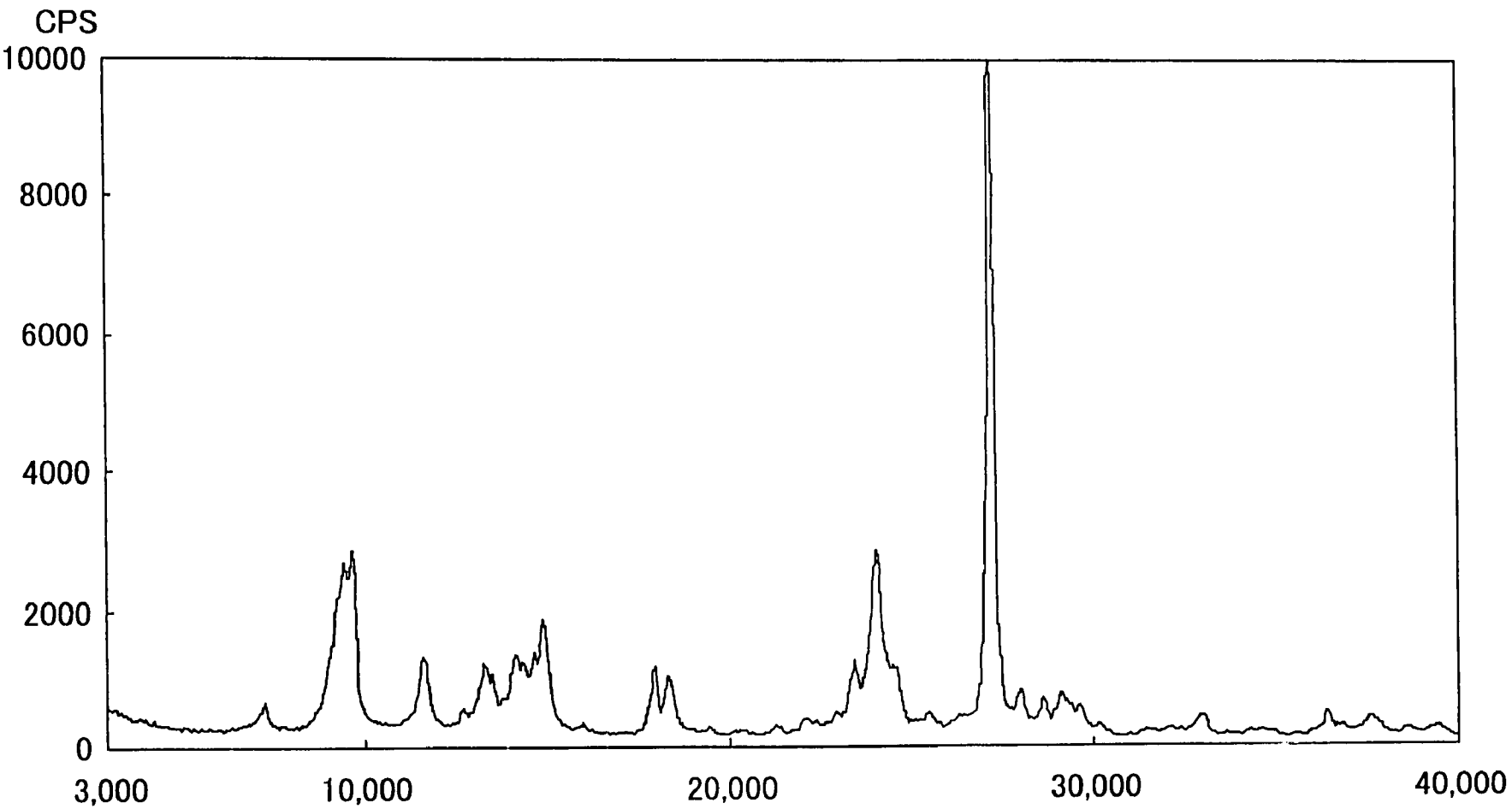
FIG. 15 is a graph illustrating X ray diffraction spectrum of the titanyl phthalocyanine powder obtained in Synthesis Example 1 of pigment described later.
Figure 16:
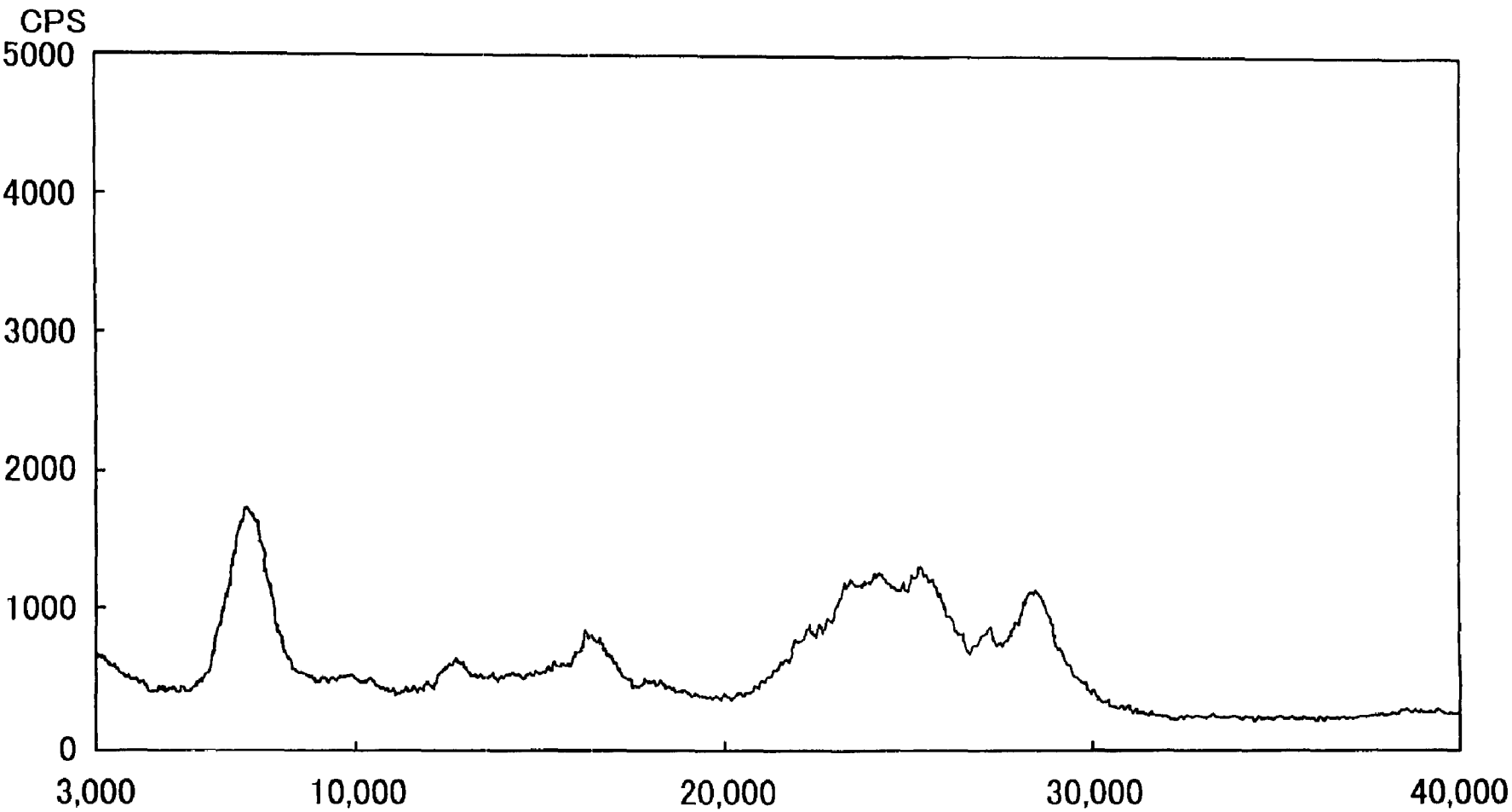
FIG. 16 is a graph illustrating X ray diffraction spectrum of the dried powder of water paste obtained in Synthesis Example 1 of pigment described later.

The thus obtained titanyl phthalocyanine powder measured using X ray diffraction spectrum under the following conditions had a CuKα X ray diffraction spectrum having a wavelength of 1.542 Å such that the maximum diffraction peak was observed at a Bragg (2θ) angle of 27.2±0.2°, and a peak is observed at a Bragg (2θ) angle of 7.3±0.2° as the lowest angle diffraction peak while there is no peak between 9.4°±0.2° and 7.3°±0.2° and there is no peak at 26.3±0.2°. The result is illustrated in FIG. 15. In addition, part of the water paste obtained in Synthesis Example 1 of pigment was dried for 2 days with a reduced pressure of 5 mmHg at 80° C. to obtain amorphous titanyl phthalocyanine powder. The X ray diffraction spectrum of the dried powder of the water paste is illustrated in FIG. 16.

(Measuring Conditions of X Ray Diffraction Spectrum)
X ray tube: Cu
Voltage: 50 kV
Current: 30 mA
Scanning speed: 2°/minute
Scanning area: 3 to 40°
Decay time constant: 2 sec.

Synthesis Example 2 of Pigment

Water paste of titanyl phthalocyanine pigment was synthesized according to the method of Synthesis Example 1 of pigment and titanyl phthalocyanine crystal having a primary particle diameter smaller than that of Synthesis Example 1 of pigment was obtained.

400 parts of tetrahydrofuran was added to 60 parts of the water paste before crystal conversion obtained in Synthesis Example 1. The mixture was vigorously stirred (2,000 rpm) with HOMOMIXER (Mark II f model, manufactured by Kenis Ltd.) at room temperature. When the color of navy blue of the water paste was changed to the color of light blue (20 minutes after the stirring started), the stirring was stopped and filtration with a reduced pressure was performed immediately. The crystal obtained on the filtration device was washed with tetrahydrofuran and a wet cake of a pigment was obtained. The resultant wet cake was dried with a reduced pressure (5 mmHg) at 70° C. for two days to obtain 8.5 parts of titanyl phthalocyanine crystal. The obtained titanyl phthalocyanine crystal was assigned as Pigment No. 2. No halogenated material was used in the raw material of Synthesis Example 1. The density of the solid portion of the wet cake described above is 15% by weight. The weight ratio of the solution for use in crystal conversion to the wet cake was 44.

Part of the titanyl phthalocyanine (water paste) before crystal conversion obtained in Synthesis Example 1 was diluted with deionized water to be about 1% by weight. The paste was scooped by a copper net the surface of which was electrocondcutively treated. The particle size of the titanyl phthalocyanine was observed by a transmission electron microscope (TEM) (H-9000NAR, manufactured by Hitachi, Ltd.) with a magnifying power of 75,000. The average particle size thereof was obtained as follows.

The TEM image observed as described above was photographed as a TEM photograph. 30 photographed titanyl phthalocyanine particles (having a needle-like form) are arbitrarily selected and the major axis thereof was measured. The arithmetical mean of the major axes of the measured 30 particles were calculated and determined as the average particle size.

The average particle size in the water paste of the Synthesis Example 1 was 0.06 μm.

In addition, the crystalline converted titanyl phthalocyanine crystals immediately before filtration in Synthesis Examples 1 and 2 were diluted with tetrahydrofuran to be about 1% by weight and observed in the same manner as in the method described above. The average particle size diameters obtained as described above are shown in Table 1. The forms of the titanyl phthalocyanine crystals manufactured in Synthesis Examples 1 and 2 were not identical (for example, a form close to a triangle or a form close to a square). Therefore, the maximum diagonal of the crystal was used as the major axis for calculation. As seen in Table 1, Pigment No. 1 manufactured in Synthesis Example 1 of pigment does not only have a large average particle diameter but also contains coarse particles. To the contrary, it is found that Pigment No. 2 manufactured in Synthesis Example 2 of pigment has a small average particle size and the size of the individual primary particles thereof is significantly uniform.

TABLE 1

| | Average particle size | Note |
|---|---|---|
| Synthesis Example 1 of pigment (Pigment No. 1) | 0.31 | Contains a large particle having a particle diameter of from about 0.3 to about 0.4 μm |
| Synthesis Examples 2 of pigment (Pigment No. 2) | 0.12 | Substantially same crystal size |

Synthesis Example 3 of Pigment

A pigment was prepared based on the method described in Example 1 of JOP H01-299874 (Japanese patent No. 2512081). That is, the wet cake prepared in Synthesis Example 1 of pigment was dried. 1 g of the dried product was added to 50 g of polyethylene glycol and the mixture was pulverized with 100 g of glass beads using a Sand mill. After crystal transfer, the resultant was washed with dilute sulfuric acid and an aqueous solution of ammonium hydroxide in this order. After drying, a pigment was obtained as Pigment No. 3. No halogenated material was used in the raw material of Synthesis Example 3 of pigment.

Synthesis Example 4 of Pigment

A pigment was prepared based on the method described in Manufacturing Example 1 of JOP H03-269064 (Japanese patent No. 2584682). That is, the wet cake prepared in Synthesis Example 1 was dried. 1 g of the dried product was stirred at 50° C. in a mixture solvent of 10 g of deionized water and 1 g of monochlorobenzene for one hour. Thereafter, the resultant was washed with methanol and deionized water. After drying, a pigment was obtained as Pigment No. 4. No halogenated material was used in the raw material of Synthesis Example 4 of pigment.

Synthesis Example 5 of Pigment

A pigment was prepared based on the method described in JOP H02-8256 (JPP H07-91486). That is, 9.8 g of phthalodinitrile and 75 ml of 1-chloronaphthalene were mixed with stirring and 2.2 ml of titanium tetrachloride was dropped in nitrogen atmosphere. Thereafter, the temperature was gradually raised to 200° C. and the resultant was stirred for reaction for 3 hours while the reaction temperature was maintained in a range of from 200 to 220° C. After the reaction, the resultant was naturally cooled down to 130° C. and heat-filtered. The filtered resultant was washed with 1-chloronaphthalene until the obtained powder indicated the color of blue. Next, the resultant powder was washed with methanol several times. Further, subsequent to washing with hot water of 80° C. several times and drying, a pigment was obtained as Pigment No. 5. The raw material of Synthesis Example 5 contains a halogenated material.

Synthesis Example 6 of Pigment

A pigment was prepared based on the method described in Synthesis Example 1 of JOP S64-17066 (JPP H07-97221). That is, 5 g of α type TiOPc was subject to crystal conversion treatment at 100° C. for 10 hours in a sand grinder together with 10 g of sodium chloride and 5 g of acetophenone. The resultant was washed with deionized water and methanol and purified with dilute sulfuric acid. Thereafter, the purified resultant was washed with deionized water until the acid component was lost. Subsequent to drying, a pigment was obtained as Pigment No. 6. The raw material of Synthesis Example 6 of pigment contains a halogenated material.

Synthesis Example 7 of Pigment

A pigment was prepared based on the method described in Example 1 of JOP H11-5919 (Japanese patent No. 3003664). That is, 20.4 parts of O-phthalodinitrile and 7.6 parts of titanium tetrachloride were heated and reacted in 50 parts of quinoline at 200° C. for 2 hours. After the solvent was removed by moisture vapor distillation, the resultant was purified with 2% hydrochloric acid and 2% sodium hydroxide aqueous solution and washed with methanol and N,N-dimethyl formaldehyde. Subsequent to drying, titanyl phthalocyanine was obtained. 2 parts of the titanyl phthalocyanine were dissolved in 40 parts of 98% sulfuric acid at 5° C. little by little. The mixture was stirred for about one hour while maintaining the temperature to not higher than 5° C. The resultant was slowly added in 400 parts of iced water in which sulfuric acid had been vigorously stirred and the precipitated crystal was filtered. The crystal was washed with distilled water until the acid portion was removed to obtain a wet cake. The cake was stirred in 100 parts of tetrahydrofuran for about 5 hours. Subsequent to filtration, washing with tetrahydrofuran, and drying, a pigment was obtained as Pigment No. 7. The raw material of Synthesis Example 7 contains a halogenated material.

Synthesis Example 8 of Pigment

A pigment was prepared based on the method described in Synthesis Example 2 of JOP H03-255456 (Japanese Patent No. 3005052). That is, 10 parts of the wet cake prepared in Synthesis Example 1 was mixed with 15 parts of sodium chloride and 7 parts of diethylene glycol. The mixture was subject to milling treatment by an automatic mortar for 60 hours at 80° C. Next, the resultant was sufficiently water-washed to completely remove the sodium chloride and diethylene glycol contained therein. Subsequent to drying with a reduced pressure, 200 parts of cyclohexanone and glass beads having a particle diameter of 1 mm were added to the resultant. The mixture was subject to treatment using a Sand mill for 30 minutes and a pigment was obtained as Pigment No. 8. No halogenated material was used in the raw material of Synthesis Example 8.

Synthesis Example 9 of Pigment

A pigment was prepared based on the method described in JOP H08-110649. That is, 58 parts of 1,3-diiminoiso indoline and 51 parts of tetrabutoxy titanium were reacted in 300 parts of α-chloronaphthalene for 5 hours at 210° C. The resultant was washed with α-chloronaphthalene and dimethyl formamide (DMF) in this order. Thereafter, the resultant was washed with heated DMF, hot water, and methanol. After drying, 50 parts of titanyl phthalocyanine was obtained. 4 parts of the titanyl phthalocyanine were added in 400 parts of sulfuric acid cooled down to 0° C. and stirred for one hour at 0° C. When the titanyl phthalocyanine was completely dissolved, the resultant was added in a mixture solution of 800 ml of water and 800 ml of toluene cooled down to 0° C. After the resultant was stirred for 2 hours at room temperature, the precipitated titanyl phthalocyanine mixed crystal was filtered and dried to obtain 2.9 parts of titanyl phthalocyanine mixed crystal (Pigment No. 9). No halogenated material was used in the raw material of Synthesis Example 9.

The X-ray diffraction spectrum was measured for the pigments Nos. 3 to 9 manufactured in Synthesis Examples 3 to 9 of pigment and confirmed that the X-ray diffraction spectrum thereof was the same as those described in the corresponding JOPs. The X-ray diffraction spectrum of the pigment prepared in Synthesis Example 2 matched the spectrum of the pigment prepared in Synthesis Example 1. The peaks of X-ray diffraction spectra of the Synthesis Examples 1 to 9 are shown in Table 2.

TABLE 2

| | | Maximum peak | Lowest Angle peak | Peak at 9.4° | Peak at 9.6° | Peak in the range of 7.4° to 9.4° | Peak at 24.0° | Peak at 26.3° |
|---|---|---|---|---|---|---|---|---|
| SE 1 | P1 | 27.2° | 7.3° | Y | Y | N | Y | N |
| SE 2 | P2 | 27.2° | 7.3° | Y | Y | N | Y | N |
| SE 3 | P3 | 27.2° | 7.3° | N | N | N | Y | N |
| SE 4 | P4 | 27.2° | 9.6° | Y | Y | N | Y | N |
| SE 5 | P5 | 27.2° | 7.4° | N | Y | N | N | N |
| SE 6 | P6 | 27.3° | 7.3° | Y | Y | Y(7.5°) | Y | N |
| SE 7 | P7 | 27.2° | 7.5° | N | Y | Y(7.5°) | Y | N |
| SE 8 | P8 | 27.2° | 7.4° | N | N | Y(9.2°) | Y | Y |
| SE 9 | P9 | 27.2° | 7.3° | Y | Y | N | Y | N |

SE represents Synthesis Example;
P represents pigment;
Y represents Yes; and
N represents No.

Next, a method of manufacturing liquid of application for forming a charge generating layer using the charge generating material synthesized as described above is described.

Liquid Dispersion Example 1

The following recipe of Pigment No. 1 prepared in Synthesis Example 1 was dispersed under the following dispersion condition to obtain a liquid dispersion as a liquid of application for forming a charge generating layer.

| Recipe: | |
|---|---|
| Titanyl phthalocyanine pigment (Pigment No. 1) | 15 parts |
| Polyvinyl butyral (BX-1, manufactured by Sekisui Chemical Co., Ltd.) | 10 parts |
| 2-butanone | 280 parts |

Condition:

2-butanone in which polyvinyl butyral was dissolved and the pigment were all put in a marketed bead mill dispersion device using PSZ balls having a diameter of 0.5 mm. Dispersion was performed for 30 minutes at 1,200 rpm to prepare a liquid dispersion (Liquid Dispersion No. 1) for forming a charge generating layer.

Liquid Dispersion Examples 2 to 9

Instead of Pigment No. 1 used in Liquid Dispersion Example 1, Liquid Dispersions were prepared using Pigments Nos. 2 to 9 under the same condition of Liquid Dispersion Example 1. These obtained liquid dispersions were assigned as Liquid dispersions 2 to 9 for forming a charge generating layer corresponding to the numbers of Pigments.

Liquid Dispersion Example 10

Liquid Dispersion No. 1 prepared in Liquid Dispersion Example 1 was filtered using cotton wind cartridge filter (TCW-1-CS with an effective hole diameter of 1 μm, manufactured by ToyoRoshi Kaisha, Ltd.). Filtration was performed under pressure using a pump. The obtained liquid was assigned as Liquid dispersion No. 10 for forming a charge generating layer.

Liquid Dispersion Example 11

A liquid dispersion was prepared by filtration under pressure as in the manner described in Liquid Dispersion Example 10 except that the filter used in Liquid Dispersion Example 10 was replaced with cotton wind cartridge filter (TCW-3-CS having an effective hole diameter of 3 μm, manufactured by ToyoRoshi Kaisha, LTd.). The obtained liquid was assigned as Liquid dispersion No. 11 for forming a charge generating layer.

Liquid Dispersion Example 12

A liquid dispersion was prepared by filtration under pressure as in the manner described in Liquid Dispersion Example 10 except that the filter used in Liquid Dispersion Example 10 was replaced with cotton wind cartridge filter (TCW-5-CS having an effective hole diameter of 5 μm, manufactured by ToyoRoshi Kaisha, LTd.). The obtained liquid was assigned as Liquid dispersion No. 12 for forming a charge generating layer.

Liquid Dispersion Example 13

Dispersion was performed in the same manner as described in Liquid Dispersion Example 1 except that the number of rotation of the rotor was changed to 1,000 rpm for 20 minutes in the dispersion condition. The obtained liquid was assigned as Liquid Dispersion No. 13 for forming a charge generating layer.

Liquid Dispersion Example 14

The liquid dispersion prepared in Liquid Dispersion Example 13 was filtered using a cotton wind cartridge filter TCW-1-CS (with an effective hole diameter of 1 μm). The filtration was performed under pressure using a pump. The obtained liquid was assigned as Liquid Dispersion No. 14 for forming a charge generating layer.

The particle size distribution of the Pigment particles in the liquid dispersions as prepared above was measured using CAPA-700, manufactured by Horiba, Ltd. The results are shown in Table 3.

TABLE 3

| | | Average particle diameter (μm) | Standard deviation (μm) |
|---|---|---|---|
| Liquid Dispersion 1 for forming a charge generating layer | Pigment No. 1 | 0.29 | 0.18 |
| Liquid Dispersion 2 | Pigment No. 2 | 0.19 | 0.13 |
| Liquid Dispersion 3 | Pigment No. 3 | 0.28 | 0.19 |
| Liquid Dispersion 4 | Pigment No. 4 | 0.31 | 0.2 |
| Liquid Dispersion 5 | Pigment No. 5 | 0.3 | 0.2 |
| Liquid Dispersion 6 | Pigment No. 6 | 0.27 | 0.19 |
| Liquid Dispersion 7 | Pigment No. 7 | 0.29 | 0.2 |
| Liquid Dispersion 8 | Pigment No. 8 | 0.27 | 0.18 |
| Liquid Dispersion 9 | Pigment No. 9 | 0.26 | 0.19 |
| Liquid Dispersion 10 | Pigment No. 10 | 0.22 | 0.16 |
| Liquid Dispersion 11 | Pigment No. 11 | 0.24 | 0.17 |
| Liquid Dispersion 12 | Pigment No. 12 | 0.28 | 0.18 |
| Liquid Dispersion 13 | Pigment No. 13 | 0.33 | 0.23 |

With regard to Liquid Dispersion Example 14 for forming a charge generating layer, the filter was clogged during filtration so that the liquid dispersion was not filtered completely. Therefore, the liquid dispersion was not evaluated.

Liquid Dispersion Example 15

The liquid dispersion having the following receipe was prepared by dispersion for 72 hours using a ball milling. The obtained liquid was assigned as Liquid Dispersion No. 15 for forming a charge generating layer.

| Recipe | |
|---|---|
| Butyral resin: S-LEC BMS, manufactured by Sekisui Chemical Co., Ltd. | 5 parts |
| Trisazo pigment having the following chemical structure | 15 parts |

Chemical formula 34

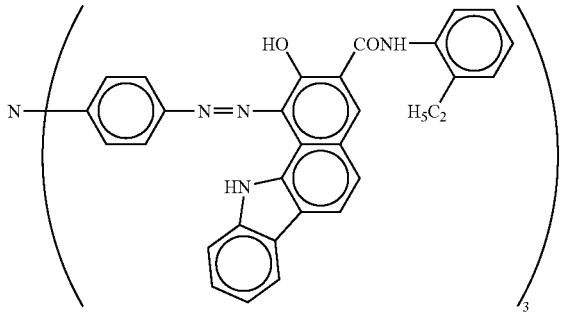

| | |
|---|---|
| Cyclohexanone | 700 parts |
| 2-butanone | 300 parts |

Synthesis Example of Resin for Forming a Charge Blocking Layer 100 parts of 6-nylon was dissolved in 160 parts of methanol. 75 parts of formaldehyde and 2 parts of phosphoric acid were admixed to the resultant and stirred. The temperature was raised to 125° C. over one hour. After 30 minutes at 125° C., the mixture was cooled down to room temperature over 45 minutes. The resultant mixture obtained was a translucent gel.

To neutralize phosphoric acid, the gel was dissolved to 95% ethanol containing excessive ammonium. This solution was poured to water to precipitate polyamide.

The precipitated polyamide was filtered and washed with tapped water having an amount of 1 litter. Subsequent to drying, N-methoxymethylized nylon was obtained.

| Liquid dispersion for forming charge blocking layer | |
|---|---|
| N-methoxymethylized nylon (resin) | 6.4 part |
| methanol | 70 parts |
| n-butanol | 30 parts |

N-methoxymethylized nylon, i.e., resin, was dissolved in a solvent having the ratio mentioned above to obtain a liquid dispersion for forming a charge blocking layer.

| Liquid of application for forming moiré prevention layer | |
|---|---|
| The mixture having the following component with the following ratio was dispersed by a ball mill to form a liquid of application of for forming an intermediate layer. | |
| Titanium oxide T1 (specific surface area: 6.5 $m^2/g$ purity: 99.8%) | 40 parts |
| Titanium oxide T2 (specific surface area: 21.0 $m^2/g$ purity: 99.7%) | 30 parts |
| Alkyd resin (BEKKOLTGHT® M6401-50-S: solid portion 50%, manufactured by Dainippon Ink and Chemicals, Incorporated.) | 14 parts |
| Melamine resin (SUPER BECKAMINE G-821-60 (solid portion 60%, manufactured by Dainippon Ink and Chemicals, | |

-continued

| Liquid of application for forming moiré prevention layer | |
|---|---|
| Incorporated.) | |
| 2-butanone | 100 parts |
| Liquid of application for forming a charge transport layer | |
| polycarbonate (TS2050, manufactured by Teijin Chemicals Ltd.) | 10 parts |
| charge transport polymer represented by the following chemical structure | 7 parts |
| tetrahydrofuran | 80 parts |

[Chemical formula 35]

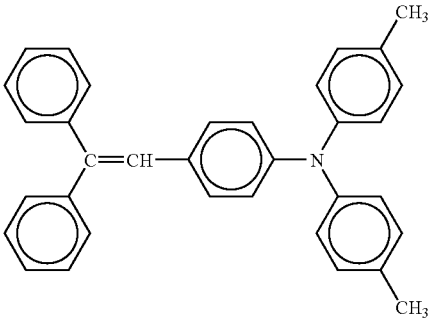

Example 1

The liquid of application mentioned above for forming a charge blocking layer, the liquid of application mentioned above for forming a moiré prevention layer, the liquid of application 2 mentioned above for forming a charge generating layer and the liquid of application for a charge transport layer were applied to an aluminum cylinder (JIS1050) having a diameter of 100 mm in this order. Subsequent to drying, a charge blocking layer having a thickness of 1.0 μm, a moiré prevention layer having a thickness of 3.5 μm, a charge generating layer having a thickness of 0.3 μm and a charge transport layer having a thickness of 2.5 μm were formed to obtain an image bearing member.

Example 2

The image bearing member of Example 2 was manufactured in the same manner as in Example 1 except that the liquid of application for forming a charge blocking layer was changed to the following:

| Liquid of application for forming a charge blocking layer | |
|---|---|
| N-methoxymethylized nylon (resin) | 6.4 parts |
| methanol | 70 parts |
| n-butanol | 20 parts |
| deionized water | 10 parts |

Comparative Example 1

The image bearing member of Comparative Example 1 was manufactured in the same manner as in Example 1 except that the charge blocking layer was not provided.

Comparative Example 2

The image bearing member of Comparative Example 2 was manufactured in the same manner as in Example 1 except that the moire prevention layer was not provided.

Comparative Example 3

The image bearing member of Comparative Example 3 was manufactured in the same manner as in Example 1 except that the order of application of the charge blocking layer and the moire prevention layer was reversed.

Examples 3 to 12 and Comparative Examples 4 to 12

The image bearing members of Examples 5 to 10 and Comparative Examples 4 and 5 were manufactured in the same manner as in Example 1 except that the liquid of application for forming a moire prevention layer were changed as in the following table.

TABLE 4

| | Titanium oxide T1 | | Titanium oxide T2 | | |
|---|---|---|---|---|---|
| | Specific surface area ($m^2/g$) | Purity (%) | Specific surface area ($m^2/g$) | Purity (%) | Mixing ratio T2/(T1 + T2) |
| Example 3 | 5.0 | 99.7 | 21.0 | 99.7 | 3/7 |
| Example 4 | 7.8 | 99.7 | 21.0 | 99.7 | 3/7 |
| Example 5 | 6.5 | 99.8 | 28.5 | 99.6 | 3/7 |
| Example 6 | 6.5 | 99.8 | 33.0 | 99.8 | 3/7 |
| Example 7 | 6.3 | 99.2 | 21.0 | 99.7 | 3/7 |
| Example 8 | 6.5 | 99.8 | 22.5 | 99.0 | 3/7 |
| Example 9 | 6.3 | 99.2 | 22.5 | 99.0 | 3/7 |
| Example 10 | 6.5 | 99.8 | 21.0 | 99.7 | 0.4 |
| Example 11 | 6.5 | 99.8 | 21.0 | 99.7 | 0.25 |
| Example 12 | 6.5 | 99.8 | 21.0 | 99.7 | 0.6 |
| Comparative Example 4 | 6.5 | 99.8 | 0 | 0 | — |
| Comparative Example 5 | 0 | 0 | 21.0 | 99.7 | — |
| Comparative Example 6 | 4.2 | 99.6 | 21.0 | 99.7 | 3/7 |
| Comparative Example 7 | 9.9 | 99.5 | 21.0 | 99.7 | 3/7 |
| Comparative Example 8 | 6.5 | 99.8 | 9.9 | 99.5 | 3/7 |
| Comparative Example 9 | 6.5 | 99.8 | 38.5 | 99.4 | 3/7 |
| Comparative Example 10 | 6.3 | 98.2 | 22.5 | 97.7 | 3/7 |
| Comparative Example 11 | 6.5 | 99.6 | 21.0 | 99.7 | 0.15 |
| Comparative Example 12 | 6.5 | 99.8 | 21.0 | 99.7 | 0.7 |

Examples 1 to 12 and Comparative Examples 1 to 12

To find out the impact of the fatigue caused during repetitive use of the image bearing members manufactured as described above, all the devices were removed from the image forming apparatus illustrated in FIG. 12 except for the laser diode (LD) as the image irradiation light source having a wavelength of 780 nm (image writing by a polygon mirror), a charger taking scorotron system as a charging device with the charging condition of DC bias of −1,300 V) and a discharging lamp. A duration test using a chart having a writing ratio of 6% was performed for 96 hours on end for the remodeled image forming apparatus. Thereafter, the image bearing member was removed and attached to a non-remodeled image forming apparatus (Imagio Neo1050Pro, Manufactured by Ricoh Co., Ltd.). Then white solid and half tone images were output and evaluated for image density, background fouling, the occurrence of fouling at the top end, and moire. The images were scaled in the following 4 ranks: E: Excellent, G: Good, F: Fair and P: Poor. The results are shown in Table 5.

TABLE 5

| | Image density | Background fouling | Fouling at top end | Moire |
|---|---|---|---|---|
| Example 1 | E | E | E | E |
| Example 2 | E | E | E | E |
| Example 3 | E | G | E | E |
| Example 4 | E | E | E | E |
| Example 5 | E | E | E | E |
| Example 6 | G | E | E | E |
| Example 7 | E | E | E | E |
| Example 8 | E | E | E | E |
| Example 9 | G | G | G | E |
| Example 10 | E | E | E | E |
| Example 11 | E | E | G | E |
| Example 12 | G | E | E | G |
| Comparative Example 1 | E | P | E | E |
| Comparative Example 2 | E | F | E | P |
| Comparative Example 3 | P | F | G | E |
| Comparative Example 4 | E | E | P | E |
| Comparative Example 5 | F | E | E | P |
| Comparative Example 6 | E | F | F | E |
| Comparative Example 7 | F | E | E | F |
| Comparative Example 8 | E | E | F | E |
| Comparative Example 9 | F | E | E | E |
| Comparative Example 10 | P | F | E | E |
| Comparative Example 11 | E | E | F | E |
| Comparative Example 12 | F | E | E | F |

As seen in Table 5, the image bearing member of the present invention can stably form images without deterioration of image density, background fouling, fouling at top end and moiré.

Example 13

The image bearing member of Example 13 was manufactured in the same manner as in Example 1 except that the liquid of application for forming a charge generating layer was changed from the liquid of application 2 for forming a charge generating layer to the liquid of application 1 for forming a charge generating layer.

Example 14

The image bearing member of Example 14 was manufactured in the same manner as in Example 1 except that the liquid of application for forming a charge generating layer was changed from the liquid of application 2 for forming a charge generating layer to the liquid of application 3 for forming a charge generating layer.

Example 15

The image bearing member of Example 15 was manufactured in the same manner as in Example 1 except that the liquid of application for forming a charge generating layer was changed from the liquid of application 2 for forming a charge generating layer to the liquid of application 4 for forming a charge generating layer.

Example 16

The image bearing member of Example 16 was manufactured in the same manner as in Example 1 except that the liquid of application for forming a charge generating layer was changed from the liquid of application 2 for forming a charge generating layer to the liquid of application 5 for forming a charge generating layer.

Example 17

The image bearing member of Example 17 was manufactured in the same manner as in Example 1 except that the liquid of application for forming a charge generating layer was changed from the liquid of application 2 for forming a charge generating layer to the liquid of application 6 for forming a charge generating layer.

Example 18

The image bearing member of Example 18 was manufactured in the same manner as in Example 1 except that the liquid of application for forming a charge generating layer was changed from the liquid of application 2 for forming a charge generating layer to the liquid of application 7 for forming a charge generating layer.

Example 19

The image bearing member of Example 19 was manufactured in the same manner as in Example 1 except that the liquid of application for forming a charge generating layer was changed from the liquid of application 2 for forming a charge generating layer to the liquid of application 8 for forming a charge generating layer.

Example 20

The image bearing member of Example 20 was manufactured in the same manner as in Example 1 except that the liquid of application for forming a charge generating layer was changed from the liquid of application 2 for forming a charge generating layer to the liquid of application 9 for forming a charge generating layer.

Example 19

The image bearing member of Example 21 was manufactured in the same manner as in Example 1 except that the liquid of application for forming a charge generating layer was changed from the liquid of application 2 for forming a charge generating layer to the liquid of application 10 for forming a charge generating layer.

Example 22

The image bearing member of Example 22 was manufactured in the same manner as in Example 1 except that the liquid of application for forming a charge generating layer was changed from the liquid of application 2 for forming a charge generating layer to the liquid of application 11 for forming a charge generating layer.

Example 23

The image bearing member of Example 23 was manufactured in the same manner as in Example 1 except that the liquid of application for forming a charge generating layer was changed from the liquid of application 2 for forming a charge generating layer to the liquid of application 12 for forming a charge generating layer.

Example 24

The image bearing member of Example 24 was manufactured in the same manner as in Example 1 except that the liquid of application for forming a charge generating layer was changed from the liquid of application 2 for forming a charge generating layer to the liquid of application 13 for forming a charge generating layer.

Example 25

The image bearing member of Example 25 was manufactured in the same manner as in Example 1 except that the liquid of application for forming a charge generating layer was changed from the liquid of application 2 for forming a charge generating layer to the liquid of application 15 for forming a charge generating layer.

For the image bearing members manufactured in Examples 1 and 13 to 25 as described above, the duration test mentioned above was performed. That is, all the devices were removed from the image forming apparatus illustrated in FIG. 12 except for the laser diode (LD) as the image irradiation light source having a wavelength of 780 nm (image writing by a polygon mirror), a charger taking scorotron system as a charging device with the charging condition of DC bias of −1,300 V) and a discharging lamp. The duration test as mentioned above using a chart having a writing ratio of 6% was performed for 96 hours on end for the remodeled image forming apparatus. Thereafter, the image bearing member was removed and attached to a non-remodeled image forming apparatus (Imagio Neo1050Pro, Manufactured by Ricoh Co., Ltd.). Then white solid and half tone images were output and evaluated for image density, background fouling, the occurrence of fouling at the top end, and moire. The images were scaled in the following 4 ranks: E: Excellent, G: Good, F: Fair and P: Poor. The results are shown in Table 6.

TABLE 6

| | Liquid of application for forming charge generating layer | Image density | Background fouling | Fouling at top end | Moire |
|---|---|---|---|---|---|
| Example 1 | Liquid of application 2 | E | E | E | E |
| Example 13 | Liquid of application 1 | E | G | E | E |
| Example 14 | Liquid of application 3 | G | G | E | E |
| Example 15 | Liquid of application 4 | G | F | E | E |
| Example 16 | Liquid of application 5 | G | G | E | E |
| Example 17 | Liquid of application 6G | G | G | E | E |
| Example 18 | Liquid of application 7 | G | G | E | E |
| Example 19 | Liquid of application 8 | G | G | E | E |
| Example 20 | Liquid of application 9 | G | F | E | E |
| Example 21 | Liquid of application 10 | E | E | E | E |
| Example 22 | Liquid of application 11 | E | E | E | E |
| Example 23 | Liquid of application 12 | E | G | E | E |
| Example 24 | Liquid of application 13 | G | F | E | E |
| Example 25 | Liquid of application 15 | F | F | E | E |

As seen in table 10, it is possible to manufacture an image bearing member suitable for actual use regardless of materials for use in a charge generating layer by providing a charge blocking layer and the moiré prevention layer of the charge blocking layer.

However, when an azo pigment (Example 25) is used, the image density deteriorates after repetitive use in comparison with other image bearing members (all of which uses titanyl phthalocyanine).

In addition, when titanyl phthalocyanine having a specific crystal type (crystal type of titnaly phthalocyanine of Synthesis Example 1) is used, the characteristics are excellent.

Further, when the titanyl phthalocyanine having a crystal type of Synthesis type 1 is used, it is found that the anti-background fouling characteristics after repetitive use are especially good as seen in Examples 1, 21 and 22 by making the primary particle size not greater than 0.25 μm. As methods of regulating the primary particle size to not greater than 0.25 μm, there are a method of reducing the particle size during synthesis and a method of removing coarse particles after dispersion, both of which are confirmed to be effective.

Example 26

The image bearing member of Example 26 was manufactured in the same manner as Example 1 except that the liquid of application for forming a charge generating layer was changed to the following composition.

Chemical formula 36

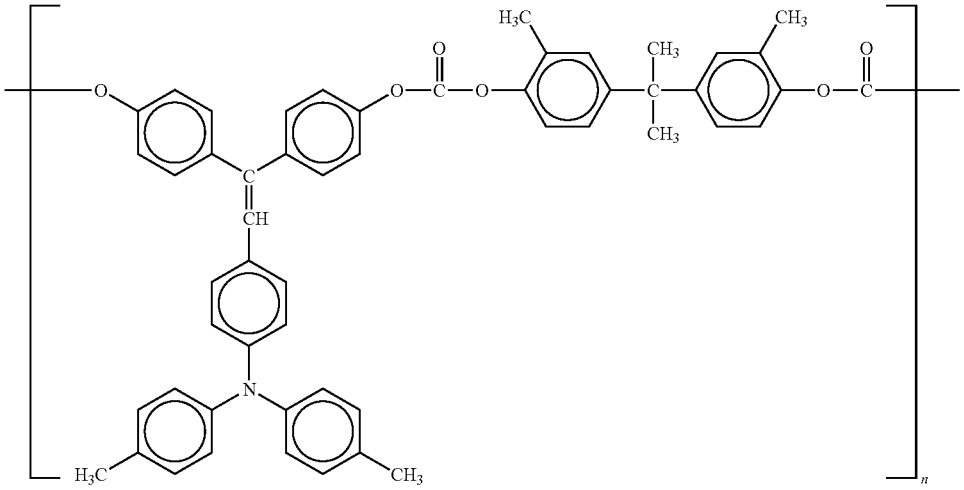

| Liquid of application for charge transport layer | |
|---|---|
| Charge transport polymer having the following chemical structure (weight average molecular weight: 135,000) | 10 parts |

Chemical formula 37

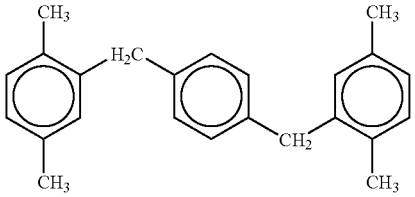

| | |
|---|---|
| Additive having the following chemical structure | 0.5 parts |
| Methylene chloride | 100 parts |

Example 27

The image bearing member of Example 27 was manufactured in the same manner as Example 1 except that the layer thickness of the charge transport layer was changed to 18 μm, and the liquid of application having the following composition for forming a protective layer was applied to the charge transport layer and dried to provide a protective layer having a thickness of 5 μm.

Chemical formula 38

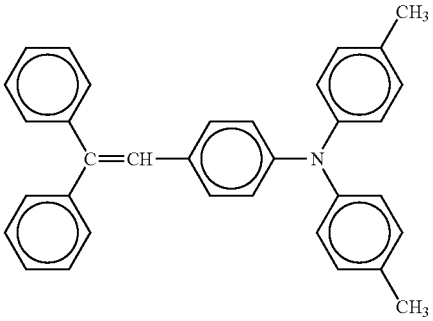

| Liquid of application for protective layer | |
|---|---|
| Polycarbonate (TS2050, manufactured by Teijin Chemicals Ltd.) (Viscosity average molecular weight: 50,000) | 10 parts |
| Charge transport material having the following chemical structure | 7 parts |
| aluminum particulate (Specific resistance: $2.5 \times 10^{12}$ Ωcm, average primary particle diameter: 0.4 μm) | 4 parts |
| cyclohexanone | 500 parts |
| tetrahydrofuran | 150 parts |

Example 28

The image bearing member of Example 28 was manufactured in the same manner as Example 27 except that the aluminum particulates in the liquid of application for forming a protective layer were changed to the following.

titanium oxide particulate (Specific resistance: $1.5\times10^{10}$ Ωcm, average primary particle diameter: 0.5 μm) 4 parts Example 29

The image bearing member of Example 29 was manufactured in the same manner as Example 27 except that the aluminum particulates in the liquid of application for forming a protective layer were changed to the following.

tin oxide-antimony oxide powder (Specific resistance: $10^6$ Ωcm, average primary particle diameter: 0.4 μm) 4 parts Example 30

The image bearing member of Example 30 was manufactured in the same manner as Example 1 except that the layer thickness of the charge transport layer was changed to 18 μm, and the liquid of application having the following composition for forming a protective layer was applied to the charge transport layer and dried to provide a protective layer having a thickness of 5 μm.

| Liquid of application for protective layer | |
|---|---|
| Methyltrimethoxysilane | 100 parts |
| 3% acetic acid | 20 parts |
| charge transport compound having the following chemical structure | 35 parts |
| anti-oxidation agent (SANOL LS2626, manufactured by Sarikyo Chemicals Co., Ltd.) | 1 part |
| curative agent (dibutyl tin acetate) | 1 part |
| 2-prpanol | 200 parts |

Chemical formula 39

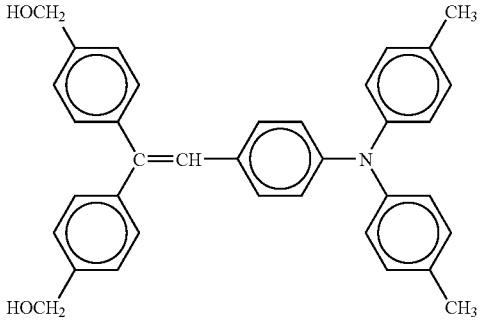

Example 31

The image bearing member of Example 31 was manufactured in the same manner as Example 1 except that the layer thickness of the charge transport layer was changed to 18 μm, the liquid of application having the following composition for forming a protective layer was applied to the charge transport layer and naturally dried for 20 minutes and the applied layer was hardened by optical irradiation under the following condition to provide a protective layer having a thickness of 5 μm.

Optical Irradiation Condition

Metal halide lamp: 160 W/cm

Irradiation distance: 120 mm

Irradiation power: 500 mW/cm$^2$

Irradiation time: 60 seconds

| | |
|---|---|
| polymeric radical compound having one functional group with a charge transport structure and having the following chemical structure | 10 parts |
| optical polymerization initiator (1-hydroxy-cyclohexyl-phenyl-keton, IRGACUPE® 184, manufactured by Ciba Specialty Chemicals Inc.) | 1 part |
| tetrahydrofuran | 100 parts |

-continued

Chemilca formula 40

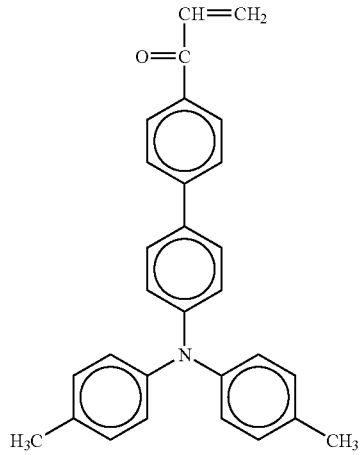

For the image bearing members manufactured in Examples 1 and 26 to 31 as described above, the duration test mentioned above was performed. That is, all the devices were removed from the image forming apparatus illustrated in FIG. 12 except for the laser diode (LD) as the image irradiation light source having a wavelength of 780 nm (image writing by a polygon mirror), a charger taking scorotron system as a charging device with the charging condition of DC bias of −1,300 V) and a discharging lamp. The duration test as mentioned above using a chart having a writing ratio of 6% was performed for 96 hours on end for the remodeled image forming apparatus. Thereafter, the image bearing member was removed and attached to a non-remodeled image forming apparatus (Imagio Neo 1050Pro, manufactured by Ricoh Co., Ltd.). Then white solid and half tone images were output and evaluated for image density, background fouling, the occurrence of fouling at the top end, and moire. The images were scaled in the following 4 ranks: E: Excellent, G: Good, F: Fair and P: Poor. Thereafter, using the non-remodeled image forming apparatus (Imagio Neo 1050Pro, manufactured by Ricoh Co., Ltd.), the abrasion amount of the photosensitive layer (the protective layer, if present) after 300,000 prints was measured. The results are shown in Table 7.

TABLE 7

| | Image density | Background fouling | Fouling at top end | Moire | Amount of abrasion (μm) |
|---|---|---|---|---|---|
| Example 1 | E | E | E | E | 4.7 |
| Example 26 | E | E | E | E | 2.6 |
| Example 27 | E | E | E | E | 1.6 |
| Example 28 | E | E | E | E | 1.4 |
| Example 29 | E | E | E | E | 1.6 |
| Example 30 | E | E | E | E | 0.9 |
| Example 31 | E | E | E | E | 0.2 |

Examples 32 to 35 and Comparative examples 13 to 16

The image bearing members of Examples 32 to 35 and Comparative Examples 1 to 4 were manufactured in the same manner as in Examples 1 to 4 and Comparative Examples 1 to 4 except that the electroconductive substrate was changed to an aluminum cylinder (JIS 1050) having a diameter of 30 mm.

The image bearing members manufactured above were prepared 4 of each and installed in the process cartridges illustrated in FIG. 14 for use in an image forming apparatus. The process cartridges were installed in the full color tandem image forming apparatus illustrated in FIG. 13. A semi-conductor laser (image writing by polygon mirror) having a wavelength of 780 nm was used as the image irradiation light source. The charging device was disposed in the vicinity of the image bearing member by winding an insulation tape having a thickness of 50 μm around the non-image formation portions at both ends of the charging roller. The DC bias of −900 V and AC bias (Vpp (peak to peak): 1.9 kV; frequency: 1.0 kHz) were overlapped and the developing bias was set to be −650 V. The process cartridges including each of the image bearing members contained the same developer and were respectively attached to yellow station, magenta station, cyan station, and black station. Images were repetitively output for each station at 28° C. at 75% RH while rotating each station per 10,000 images to form 40,000 images in total. Thereafter the images were evaluated.

The images were scaled in the following 4 ranks: E: Excellent, G: Good while slight deterioration is observed in images with no practical problem, I: Inferior; Apparently image deficiency is observed; and B: Bad; image deficiency has a significant adversary impact and the image quality is extremely inferior. The results are shown in Table 8.

TABLE 8

| | Image density | Background fouling | Fouling at top end | Moire |
|---|---|---|---|---|
| Example 32 | E | E | E | E |
| Example 33 | E | E | E | E |
| Example 34 | E | G | E | E |
| Example 35 | E | E | E | G |
| Comparative Example 13 | E | B | E | E |
| Comparative Example 14 | E | I | E | B |
| Comparative Example 15 | B | I | G | E |
| Comparative Example 16 | E | E | B | E |

As seen in Table 8, when the charge blocking layer and the moiré prevention layer of the present invention are provided, it is possible to stably form images without deterioration of image density, background fouling, fouling at top end and moiré even after repetitive use in a full color image forming apparatus.

Another liquid dispersion for forming a charge blocking layer was prepared as follows.

| Liquid dispersion for forming charge blocking layer | |
|---|---|
| N-methoxymethylized nylon (resin) | 6.4 parts |
| tartaric acid | 0.2 parts |
| methanol | 70 parts |
| n-butanol | 30 parts |

N-methoxymethylized nylon, i.e., resin, was dissolved in a solvent having the ratio mentioned above to obtain a liquid dispersion for forming a charge blocking layer.

| | |
|---|---|
| Titanium oxide (purity: 99.8%) | 70 parts |
| Alkyd resin (BEKKOLIGHT ® M6401-50-S: solid portion 50%, manufactured by Dainippon Ink and Chemicals, Incorporated.) | 14 parts |
| Melamine resin (SUPER BECKAMINE G-821-60 (solid portion 60%, manufactured by Dainippon Ink and Chemicals, Incorporated.) | |
| 2-butanone | 100 parts |
| Liquid of application for forming a charge transport layer polycarbonate (TS2050, manufactured by Teijin Chemicals Ltd.) | 10 parts |
| charge transport polymer chemical structure | 7 parts |
| tetrahydrofuran | 80 parts |

Example 36

The liquid of application mentioned above for forming a charge blocking layer, the liquid of application mentioned above for forming a moiré prevention layer, the liquid of application 2 mentioned above for forming a charge generating layer and the liquid of application for a charge transport layer were applied to an aluminum cylinder (JIS1050) having a diameter of 100 mm in this order. Subsequent to drying, a charge blocking layer having a thickness of 1.0 μm, a moiré prevention layer having a thickness of 3.5 μm, a charge generating layer having a thickness of 0.3 μm and a charge transport layer having a thickness of 2.5 μm were formed to obtain an image bearing member.

Example 37

The image bearing member of Example 37 was manufactured in the same manner as in Example 36 except that the liquid of application for forming a charge blocking layer was changed to the following:

| Liquid of application for forming a charge blocking layer | |
|---|---|
| N-methoxymethylized nylon (resin) | 6.4 parts |
| maleic acid | 0.2 parts |
| methanol | 70 parts |
| n-butanol | 20 parts |
| deionized water | 10 parts |

Example 38

The image bearing member of Example 38 was manufactured in the same manner as in Example 36 except that the liquid of application for forming a charge blocking layer was changed to the following:

| Liquid of application for forming charge blocking layer | |
|---|---|
| N-methoxymethylized nylon (resin) | 6.4 parts |
| fumaric acid | 0.2 parts |
| methanol | 70 parts |
| n-butanol | 20 parts |
| deionized water | 10 parts |

Example 39

The image bearing member of Example 39 was manufactured in the same manner as in Example 36 except that the liquid of application for forming a charge blocking layer was changed to the following:

| Liquid of application for forming charge blocking layer | |
|---|---|
| N-methoxymethylized nylon (resin) | 6.4 parts |
| succinic acid | 0.2 parts |
| methanol | 70 parts |
| n-butanol | 20 parts |
| deionized water | 10 parts |

Example 40

The image bearing member of Example 40 was manufactured in the same manner as in Example 36 except that the liquid of application for forming a charge blocking layer was changed to the following:

| Liquid of application for forming charge blocking layer | |
|---|---|
| N-methoxymethylized nylon (resin) | 6.4 parts |
| malic acid | 0.2 parts |
| methanol | 70 parts |
| n-butanol | 20 parts |
| deionized water | 10 parts |

Example 41

The image bearing member of Example 41 was manufactured in the same manner as in Example 36 except that the liquid of application for forming a charge blocking layer was changed to the following:

| Liquid of application for forming charge blocking layer | |
|---|---|
| N-methoxymethylized nylon (resin) | 6.4 parts |
| adipic acid | 0.2 parts |
| methanol | 70 parts |
| n-butanol | 20 parts |
| deionized water | 10 parts |

Example 42

The image bearing member of Example 42 was manufactured in the same manner as in Example 36 except that the liquid of application for forming a charge blocking layer was changed to the following:

| Liquid of application for forming charge blocking layer | |
|---|---|
| N-methoxymethylized nylon (resin) | 6.4 parts |
| tricarballylic acid | 0.2 parts |
| methanol | 70 parts |
| n-butanol | 20 parts |
| deionized water | 10 parts |

Example 43

The image bearing member of Example 43 was manufactured in the same manner as in Example 36 except that the liquid of application for forming a charge blocking layer was changed to the following:

| Liquid of application for forming charge blocking layer | |
|---|---|
| N-methoxymethylized nylon (resin) | 6.4 parts |
| citric acid | 0.2 parts |
| methanol | 70 parts |
| n-butanol | 20 parts |
| deionized water | 10 parts |

Comparative Example 17

The image bearing member of Comparative Example 17 was manufactured in the same manner as in Example 36 except that the charge blocking layer was not provided.

Comparative Example 18

The image bearing member of Comparative Example 18 was manufactured in the same manner as in Example 36 except that the moire prevention layer was not provided.

Comparative Example 19

The image bearing member of Comparative Example 19 was manufactured in the same manner as in Example 36 except that the order of application of the charge blocking layer and the moire prevention layer was reversed.

Example 44

The image bearing member of Example 44 was manufactured in the same manner as in Example 36 except that the layer thickness of the charge blocking layer was changed to 0.5 μm.

Example 45

The image bearing member of Example 45 was manufactured in the same manner as in Example 36 except that the layer thickness of the charge blocking layer was changed to 2.0 μm.

Comparative Example 20

The image bearing member of Comparative Example 20 was manufactured in the same manner as in Example 36 except that the layer thickness of the charge blocking layer was changed to 0.25 μm.

Comparative Example 21

The image bearing member of Comparative Example 21 was manufactured in the same manner as in Example 36 except that the layer thickness of the charge blocking layer was changed to 3.0 μm.

Examples 46 to 51 and Comparative Examples 22 and 23

The image bearing members of Examples 46 to 51 and Comparative Examples 22 and 23 were manufactured in the same manner as in Example 36 except that the liquid of application for forming a charge blocking layer and the liquid of application for forming a moire prevention layer were changed as in the following table 12.

TABLE 12

| | Charge blocking layer Content of aliphatic carboxylic acid (parts by weight) | Moire prevention layer Purity of titanium oxide |
|---|---|---|
| Example 46 | 0.05 | 99.7 |
| Example 47 | 0.25 | 99.6 |
| Example 48 | 0.5 | 99.8 |
| Example 49 | 0.25 | 99.0 |
| Example 50 | 0.01 | 99.8 |
| Example 51 | 1.0 | 99.5 |
| Comparative Example 22 | Nil | 99.7 |
| Comparative Example 23 | 0.25 | 97.6 |

Examples 36 to 51 and Comparative Examples 17 to 23

To find out the impact of the fatigue caused during repetitive use of the image bearing members manufactured as described above, all the devices were removed from the image forming apparatus illustrated in FIG. 12 except for the laser diode (LD) as the image irradiation light source having a wavelength of 780 nm (image writing by a polygon mirror), a charger taking scorotron system as a charging device with the charging condition of DC bias of −1,300 V) and a discharging lamp. A duration test using a chart having a writing ratio of 6% was performed for 96 hours on end for the remodeled image forming apparatus. Thereafter, the image bearing member was removed and attached to a non-remodeled image forming apparatus (Imagio Neo1050Pro, Manufactured by Ricoh Co., Ltd.). Then white solid and half tone images were output and evaluated for image density, background fouling, the occurrence of fouling at the top end, and moire. The images were scaled in the following 4 ranks: E: Excellent, G: Good, F: Fair and P: Poor. The results are shown in Table 5.

As seen in Table 13, the image bearing member of the present invention can stably form images without deterioration of image density, background fouling, fouling at top end and moiré.

TABLE 13

| | Image density | Background fouling | Fouling at top end | Moire |
|---|---|---|---|---|
| Example 36 | E | E | E | E |
| Example 37 | E | E | E | E |
| Example 38 | E | E | E | E |
| Example 39 | E | E | E | E |
| Example 40 | E | E | E | E |
| Example 41 | E | E | E | E |
| Example 42 | E | E | E | E |
| Example 43 | E | E | E | E |
| Example 44 | E | E | E | E |
| Example 45 | E | E | E | E |
| Example 46 | E | E | E | E |

TABLE 13-continued

| | Image density | Background fouling | Fouling at top end | Moire |
|---|---|---|---|---|
| Example 47 | E | E | E | E |
| Example 48 | E | E | E | E |
| Example 49 | G | G | G | E |
| Example 50 | E | G | G | E |
| Example 51 | G | E | E | E |
| Comparative Example 17 | E | P | E | E |
| Comparative Example 18 | E | F | E | P |
| Comparative Example 19 | P | F | G | E |
| Comparative Example 20 | E | F | E | E |
| Comparative Example 21 | F | E | E | E |
| Comparative Example 22 | E | E | P | E |
| Comparative Example 23 | F | F | P | E |

Example 52

The image bearing member of the Example 52 was manufactured in the same manner as in Example 36 except that the liquid of application for forming a moiré prevention layer was changed to the following.

| Liquid of application for forming moiré prevention layer | |
|---|---|
| Titanium oxide (specific surface area: 6.8 $m^2/g$ purity: 99.9%) | 91 parts |
| Alkyd resin (BEKKOLIGHT ® M6401-50-S: solid portion 50%, manufactured by Dainippon Ink and Chemicals, Incorporated.) | 14 parts |
| Melamine resin (SUPER BECKAMINE G-821-60 (solid portion 60%, manufactured by Dainippon Ink and Chemicals, Incorporated.) | |
| 2-butanone | 125 parts |

Example 53

The image bearing member of the Example 53 was manufactured in the same manner as in Example 36 except that the liquid of application for forming a moiré prevention layer was changed to the following.

| Liquid of application for forming moiré prevention layer | |
|---|---|
| Titanium oxide (specific surface area: 6.8 $m^2/g$ purity: 99.9%) | 52 parts |
| Alkyd resin (BEKKOLIGHT ® M6401-50-S: solid portion 50%, manufactured by Dainippon Ink and Chemicals, Incorporated.) | 14 parts |
| Melamine resin (SUPER BECKAMINE G-821-60 (solid | |

-continued

| Liquid of application for forming moiré prevention layer | |
|---|---|
| portion 60%, manufactured by Dainippon Ink and Chemicals, Incorporated.) | |
| 2-butanone | 78 parts |

Comparative Example 24

The image bearing member of the Comparative Example 24 was manufactured in the same manner as in Example 36 except that the liquid of application for forming a moiré prevention layer was changed to the following.

| Liquid of application for forming moiré prevention layer | |
|---|---|
| Titanium oxide (specific surface area: 6.8 $m^2/g$ purity: 99.9%) | 104 parts |
| Alkyd resin (BEKKOLIGHT ® M6401-50-S: solid portion 50%, manufactured by Dainippon Ink and Chemicals, Incorporated.) | 14 parts |
| Melamine resin (SUPER BECKAMINE G-821-60 (solid portion 60%, manufactured by Dainippon Ink and Chemicals, Incorporated.) | |
| 2-butanone | 142 parts |

Comparative Example 25

The image bearing member of the Comparative Example 25 was manufactured in the same manner as in Example 36 except that the liquid of application for forming a moiré prevention layer was changed to the following.

| Liquid of application for forming moiré prevention layer | |
|---|---|
| Titanium oxide (specific surface area: 6.8 $m^2/g$ purity: 99.9%) | 104 parts |
| Alkyd resin (BEKKOLIGHT ® M6401-50-S: solid portion 50%, manufactured by Dainippon Ink and Chemicals, Incorporated.) | 14 parts |
| Melamine resin (SUPER BECKAMINE G-821-60 (solid portion 60%, manufactured by Dainippon Ink and Chemicals, Incorporated.) | |
| 2-butanone | 62 parts |

Examples 52 to 53 and Comparative Examples 24 to 25

The image bearing members manufactured as described above were cur and the cut faces thereof were observed with an electron microscope (S-4200, manufactured by Hitachi Ltd.,) with a magnifying power of 10,000 to obtain the content ratio of titanium oxide in the moire prevention layer.

To find out the impact of the fatigue caused during repetitive use of the image bearing members manufactured as described above, all the devices were removed from the image forming apparatus illustrated in FIG. 12 except for the laser diode (LD) as the image irradiation light source having a wavelength of 780 nm (image writing by a polygon mirror), a charger taking scorotron system as a charging device with the charging condition of DC bias of −1,300 V) and a discharging lamp. A duration test using a chart having a writing ratio of 6% was performed for 96 hours on end for the remodeled image forming apparatus. Thereafter, the image bearing member was removed and attached to a non-remodeled image forming apparatus (Imagio Neo1050Pro, Manufactured by Ricoh Co., Ltd.). Then white solid and half tone images were output and evaluated for image density, background fouling, the occurrence of fouling at the top end, and moire. The images were scaled in the following 4 ranks: E: Excellent, G: Good, F: Fair and P: Poor. The results are shown in Table 14.

TABLE 14

| | Image density | Background fouling | Fouling at top end | Moire |
|---|---|---|---|---|
| Example 52 | E | E | E | E |
| Example 53 | E | E | G | E |
| Comparative Example 24 | P | E | E | E |
| Comparative Example 25 | E | F | P | G |

As seen in Table 145, the image bearing member of the present invention can stably form images without deterioration of image density, background fouling, fouling at top end and moiré.

Example 54

The image bearing member of the Example 54 was manufactured in the same manner as in Example 36 except that the liquid of application for forming a moiré prevention layer was changed to the following.

| Liquid of application for forming moiré prevention layer | |
|---|---|
| Titanium oxide (specific surface area: 6.8 $m^2/g$ purity: 99.9%) | 70 parts |
| Alkyd resin (BEKKOLIGHT ® M6401-50-S: solid portion 50%, manufactured by Dainippon Ink and Chemicals, Incorporated.) | 12 parts |
| Melamine resin (SUPER BECKAMINE G-821-60 (solid portion 60%, manufactured by Dainippon Ink and Chemicals, Incorporated.) | |
| 2-butanone | 100 parts |

Example 55

The image bearing member of the Example 55 was manufactured in the same manner as in Example 36 except that the liquid of application for forming a moiré prevention layer was changed to the following.

| Liquid of application for forming moiré prevention layer | |
|---|---|
| Titanium oxide (specific surface area: 6.8 $m^2/g$ purity: 99.9%) | 70 parts |
| Alkyd resin (BEKKOLIGHT ® M6401-50-S: solid portion 50%, manufactured by Dainippon Ink and Chemicals, Incorporated.) | 20 parts |
| Melamine resin (SUPER BECKAMINE G-821-60 (solid portion 60%, manufactured by Dainippon Ink and Chemicals, Incorporated.) | |
| 2-butanone | 100 parts |

Comparative Example 26

The image bearing member of the Comparative Example 26 was manufactured in the same manner as in Example 36 except that the liquid of application for forming a moiré prevention layer was changed to the following.

| Liquid of application for forming moiré prevention layer | |
|---|---|
| Titanium oxide (specific surface area: 6.8 $m^2/g$ purity: 99.9%) | 70 parts |
| Alkyd resin (BEKKOLIGHT ® M6401-50-S: solid portion 50%, manufactured by Dainippon Ink and Chemicals, Incorporated.) | 12 parts |
| Melamine resin (SUPER BECKAMINE G-821-60 (solid portion 60%, manufactured by Dainippon Ink and Chemicals, Incorporated.) | |
| 2-butanone | 100 parts |

Comparative Example 27

The image bearing member of the Comparative Example 27 was manufactured in the same manner as in Example 36 except that the liquid of application for forming a moiré prevention layer was changed to the following.

| Liquid of application for forming moiré prevention layer | |
|---|---|
| Titanium oxide (specific surface area: 6.8 $m^2/g$ purity: 99.9%) | 70 parts |
| Alkyd resin (BEKKOLIGHT ® M6401-50-S: solid portion 50%, manufactured by Dainippon Ink and Chemicals, Incorporated.) | 22 parts |
| Melamine resin (SUPER BECKAMINE G-821-60 (solid portion 60%, manufactured by Dainippon Ink and Chemicals, Incorporated.) | |
| 2-butanone | 100 parts |

TABLE 15

| | Image density | Background fouling | Fouling at top end | Moire |
|---|---|---|---|---|
| Example 54 | G | E | E | E |
| Example 55 | E | G | G | E |
| Comparative Example 26 | P | E | E | E |
| Comparative Example 27 | E | F | F | E |

As seen in Table 15, the image bearing member of the present invention can stably form images without deterioration of image density, background fouling, fouling at top end and moiré.

Example 56

The image bearing member of the Example 56 was manufactured in the same manner as in Example 36 except that the liquid of application for forming a moiré prevention layer was changed to the following.

| Liquid of application for forming moiré prevention layer | |
|---|---|
| Titanium oxide T1 (specific surface area: 6.5 $m^2/g$ purity: 99.8%) | 40 parts |
| Titanium oxide T2 (specific surface area: 21.0 $m^2/g$ purity: 99.7%) | 30 parts |
| Alkyd resin (BEKKOLIGHT ® M6401-50-S: solid portion 50%, manufactured by Dainippon Ink and Chemicals, Incorporated.) | 14 parts |
| Melamine resin (SUPER BECKAMINE G-821-60 (solid portion 60%, manufactured by Dainippon Ink and Chemicals, Incorporated.) | |
| 2-butanone | 100 parts |

Examples 57 to 65, Comparative Example 28, ??? 1 to 6

The image bearing members of Examples 57 to 65, Comparative Example 28 and ??? were manufactured in the same manner as in Example 36 except that the liquid of application for forming a moire prevention layer were changed as in the following table.

TABLE 16

| | Titanium oxide T1 | | Titanium oxide T2 | | |
|---|---|---|---|---|---|
| | Specific surface area ($m^2/g$) | Purity (%) | Specific surface area ($m^2/g$) | Purity (%) | Mixing ratio T2/(T1 + T2) |
| Example 57 | 5.0 | 99.7 | 21.0 | 99.7 | 0.43 |
| Example 58 | 7.8 | 99.7 | 21.0 | 99.7 | 0.43 |
| Example 59 | 6.5 | 99.8 | 28.5 | 99.6 | 0.43 |
| Example 60 | 6.5 | 99.8 | 33.0 | 99.8 | 0.43 |
| Example 61 | 6.3 | 99.2 | 21.0 | 99.7 | 0.43 |
| Example 62 | 6.5 | 99.8 | 22.5 | 99.0 | 0.43 |
| Example 63 | 6.3 | 99.2 | 22.5 | 99.0 | 0.43 |
| Example 64 | 6.5 | 99.8 | 21.0 | 99.7 | 0.25 |
| Example 65 | 6.5 | 99.8 | 21.0 | 99.7 | 0.6 |
| ??? 1 | 4.2 | 99.6 | 21.0 | 99.7 | 0.43 |
| ??? 2 | 9.9 | 99.5 | 21.0 | 99.7 | 0.43 |
| ??? 3 | 6.5 | 99.8 | 9.9 | 99.5 | 0.43 |
| ??? 4 | 6.5 | 99.8 | 38.5 | 99.4 | 0.43 |
| Comparative Example 28 | 6.3 | 98.2 | 22.5 | 99.7 | 0.43 |
| ??? 5 | 6.5 | 99.8 | 21.0 | 99.7 | 0.15 |
| ??? 6 | 6.5 | 99.8 | 21.0 | 99.7 | 0.7 |

To find out the impact of the fatigue caused during repetitive use of the image bearing members manufactured as described above, all the devices were removed from the image forming apparatus illustrated in FIG. 13 except for the laser diode (LD) as the image irradiation light source having a wavelength of 780 nm (image writing by a polygon mirror), a charger taking scorotron system as a charging device with the charging condition of DC bias of −1,300 V) and a discharging lamp. A duration test using a chart having a writing ratio of 6% was performed for 96 hours on end for the remodeled image forming apparatus. Thereafter, the image bearing member was removed and attached to a non-remodeled image forming apparatus (Imagio Neo1050Pro, Manufactured by Ricoh Co., Ltd.). Then white solid and half tone images were output and evaluated for image density, background fouling, the occurrence of fouling at the top end, and moire. The images were scaled in the following 4 ranks: E: Excellent, G: Good, F: Fair and P: Poor. The results are shown in Table 17.

TABLE 17

| | Image density | Background fouling | Fouling at top end | Moire |
|---|---|---|---|---|
| Example 57 | E | E | E | E |
| Example 58 | E | E | E | E |
| Example 59 | E | E | E | E |
| Example 60 | E | E | E | E |
| Example 61 | E | E | E | E |
| Example 62 | E | E | E | E |
| Example 63 | E | E | G | E |
| Example 64 | E | E | E | E |
| Example 65 | E | E | E | E |
| ??? 1 | E | G | G | E |
| ??? 2 | G | E | E | E |
| ??? 3 | E | E | G | E |
| ??? 4 | G | E | E | E |
| Comparative Example 28 | E | F | P | E |
| ??? 5 | E | E | G | E |
| ??? 6 | G | E | E | G |

As seen in Table 17, the image bearing member of the present invention can stably form images without deterioration of image density, background fouling, fouling at top end and moiré.

Example 66

The image bearing member of Example 66 was manufactured in the same manner as in Example 36 except that the liquid of application for forming a charge generating layer was changed from the liquid of application 2 for forming a charge generating layer to the liquid of application 1 for forming a charge generating layer.

Example 67

The image bearing member of Example 67 was manufactured in the same manner as in Example 36 except that the liquid of application for forming a charge generating layer was changed from the liquid of application 2 for forming a charge generating layer to the liquid of application 3 for forming a charge generating layer.

Example 68

The image bearing member of Example 68 was manufactured in the same manner as in Example 36 except that the liquid of application for forming a charge generating layer was changed from the liquid of application 2 for forming a charge generating layer to the liquid of application 4 for forming a charge generating layer.

Example 69

The image bearing member of Example 69 was manufactured in the same manner as in Example 36 except that the liquid of application for forming a charge generating layer was changed from the liquid of application 2 for forming a charge generating layer to the liquid of application 5 for forming a charge generating layer.

Example 70

The image bearing member of Example 70 was manufactured in the same manner as in Example 36 except that the liquid of application for forming a charge generating layer was changed from the liquid of application 2 for forming a charge generating layer to the liquid of application 6 for forming a charge generating layer.

Example 71

The image bearing member of Example 71 was manufactured in the same manner as in Example 36 except that the liquid of application for forming a charge generating layer was changed from the liquid of application 2 for forming a charge generating layer to the liquid of application 7 for forming a charge generating layer.

Example 72

The image bearing member of Example 72 was manufactured in the same manner as in Example 36 except that the liquid of application for forming a charge generating layer was changed from the liquid of application 2 for forming a charge generating layer to the liquid of application 8 for forming a charge generating layer.

Example 73

The image bearing member of Example 73 was manufactured in the same manner as in Example 36 except that the liquid of application for forming a charge generating layer was changed from the liquid of application 2 for forming a charge generating layer to the liquid of application 9 for forming a charge generating layer.

Example 74

The image bearing member of Example 74 was manufactured in the same manner as in Example 36 except that the liquid of application for forming a charge generating layer was changed from the liquid of application 2 for forming a charge generating layer to the liquid of application 10 for forming a charge generating layer.

Example 75

The image bearing member of Example 75 was manufactured in the same manner as in Example 36 except that the liquid of application for forming a charge generating layer was changed from the liquid of application 2 for forming a charge generating layer to the liquid of application 11 for forming a charge generating layer.

Example 76

The image bearing member of Example 76 was manufactured in the same manner as in Example 36 except that the liquid of application for forming a charge generating layer was changed from the liquid of application 2 for forming a charge generating layer to the liquid of application 12 for forming a charge generating layer.

Example 77

The image bearing member of Example 77 was manufactured in the same manner as in Example 36 except that the liquid of application for forming a charge generating layer was changed from the liquid of application 2 for forming a charge generating layer to the liquid of application 13 for forming a charge generating layer.

Example 78

The image bearing member of Example 78 was manufactured in the same manner as in Example 36 except that the liquid of application for forming a charge generating layer was changed from the liquid of application 2 for forming a charge generating layer to the liquid of application 15 for forming a charge generating layer.

For the image bearing members manufactured in Examples 36 and 66 to 78 as described above, the duration test mentioned above was performed. That is, all the devices were removed from the image forming apparatus illustrated in FIG. 12 except for the laser diode (LD) as the image irradiation light source having a wavelength of 780 nm (image writing by a polygon mirror), a charger taking scorotron system as a charging device with the charging condition of DC bias of −1,300 V) and a discharging lamp. The duration test as mentioned above using a chart having a writing ratio of 6% was performed for 96 hours on end for the remodeled image forming apparatus. Thereafter, the image bearing member was removed and attached to a non-remodeled image forming apparatus (Imagio Neo1050Pro, Manufactured by Ricoh Co., Ltd.). Then white solid and half tone images were output and evaluated for image density, background fouling, the occurrence of fouling at the top end, and moire. The images were scaled in the following 4 ranks: E: Excellent, G: Good, F: Fair and P: Poor. The results are shown in Table 18.

TABLE 18

| | Liquid of application for forming charge generating layer | Image density | Background fouling | Fouling at top end | Moire |
|---|---|---|---|---|---|
| Example 36 | Liquid of application 2 | E | E | E | E |
| Example 66 | Liquid of application 1 | E | G | E | E |
| Example 67 | Liquid of application 3 | G | G | E | E |
| Example 68 | Liquid of application 4 | G | F | E | E |
| Example 69 | Liquid of application 5 | G | G | E | E |
| Example 70 | Liquid of application 6 | G | G | E | E |
| Example 71 | Liquid of application 7 | G | G | E | E |
| Example 72 | Liquid of application 8 | G | G | E | E |
| Example 73 | Liquid of application 9 | G | F | E | E |
| Example 74 | Liquid of application 10 | E | E | E | E |
| Example 75 | Liquid of application 11 | E | E | E | E |
| Example 76 | Liquid of application 12 | E | G | E | E |
| Example 77 | Liquid of application 13 | G | F | E | E |
| Example 78 | Liquid of application 15 | F | F | E | E |

As seen in table 18, it is possible to manufacture an image bearing member suitable for actual use regardless of materials for use in a charge generating layer by providing a charge blocking layer and the moiré prevention layer of the charge blocking layer.

However, when an azo pigment is used as in Example 78, the image density deteriorates after repetitive use in comparison with other image bearing members (all of which use titanyl phthalocyanine).

In addition, when titanyl phthalocyanine having a specific crystal type (crystal type of titnaly phthalocyanine of Synthesis Example 1) is used, the characteristics are excellent.

Further, when the titanyl phthalocyanine having a crystal type of Synthesis type 1 is used, it is found that the anti-background fouling characteristics after repetitive use are especially good as seen in Examples 36, 74 and 75 by making the primary particle size not greater than 0.25 μm. As methods of regulating the primary particle size to not greater than 0.25 μm, there are a method of reducing the particle size during synthesis and a method of removing coarse particles after dispersion, both of which are confirmed to be effective.

Example 79

The image bearing member of Example 79 was manufactured in the same manner as Example 36 except that the liquid of application for forming a charge generating layer was changed to the following composition.

| Liquid of application for forming charge transport layer | |
|---|---|
| Charge transport polymer represented by Chemical formula 36 (weight average molecular weight: 135,000) | 10 parts |
| Additive represented by Chemical formula 36 | 0.5 parts |
| Methylene chloride | 100 parts |

Example 80

The image bearing member of Example 80 was manufactured in the same manner as Example 36 except that the layer thickness of the charge transport layer was changed to 18 μm, and the liquid of application having the following composition for forming a protective layer was applied to the charge transport layer and dried to provide a protective layer having a thickness of 5 μm.

| Liquid of application for forming protective layer | |
|---|---|
| Polycarbonate (TS2050, manufactured by Teijin Chemicals Ltd.) (Viscosity average molecular weight: 50,000) | 10 parts |
| Charge transport material represented by Chemical formula 38 | 7 parts |
| aluminum particulate (Specific resistance: $2.5 \times 10^{12}$ Ωcm, average primary particle diameter: 0.4 μm) | 4 parts |
| cyclohexanone | 500 parts |
| tetrahydrofuran | 150 parts |

Example 81

The image bearing member of Example 81 was manufactured in the same manner as Example 80 except that the aluminum particulates in the liquid of application for forming a protective layer were changed to the following.

titanium oxide particulate (Specific resistance: $1.5\times10^{10}$ Ωcm, average primary particle diameter: 0.5 μm) 4 parts Example 82

The image bearing member of Example 82 was manufactured in the same manner as Example 80 except that the aluminum particulates in the liquid of application for forming a protective layer were changed to the following.

tin oxide-antimony oxide powder (Specific resistance: $10^6$ Ωcm, average primary particle diameter: 0.4 μm) 4 parts Example 83

The image bearing member of Example 83 was manufactured in the same manner as Example 36 except that the layer thickness of the charge transport layer was changed to 18 μm, and the liquid of application having the following composition for forming a protective layer was applied to the charge transport layer and dried to provide a protective layer having a thickness of 5 μm.

| Liquid of application for forming protective layer | |
|---|---|
| Methyltrimethoxysilane | 100 parts |
| 3% acetic acid | 20 parts |
| charge transport compound represented by Chemical formual 39 | 35 parts |
| anti-oxidation agent (SANOL LS2626, manufactured by Sankyo Chemicals Co., Ltd.) | 1 part |
| curative agent (dibutyl tin acetate) | 1 part |
| 2-prpanol | 200 parts |

Example 84

The image bearing member of Example 84 was manufactured in the same manner as Example 36 except that the layer thickness of the charge transport layer was changed to 18 μm, the liquid of application having the following composition for forming a protective layer was applied to the charge transport layer and naturally dried for 20 minutes and the applied layer was hardened by optical irradiation under the following condition to provide a protective layer having a thickness of 5 μm.

Optical Irradiation Condition

Metal halide lamp: 160 W/cm

Irradiation distance: 120 mm

Irradiation power: 500 mW/$cm^2$

Irradiation time: 60 seconds

| Liquid of application for forming protective layer | |
|---|---|
| polymeric radical monomer having three functional groups without having a charge transport structure (trimethylol propane triacrylate (KAYARAD TMPTA, manufactured by Nippon Kayaku Co., Ltd.) molecular weight: 296, number of functional groups: 3 functional groups, molecular weight/number of functional groups = 99) | |
| polymeric radical compound having one functional group with a charge transport structure and represented by Chemical formula 40 | 10 parts |
| optical polymerization initiator (1-hydroxy-cyclohexyl-phenyl-keton, IRGACURE ® 184, manufactured by Ciba Specialty Chemicals Inc.) | 1 part |
| tetrahydrofuran | 100 parts |

For the image bearing members manufactured in Examples 36 and 79 to 84 as described above, the duration test mentioned above was performed. That is, all the devices were removed from the image forming apparatus illustrated in FIG. 12 except for the laser diode (LD) as the image irradiation light source having a wavelength of 780 nm (image writing by a polygon mirror), a charger taking scorotron system as a charging device with the charging condition of DC bias of −1,300 V) and a discharging lamp. The duration test as mentioned above using a chart having a writing ratio of 6% was performed for 96 hours on end for the remodeled image forming apparatus. Thereafter, the image bearing member was removed and attached to a non-remodeled image forming apparatus (Imagio Neo 1050Pro, manufactured by Ricoh Co., Ltd.). Then white solid and half tone images were output and evaluated for image density, background fouling, the occurrence of fouling at the top end, and moire. The images were scaled in the following 4 ranks: E: Excellent, G: Good, F: Fair and P: Poor. Thereafter, using the non-remodeled image forming apparatus (Imagio Neo 1050Pro, manufactured by Ricoh Co., Ltd.), the abrasion amount of the photosensitive layer (the protective layer, if present) after 300,000 prints was measured. The results are shown in Table 7.

TABLE 19

| | Image density | Background fouling | Fouling at top end | Moire | Abrasion amount (μm) |
|---|---|---|---|---|---|
| Example 36 | E | E | E | E | 4.6 |
| Example 79 | E | E | E | E | 2.5 |
| Example 80 | E | E | E | E | 1.8 |
| Example 81 | E | E | E | E | 1.2 |
| Example 82 | E | E | E | E | 1.7 |
| Example 83 | E | E | E | E | 0.9 |
| Example 84 | E | E | E | E | 0.1 |

As seen in Table 19, when the charge blocking layer and the moiré prevention layer of the present invention are provided, it is possible to stably form images without deterioration of image density, background fouling, fouling at top end and moiré even after repetitive use in a full color image forming apparatus.

Examples 85 to 88 and Comparative Examples 22 to 31

The image bearing members of Examples 85 to 88 and Comparative Examples 22 to 31 were manufactured in the same manner as Examples 36 to 39 and Comparative Examples 17 to 20 except that the electroconductive substrate was changed to an aluminum cylinder (JIS 1050) having a diameter of 30 mm.

The image bearing members manufactured above were prepared 4 of each and installed in the process cartridges illustrated in FIG. 14 for use in an image forming apparatus. The process cartridges were installed in the full color tandem image forming apparatus illustrated in FIG. 13. A semi-conductor laser (image writing by polygon mirror) having a wavelength of 780 nm was used as the image irradiation light source. The charging device was disposed in the vicinity of the image bearing member by winding an insulation tape having a thickness of 50 μm around the non-image formation portions at both ends of the charging roller. The DC bias of −900 V and AC bias (Vpp (peak to peak): 1.9 kV; frequency: 1.0 kHz) were overlapped and the developing bias was set to be −650 V. The process cartridges including each of the image bearing members contained the same developer and were respectively attached to yellow station, magenta station, cyan station, and black station. Images were repetitively output for each station at 28° C. at 75% RH while rotating each station per 10,000 images to form 40,000 images in total. Thereafter the images were evaluated.

The images were scaled in the following 4 ranks: E: Excellent, G: Good while slight deterioration is observed in images with no practical problem, I: Inferior; Apparently image deficiency is observed; and B: Bad; image deficiency has a significant adversary impact and the image quality is extremely inferior. The results are shown in Table 20.

TABLE 20

| | Image density | Background fouling | Fouling at top end | Moire |
|---|---|---|---|---|
| Example 85 | E | E | E | E |
| Example 86 | E | E | E | E |
| Example 87 | E | E | E | E |
| Example 88 | E | E | E | E |
| Comparative Example 29 | E | B | E | E |
| Comparative Example 30 | E | I | E | B |
| Comparative Example 31 | B | I | G | E |
| Comparative Example 32 | E | I | G | E |

As seen in Table 20, when the charge blocking layer and the moiré prevention layer of the present invention are provided, it is possible to stably form images without deterioration of image density, background fouling, fouling at top end and moiré even after repetitive use in a full color image forming apparatus.

Finally, whether the lowest angle peak of 7.3° C. in Bragg angle characteristic to the titanyl phthalocyanine for use in the present application was the same as the lowest angle of 7.5° of a known material was checked.

Synthesis Example 10 of Pigment

The titanyl phthalocyanine of Synthesis Example 1 of pigment was obtained in the same manner as in Synthesis Example 1 of pigment except that the crystal conversion solvent was changed from methylene chloride to 2-butanone.

Figure 17:
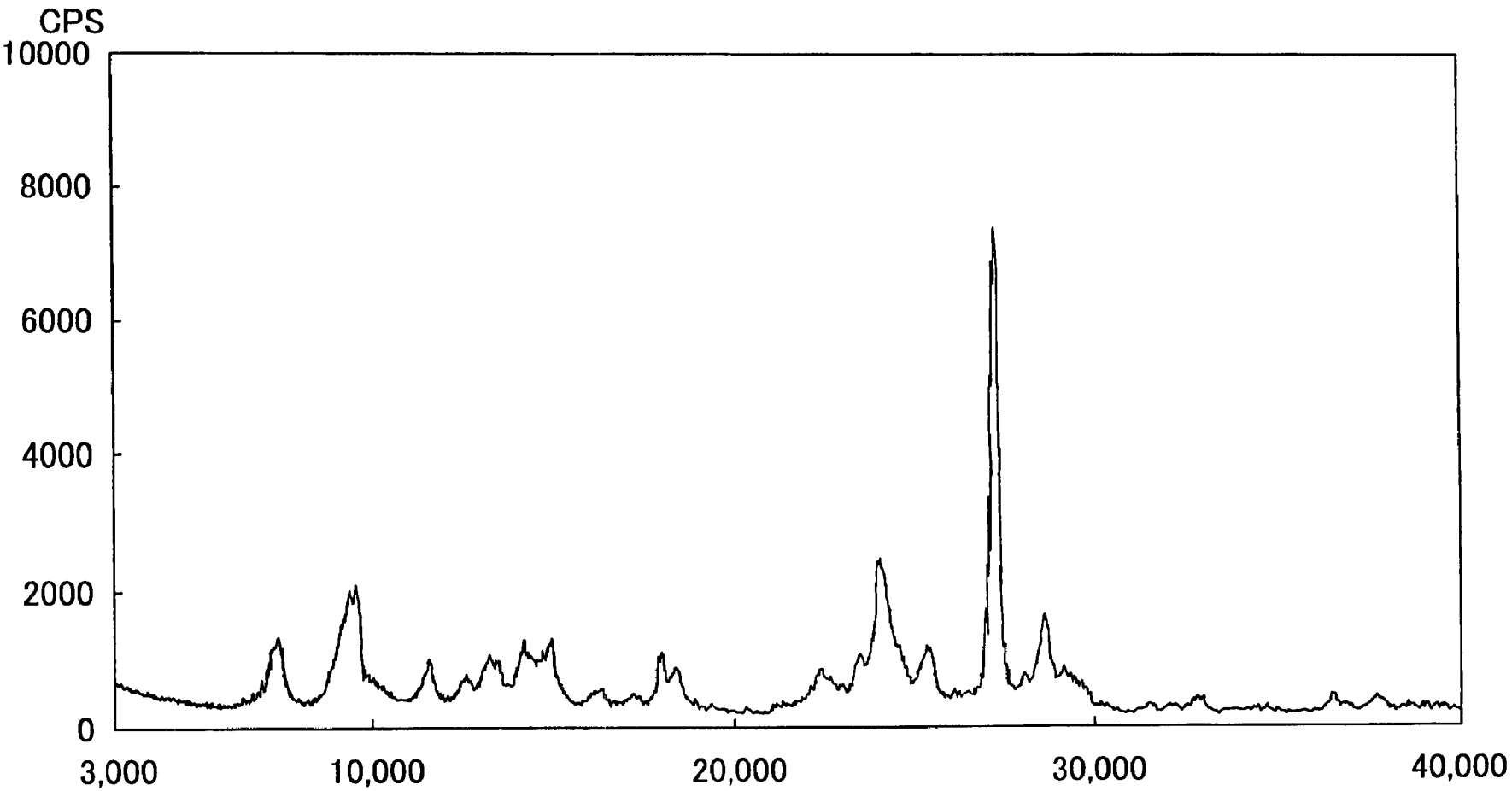
FIG. 17 is a graph illustrating X ray diffraction spectrum of the titanyl phthalocyanine crystal manufactured in Synthesis Example 10 of pigment described later.

As in Synthesis Example 1 of pigment, XD spectrum of the titanyl phthalocyanine obtained in Synthesis Example 10 of pigment was measured. The results are illustrated in FIG. 17. As seen in FIG. 17, it is found that the lowest peak angle in XD spectrum of the titanyl phthalocyanine manufactured in Synthesis Example 10 of pigment was 7.5°, which is different from that, i.e., 7.3°, of the titanyl phthalocyanine manufactured in Synthesis Example 1 of pigment.

Measuring Example 1

A pigment (having the maximum diffraction peak of 7.5°) manufactured in the same manner as described in JOP S61-239248 was added in an amount of 3% by weight to the pigment obtained in Synthesis Example 1 of pigment (having the lowest peak angle of 7.3°) and the mixture was mixed in a mortar. The X ray diffraction spectrum of the mixture was measured as described above. The X-ray diffraction spectrum of Measuring Example 1 is illustrated in FIG. 18.

Measuring Example 2

Figure 19:
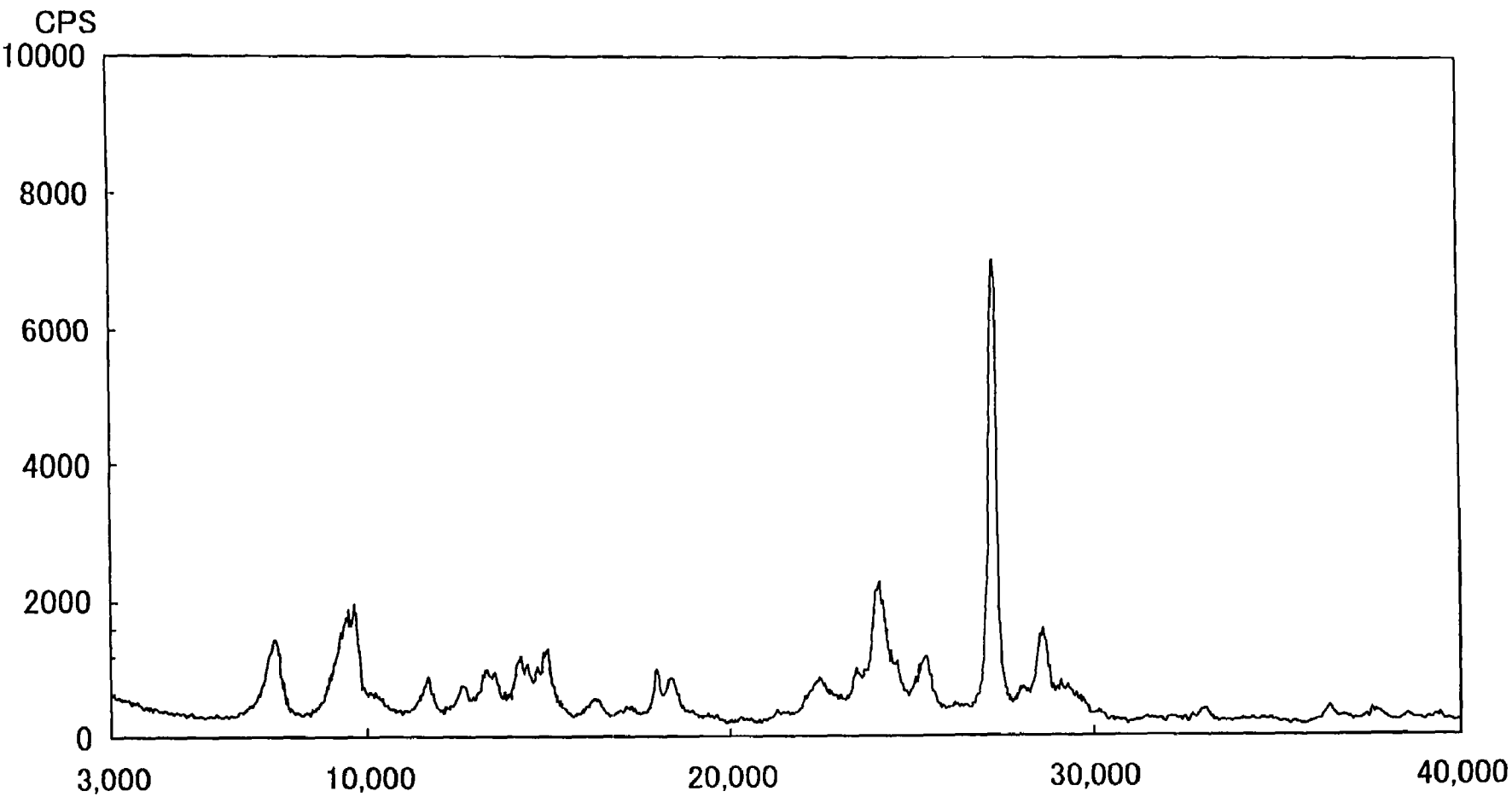
FIG. 19 is a graph illustrating X ray diffraction spectrum of the Measuring Example 2 described later.

A pigment (having the maximum diffraction peak of 7.5°) manufactured in the same manner as described in JOP S61-239248 was added in an amount of 3% by weight to the pigment obtained in Synthesis Example 10 of pigment (having the lowest peak angle of 7.5°) and the mixture was mixed in a mortar. The X ray diffraction spectrum of the mixture was measured as described above. The X-ray diffraction spectrum of Measuring Example 2 is illustrated in FIG. 19.

Figure 18:
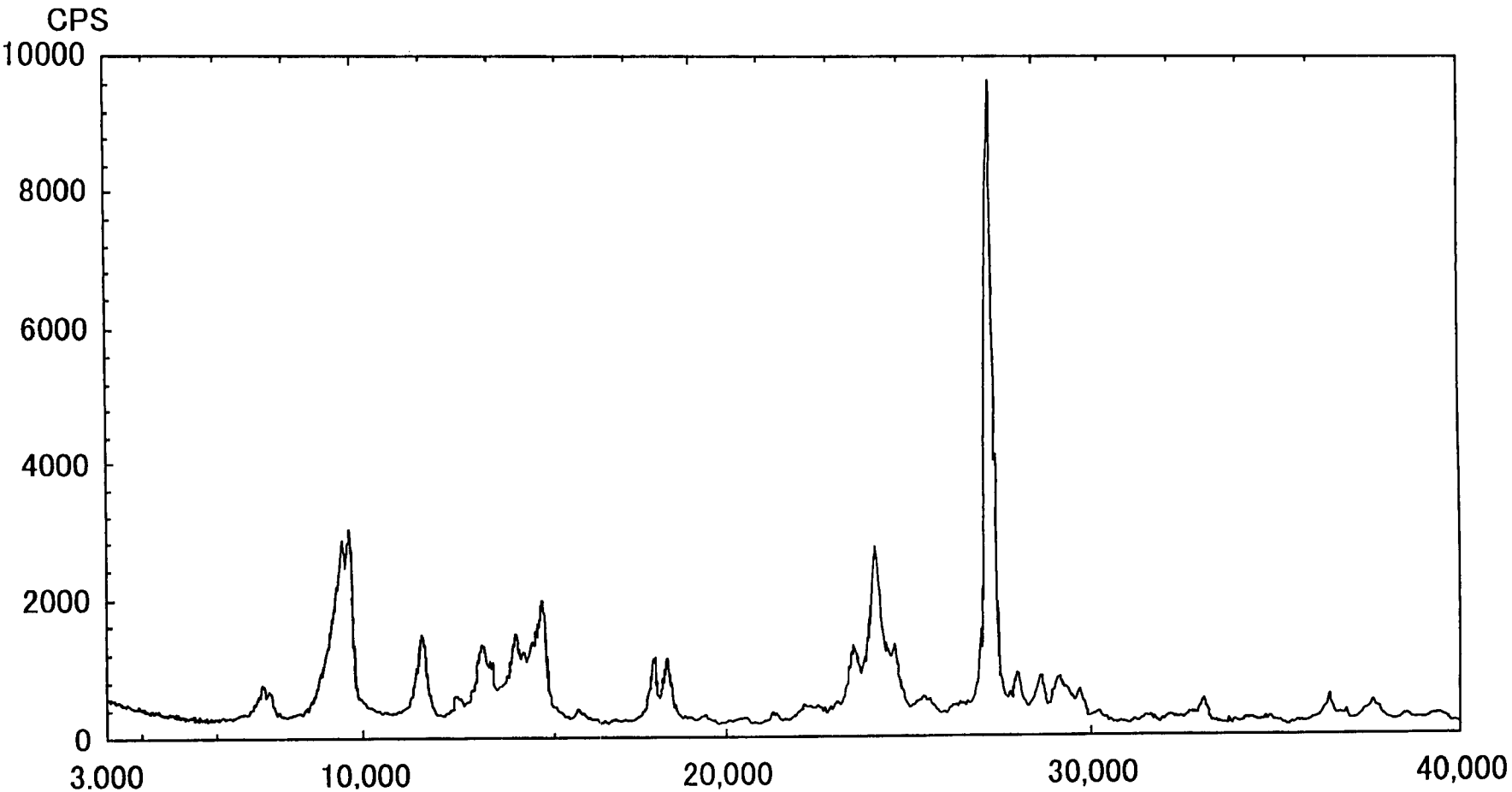
FIG. 18 is a graph illustrating X ray diffraction spectrum of the Measuring Example 1 described later.

In the spectrum of FIG. 18, there are observed two independent peaks at 7.3° and 7.5° on the low angle side. Therefore, it is found that the peaks of 7.3° and 7.5° are different. To the contrary, in the spectrum of FIG. 19, there is only one peak on the low angle side, which is 7.5°, which is obviously different from the spectrum of FIG. 18. That is, the lowest angle peak of 7.3° on the low angle side of the titanyl phthalocyanine crystal for use in the present invention is different from the peak of 7.5° of the known titanyl phtalocyanine crystal.

That is, the lowest angle peak of 7.3° on the low angle side of the titanyl phthalocyanine crystal for use in the present invention is different from the peak of 7.5° of the known titanyl phtalocyanine crystal.

As described above, the image bearing member of the present invention can restrain the decrease of charging during a first rotation of the image bearing member, the rise in the residual voltage, and the occurrence of background fouling and moiré even when the image bearing member is repetitively used. Resultantly, such an image bearing member has a high durability. In addition, in the present invention, an image forming apparatus is provided which can stably output image over time while maintaining the restraint effect against abnormal images with the image bearing member even when the image forming apparatus is repetitively used. Further, an easy handling process cartridge having a high durability for use in the image forming apparatus can be provided by providing the image bearing member therein.

This document claims priority and contains subject matter related to Japanese Patent Applications Nos. 2005-115454 and 2005-183793, filed on Apr. 13, 2005, and Jun. 23, 2005, respectively, the entire contents of which are incorporated herein by reference.

Having now fully described embodiments of the present application, it will be apparent to one of ordinary skill in the art that many changes and modifications can be made thereto without departing from the spirit and scope of embodiments of the invention as set forth herein.

What is claimed as new and desired to be secured by Letters Patent of the United States is:

1. An image bearing member comprising:

an electroconductive substrate;

a charge blocking layer disposed overlying the electroconductive substrate, comprising N-alkoxymethylized nylon and at least one acid selected from the group consisting of fumaric acid, succinic acid, malic acid, and tricarballylic acid;

a moire prevention layer disposed overlying the charge blocking layer, comprising titanium oxide having a purity not less than 99.0% and a cross-linking resin; and a photosensitive layer disposed overlying the moire prevention layer.

2. The image bearing member according to claim 1, wherein a content of the titanium oxide contained in the moiré prevention layer is from 50 to 75% by volume.

3. The image bearing member according to claim 2, wherein the titanium oxide comprises titanium oxide (T1) having a specific surface area of from 5 to 8 $m^2/g$ and titanium oxide (T2) having a surface are of from 20 to 35 $m^2/g$.

4. The image bearing member according to claim 3, wherein a mixing ratio (weight ratio) of the two kinds of titanium oxides satisfies the following relationship: $0.2 \leqq T2/(T1+T2) \leqq 0.6$.

5. The image bearing member according to claim 1, wherein the cross-linking resin contained in the moiré prevention layer is a thermosetting resin which is a mixture of an alkyd resin and a melamine resin with a mixing ratio of the alkyd resin to the melamine resin of from 1 to 4.

6. The image bearing member according to claim 1, wherein a content ratio of the acid to the N-alkoxymethylized nylon is from 0.005 to 0.1.

7. The image bearing member according to claim 1, wherein a layer thickness of the charge blocking layer comprising the N-alkoxymethylized nylon is from 0.5 to 2.0 μm.

8. The image bearing member according to claim 1, wherein the photosensitive layer has a layer structure comprising a charge generating layer and a charge transport layer.

9. The image bearing member according to claim 8, wherein the charge generating layer comprises titanyl phthalocyanine.

10. The image bearing member according to claim 9, wherein the titanyl phthalocyanine has a primary particle diameter of not greater than 0.25 μm and having a crystal form having a CuKα X ray diffraction spectrum having a wavelength of 1.542 Å such that a maximum diffraction peak is observed at a Bragg (2θ) angle of 27.2±0.2°, main peaks at a Bragg (2θ) angle of 9.4±0.2°, 9.6±0.2°, and 24.0±0.2°, and a peak at a Bragg (2θ) angle of 7.3±0.2° as a lowest angle diffraction peak, and having no peak between 9.4±0.2° and 7.3±0.2° and no peak at 26.3±0.2°.

11. The image bearing member according to claim 10, wherein a liquid dispersion is applied to form the photosensitive layer or the charge generating layer and the liquid dispersion is prepared by dispersing the titanyl phthalocyanine such that a crystal thereof has an average particle size not greater than 0.3 μm with a standard deviation not greater than 0.2 μm and filtering the resultant titanyl phthalocyanine with a filter having an effective mesh diameter not greater than 3 μm.

12. The image bearing member according to claim 10, wherein the titanyl phthalocyanine crystal is prepared by performing crystal-conversion of an amorphous or low crystalline titanyl phthalocyanine with an organic solvent under the presence of water, the amorphous or low crystalline titanyl phthalocyanine having an average primary particle diameter not greater than 0.1 μm and having a CuKα X ray diffraction spectrum having a wavelength of 1.542 Å such that a maximum diffraction peak is observed at a Bragg (2θ) angle of 7.0 to 7.5±0.2° with a half value width of at least 1°, and separating and filtrating the crystal converted titanyl phthalocyanine from the organic solvent before a primary average particle diameter of the crystal converted titanyl phthalocyanine is greater than 0.25 μm.

13. The image bearing member according to claim 12, wherein the amorphous titanyl phthalocyanine used for the crystal conversion of the titanyl phthalocyanine is prepared by an acid paste method and washed with a deionized water until the deionized water after washing has at least one of a pH of from 6 to 8 and a specific conductivity not greater than 8 μS/cm.

14. The image bearing member according to claim 12, wherein a ratio by weight of the organic solvent used during the crystal conversion of the titanyl phthalocyanine to the amorphous titanyl phthalocyanine is not less than 30/1.

15. The image bearing member according to claim 1, wherein a protective layer comprising a binder resin is disposed overlying the photosensitive layer.

16. The image bearing member according to claim 15, wherein the protective layer comprises an inorganic dye or a metal oxide having a specific electric resistance not less than $10^{10}$ Ωcm.

17. The image bearing member according to claim 16, wherein the metal oxide is one of alumina, titanium oxide and silica having a specific electric resistance not less than $10^{10}$ Ωcm.

18. The image bearing member according to claim 17, wherein the alumina is α-alumina.

19. The image bearing member according to claim 15, wherein the protective layer comprises a charge transport polymer.

20. The image bearing member according to claim 15, wherein the binder resin contained in the protective layer comprises a cross-linking structure.

21. The image bearing member according to claim 20, wherein the protective layer is formed by curing at least a radical polymeric monomer having three or more functional groups without a charge transport structure and a radical polymeric compound having one functional group with a charge transport structure.

22. The image bearing member according to claim 21, wherein the radical polymeric monomer is at least one of acryloyloxy group and methacryloyloxy group.

23. The image bearing member according to claim 9, wherein the titanyl phthalocyanine crystal is synthesized from a material excluding a halogenated compound.

24. An image forming apparatus comprising:

the image bearing member of claim 1, configured to bear a latent electrostatic image; a charging device configured to charge the image bearing member; an irradiating device configured to irradiate the image bearing member;

a developing device configured to develop the latent electrostatic image;

a transfer device configured to transfer the developed image to a transfer body; and a cleaning device to clean a surface of the image bearing member.

25. An image forming apparatus, comprising:

a process cartridge detachably attached to the image forming apparatus, comprising:

the image bearing member of claim 1; and at least one of the charging device, the irradiating device, the developing device and the cleaning device.

26. A process cartridge comprising:

the image bearing member of claim 1; and at least one of a charging device configured to charge the image bearing member, an irradiating device configured to irradiate the image bearing member, a developing device configured to develop the latent electrostatic image, a transfer device configured to transfer the developed image to a transfer body and a cleaning device configured to clean a surface of the image bearing member.

* * * * *